US006434753B2

(12) United States Patent
Kato

(10) Patent No.: US 6,434,753 B2
(45) Date of Patent: Aug. 20, 2002

(54) HOOK ASSEMBLY USED FOR WAIST-ADJUSTING MECHANISM OF GARMENT AND GARMENT HAVING WAIST-ADJUSTING MECHANISM

(76) Inventor: Koji Kato, 189, Takehana-cho, Hashima, Gifu-ken, 501-6241 (JP)

( * ) Notice: Subject to any disclaimer, the term of this patent is extended or adjusted under 35 U.S.C. 154(b) by 0 days.

(21) Appl. No.: 09/915,359

(22) Filed: Jul. 27, 2001

Related U.S. Application Data

(62) Division of application No. 09/793,755, filed on Feb. 27, 2001.

(30) Foreign Application Priority Data

Mar. 1, 2000 (JP) ..... 2000-55660
May 15, 2000 (JP) ..... 2000-142517
Aug. 3, 2000 (JP) ..... 2000-235227

(51) Int. Cl.[7] ..... A41D 1/06
(52) U.S. Cl. ..... 2/234; 2/235; 2/236
(58) Field of Search ..... 2/235, 234, 236, 2/237, 219, 220, 221

(56) References Cited

U.S. PATENT DOCUMENTS 1,705,562 A * 3/1929 Fretz et al.
1,832,687 A * 11/1931 Boshnack
2,506,411 A * 5/1950 Brohard, Jr. ..... 2/234
2,585,175 A * 2/1952 Rosenberg ..... 2/234
2,680,851 A * 6/1954 Vallone ..... 2/234
2,688,138 A * 9/1954 Glass ..... 2/234
3,149,343 A * 9/1964 Jacobson ..... 2/235
3,760,426 A * 9/1973 Jacob ..... 2/237
3,827,085 A * 8/1974 Ackermann ..... 2/234
4,069,514 A * 1/1978 Palmieri et al. ..... 2/235
4,364,124 A * 12/1982 Barna ..... 2/234
5,144,697 A * 9/1992 Sandbeck ..... 2/236
5,544,366 A * 8/1996 Kato ..... 2/237
5,898,947 A * 5/1999 Page ..... 2/237
6,044,496 A * 4/2000 Ramirez ..... 2/219
6,199,215 B1 * 3/2001 Biggerstaff ..... 2/234
6,292,950 B1 * 9/2001 Mentone ..... 2/236

FOREIGN PATENT DOCUMENTS

JP 2518803 5/1996
JP 2518804 5/1996
JP 2518807 5/1996
JP 2578079 11/1996

* cited by examiner

*Primary Examiner*—Gloria M. Hale
*Assistant Examiner*—Alissa L. Hoey
(74) *Attorney, Agent, or Firm*—Armstrong, Westerman & Hattori, LLP

(57) ABSTRACT

A front center opening can be opened and closed by a zip fastener. A hook assembly joins upper ends of the front center opening in a separable way and adjusts a waist size of pants within a fixed range. An adjusting cloth is sewed between one of fastener tapes of the zip fastener and an outer cloth of the front center opening. The adjusting cloth has an overlap to provide an extra length on the waist size of the pants. The hook assembly adjusts the waist size of the pants so as to fit a waist size of a user. The overlap of the adjusting cloth is extended in a specified manner so as to adjust a size of the pants corresponding to a portion lower than the waist of the user.

10 Claims, 47 Drawing Sheets

HOOK ASSEMBLY USED FOR WAIST-ADJUSTING MECHANISM OF GARMENT AND GARMENT HAVING WAIST-ADJUSTING MECHANISM

This application is a division of prior application Ser. No. 09/793,755 filed Feb. 27, 2001.

BACKGROUND OF THE INVENTION

1. Field of the Invention

This invention relates to a hook assembly for a garment that joins a parted portions of a waist of a garment such as pants and a skirt, a decorative hook assembly that joins a portion of a decorative belt or a decorative cover, and a garment having a waist-adjusting mechanism composed of a fastener such as those hook assemblies attached thereto. Particularly, the invention relates to a garment having a waist-adjusting mechanism that can be adjusted to a waist size of a user such as pants having a waist-adjusting mechanism or a skirt having a waist-adjusting mechanism.

2. Description of the Related Art

Generally, the pants or skirt have a waist parted so as to be opened thereat. Commonly, the parted portions are joined by a hook assembly 200 shown in FIG. 75.

FIG. 75 is an exploded perspective view showing a conventional hook assembly.

Referring to FIG. 75, the hook assembly 200 has a hook element 200A and a socket 241. The hook element 200A has a hook shape that is attached to a rear side of a waist part of an outer cloth 310 of pants or a skirt. The socket element 241 is attached to a front side of a waist part of an inner cloth 320. The hook element 200A is engaged with the socket 241 to connect the waist of the pants or skirt so as to be opened.

The conventional hook assembly is described more specifically.

As shown in FIG. 75, the hook assembly 200 has the hook element 200A and a socket element 200B. The hook element 200A is composed of a hook body 202 having a single hook 221 and a hook attachment plate 203. The socket element 200B is composed of a socket body 204 having a single socket 241 and a socket attachment plate 205. The hook 221 can be caught on in the socket 241. Two hook claws 202*b* are formed on an outer edge of the hook body 202. The hook claws 202*b* are bent nearly perpendicularly to a rear side of the hook body 202. These two hook claws 202*b* have a sharp pointed end so as to go through the cloth or the like. The hook attachment plate 203 has through holes 203*a* so as to have the hook claws 202*b* inserted therein, respectively.

Socket claws 204*c* are formed at opposite ends of the socket 241. The socket claws 204*c* are bent nearly perpendicularly to a rear side of the socket 241. The socket attachment plate 205 have through holes 205*a* so as to have these two socket claws 204*b* of the socket body 240 inserted therein, respectively.

The hook body 202 is fitted to the rear side of the outer cloth 310 of the pants or skirt so that the outer cloth 310 is held between the hook body 202 and the hook attachment plate 203. At this time, the hook claws 202*b* are inserted into the corresponding through holes 203*a* of the hook attachment plate 203 and bent, so that the hook body 202 and the hook attachment plate 203 are joined.

The socket body 204 is fitted to the front side of the inner cloth 320 of the pants or skirt so that the inner cloth 320 is held between the socket body 204 and the socket attachment plate 205. The socket claws 204*c* are inserted into the corresponding through holes 205*a* of the socket attachment plate 205 and bent, so that the socket body 204 and the socket attachment plate 205 are joined.

As described above, the hook element 200A is fixed and attached to the one cloth of the parted portions of the waist of the pants or skirt by holding it between the hook body 202 and the hook attachment plate 203. Moreover, the socket element 200B is attached to the other cloth of the parted portions of the waist of the pants or skirt by holding it between the socket body 204 and the socket attachment plate 205.

Some conventional pants can open a front center part via a zip fastener. Commonly, such pants has an upper end of the front center part joined not only by the zip fastener but also by a hook such as the hook assembly 200 in a separable way.

Specifically, when putting on the pants, a user uncouple the hook such as the hook assembly 200 and opens the zip fastener. Then, the user lets his or her legs pass through the pants. Next, the user couples the upper ends of the front center part via the hook. Thereafter, the user closes the zip fastener. At this time, some hooks can adjust their length to a small extent at the joined portion. For example, a socket member is fixed to the upper part of the inner cloth at the front center part. A hook member is secured to the upper part of the outer cloth at the front center part so that the hook member is urged by a spring so as to slide and move within a predetermined range in a waist size direction of the pants. Then, the hook member is engaged with the socket member so as to connect the upper end of the front center part of the pants. With such hook, if an external force is applied to the pants in such a direction as to enlarge the waist size of the pants, the hook member moves outwardly at the edge of the outer cloth. Thus, the waist of the pants can be enlarged. Therefore, the waist of the pants is adjusted to a body shape of the user when he or she puts on the pants.

However, in the conventional hook assembly 200, the positions of the hook element 200A and the socket element 200B are uniquely decided depending on their fitted positions. Therefore, it is impossible to adjust the waist size of the pants or skirt.

The inventor of the present application also has several inventions about pants and the like with a waist-adjustable mechanism as disclosed in Japanese Patent Nos. 2518803, 2518804, 2518807 and 2518079.

However, these inventions have complicated mechanisms, so that the prices thereof cannot be low. The above-mentioned hook with the slide mechanism has the same problem. Thus, there has been desired pants and the like that are inexpensive and capable of adjusting the waist size.

Moreover, with the hook that can adjust the waist size of the pants and the like or the hook assembly that can adjust the hooking position, the waist size of the pants can be adjusted only at a waist belt. If the waist size of the user is larger, a size becomes larger not only at the waist but also at a portion around the waist accordingly. Therefore, even if the waist size of the belt is adjusted according to the waist size of the user, the other portion does not change the size. Thus, when the user puts on the pants, the pants will be still tight for the user. In addition, the dimension of the lower part of the waist belt may become short. In this case, the portion around the front center part is pulled, thereby deteriorating the appearance.

On the other hand, if the lower part of the waist belt is given a room, the lower part becomes excessive when the waist size of the user becomes smaller, thereby generating wrinkles on the pants and affecting the appearance.

BRIEF SUMMARY OF THE INVENTION

It is an object of the invention to provide a hook assembly that is capable of adjusting a hooking position.

It is another object of the invention to provide a garment with a waist-adjusting mechanism that does not affect a feeling of a user in wearing the garment and that an appearance thereof improves even if there is a change of not only a waist size but also a size around the waist of the user to a certain degree.

According to a first aspect of the invention, there is provided a hook assembly in which a hook of a hook element is caught and fitted on a socket of a socket element. The hook assembly comprises a hook element made of one of a metal and a synthetic resin and a socket element made of one of a metal and a synthetic resin. The hook element comprises a hook body having a plurality of hooks formed on a specific first side thereof at fixed intervals in the hooking direction, three or more bendable hook claws formed on a second side that is opposite to the first side, and a hook attachment plate of a sheet shape facing the second side, the hook attachment plate having through holes in which the hook claws are inserted, respectively. The socket element comprising a socket body having a plurality of sockets formed at fixed intervals in the hooking direction, three or more bendable socket claws formed on the socket body, and a socket attachment plate of a sheet shape facing a side of the socket body on which the socket claws are formed, the socket attachment plate having through holes in which the socket claws are inserted, respectively.

According to a second aspect of the invention, there is provided a hook element used in a hook assembly in which a hook of a hook element is caught and fitted on a socket of a socket element. The hook element is made of one of a metal and a synthetic resin. The hook element comprises a hook body having a plurality of hooks formed on a specific first side thereof at fixed intervals in the hooking direction, three or more bendable hook claws formed on a second side that is opposite to the first side, and a hook attachment plate of a sheet shape facing the second side, the hook attachment plate having through holes in which the hook claws are inserted, respectively.

According to a third aspect of the invention, there is provided a socket element used in a hook assembly in which a hook of a hook element is caught and fitted on a socket of a socket element. The socket element is made of one of a metal and a synthetic resin. The socket element comprises a socket body having a plurality of sockets formed at fixed intervals in the hooking direction, three or more bendable socket claws formed on the socket body, and a socket attachment plate of a sheet shape facing a side of the socket body on which the socket claws are formed, the socket attachment plate having through holes in which the socket claws are inserted, respectively.

A hook assembly may comprise the above mentioned hook element and the following socket element made of one of a metal and a synthetic resin. The socket element comprises a socket body having a single socket that hooks the hook of the hook body, two bendable socket claws formed on the socket body, and a socket attachment plate of a sheet shape facing the socket body, the socket attachment plate having through holes in which the socket claws are inserted, respectively.

A hook assembly may comprise the above mentioned socket element and the following hook element. The hook element is made of one of a metal and a synthetic resin. The hook element comprises a hook body having a single hook formed on a specific first side thereof, three or more bendable hook claws formed on a second side that is opposite to the first side, and a hook attachment plate of a sheet shape facing the second side, the hook attachment plate having through holes in which the hook claws are inserted, respectively.

According to a fourth aspect of the invention, there is provided a hook assembly in which a hook of a hook element is caught and fitted on a socket of a socket element. The hook assembly comprises a hook element made of one of a metal and a synthetic resin and a socket element made of one of a metal and a synthetic resin. The hook element comprises a hook body having a plurality of hooks formed on a specific first side thereof at fixed intervals in the hooking direction, and four or more hook fitting holes formed on the hook body at positions located on imaginary lines that are perpendicular to the hooking direction. The socket element comprises a socket body having a plurality of sockets formed at fixed intervals in the hooking direction, and four or more socket fitting holes formed on the socket body at positions located on imaginary lines that are perpendicular to the hooking direction.

According to a fifth aspect of the invention, there is provided a hook element used in a hook assembly in which a hook of a hook element is caught and fitted on a socket of a socket element. The hook element is made of one of a metal and a synthetic resin. The hook element comprises a hook body having a plurality of hooks formed on a specific first side thereof at fixed intervals in the hooking direction, and four or more hook fitting holes formed on the hook body at positions located on imaginary lines that are perpendicular to the hooking direction.

According to a sixth aspect of the invention, there is provided a socket element used in a hook assembly in which a hook of a hook element is caught and fitted on a socket of a socket element. The socket element is made of one of a metal and a synthetic resin. The socket element comprises a socket body having a plurality of sockets formed at fixed intervals in the hooking direction, and four or more socket fitting holes formed on the socket body at positions located on imaginary lines that are perpendicular to the hooking direction.

A hook assembly may comprises the above mentioned hook element and the following socket element being made of one of a metal and a synthetic resin. The socket element comprises a socket body having a single socket that hooks the hook of the hook body, and two socket fitting holes formed on the socket body at positions located on an imaginary line that is perpendicular to the hooking direction.

A hook assembly may comprise the above mentioned socket element and the following hook element. The hook element is made of one of a metal and a synthetic resin. The hook element comprises a hook body having a single hook formed on a specific first side thereof, and three or more hook fitting holes formed on the hook body at a position located on an imaginary line extending in the hooking direction as well as at positions located on an imaginary line that is perpendicular to the hooking direction.

In a hook assembly, positions of the plural hooks and positions of the plural sockets may be set such that a hooking position between the hook and the socket is changeable within a range of 10 to 30 mm.

In a hook assembly, the socket body may further comprise connecting bridges formed at longitudinal end portions of the sockets, the connecting bridges connecting the plural sockets with each other.

In a hook assembly, the hook body and/or the socket body may further comprise a bulged portion formed in part.

In a hook assembly, the hook body and/or the socket body may further comprise accommodating dents, part of the hook claw and/or part of the socket claw being accommodated in the accommodating dent.

According to an eighth aspect of the invention, there is provided a waist adjustable garment. The garment comprises a hook assembly joining one and another parts of the garment in a separable way and adjusting a waist size of the garment within a predetermined range. An adjusting cloth of substantially a tubular shape extends substantially in a vertical direction. The adjusting cloth is sewed on the one part of the garment and capable of changing its shape within such a range as the hook assembly adjusts the waist size of the garment. A zip fastener has one and another fastener tapes. The one fastener tape to be a seam allowance is stitched to the adjusting cloth, while the other fastener tape to be a seam allowance is stitched to the other part of the garment.

A waist adjustable garment may further comprise a shape keeper provided on the adjusting cloth. The shape keeper urges the adjusting cloth so as to keep a fixed shape of the adjusting cloth.

In a waist adjustable garment, an upper end portion of the fastener tape may be stitched to the garment while inclined in an outside direction toward a front center opening of the garment.

In a waist adjustable garment, the fastener tape may be stitched only to the adjusting cloth while an upper end of the fastener tape being located at a same position as an upper end of the adjusting cloth.

A waist adjustable garment may further comprise a slit formed on a lining of the garment at a position where a lateral end portion of the adjusting cloth is stitched. The lateral end portion of the adjusting cloth is inserted into the slit and stitched to a rear side of the lining.

In a waist adjustable garment, the fastener tape may be stitched to the adjusting cloth at such an inclination as the fastener tape has an upper portion opened toward the hook assembly in relation to the adjusting cloth.

In a waist adjustable garment, the adjusting cloth may have a width becoming smaller gradually toward a lower end from an upper end or from a position that is lower than the upper end by a fixed length downward.

According to a ninth aspect of the invention, there is provided a waist adjustable garment. A joint tool joins upper ends of a front center opening of the garment in a separable way and adjusting a waist size of the garment at a joined area within a predetermined range. An adjusting cloth of substantially a tubular shape extends substantially in a vertical direction. The adjusting cloth is sewed on one of separated portions of the front center opening. The adjusting cloth is capable of changing its shape between the upper end and a lower end of the front center opening within such a range as the joint tool adjusts the waist size of the garment. A zip fastener has one and another fastener tapes. The one fastener tape to be a seam allowance is stitched to the adjusting cloth, while the other fastener tape to be a seam allowance is stitched to another separated portion of the front center opening.

A waist adjustable garment may further comprise a shape keeper provided on the adjusting cloth. The shape keeper urges the adjusting cloth so as to keep a fixed shape of the adjusting cloth.

A waist adjustable garment may further comprise a buttonhole piece protruding from a lateral edge of an inner cloth of the front center opening. The buttonhole piece has a buttonhole for catching a button provided on the outer cloth of the front center opening. The buttonhole is a slot having a component that extends in a direction of the waist within such a fixed range as to adjust the waist size of the garment.

In a waist adjustable garment, an upper end portion of the fastener tape may be held and stitched inside a belt lining while inclined in an outside direction toward a lateral edge of the outer cloth.

In a waist adjustable garment, the fastener tape may be stitched only to the adjusting cloth while an upper end of the fastener tape being located at a same position as an upper end of the adjusting cloth.

A waist adjustable garment may further comprise a slit formed on a lining of the outer cloth at a position where a lateral end portion of the adjusting cloth is stitched. The lateral end portion of the adjusting cloth is inserted into the slit and stitched to a rear side of the lining.

In a waist adjustable garment, the adjusting cloth may have a width becoming smaller gradually toward a lower end from an upper end or from a position that is lower than the upper end by a fixed length downward.

According to a tenth aspect of the invention, there is provided a waist adjustable garment. A joint tool joins one and another parts of the garment in a separable way and adjusts a waist size of the garment within a predetermined range. A tuck is provided on the one part of the garment so as to extend substantially in a vertical direction. The tuck is capable of changing its shape within such a range as the joint tool adjusts the waist size of the garment. A zip fastener has one and another fastener tapes. The one fastener tape to be a seam allowance is stitched to the tuck, while the other fastener tape to be a seam allowance is stitched to the other part of the garment.

A waist adjustable garment may further comprise a lining provided on a rear side of the one part of the garment over an area that is wider than a width of the tuck. The lining is stitched thereto at positions beyond lateral ends of the tuck.

In a waist adjustable garment, a folded part of the one part of the garment may be stuck by an adhesive double coated tape to a rear side of the one part of the garment near the tuck.

In a waist adjustable garment, the one part of the garment may be sewed in a vertical direction between a lateral end of the one part of the garment and the tuck.

In a waist adjustable garment, an inner folded part of the tuck may be pressed by an iron.

In a waist adjustable garment, an inner folded part of the tuck may be pleated.

In a waist adjustable garment, an inner folded part of the tuck may be stitched along a crease of the inner folded part of the tuck near the crease.

In a waist adjustable garment, an upper end portion of the fastener tape may be stitched to the garment while inclined in an outside direction toward a front center opening of the garment.

A waist adjustable garment may further comprise a sliding tape. An upper end of the one fastener tape is stitched to an upper end of the one part of the garment via the sliding tape. The sliding tape is stitched at an inclination in an outside direction toward a front center opening of the garment.

A waist adjustable garment may further comprise two elastic tapes. An upper end of the one fastener tape is stitched to an upper end of the one part of the garment via the elastic tapes. The elastic tapes is stitched to the garment so as to define substantially a V-shape in combination.

An exposed surface of the hook element or the socket element may be a dull surface. To the contrary, it may be a polished surface. The hook element and the socket element have their edges chamfered as a whole in a normal use of the invention. The hook claws and the socket claws are provided in four around the hook element and the socket element, respectively, in a standard use of the invention. Alternatively, the hook claws may be three, while cutting and picking up one hook claw from the hook body itself. The shape and the area such as the width of each of the hooks and sockets may be set as desired according to a practical use. For example, if they are attached to the waist of the pants or skirt, the shape and so on are set such that the hook element and the socket element are firmly hooked on each other and hard to be detached from each other.

The adjusting cloth is provided on the outer cloth of the front center opening in view of appearance. Alternatively, it may be provided on the inner cloth of the front center opening. A variety of cloths are available as the material of the adjusting cloth such as a cloth of the same kind as the garment. Alternatively, an elastic material such as a rubber or spandex may be used.

Further objects and advantages of the invention will be apparent from the following description, reference being had to the accompanying drawings, wherein preferred embodiments of the invention are clearly shown.

DETAILED DESCRIPTION OF THE INVENTION

Figure 1:
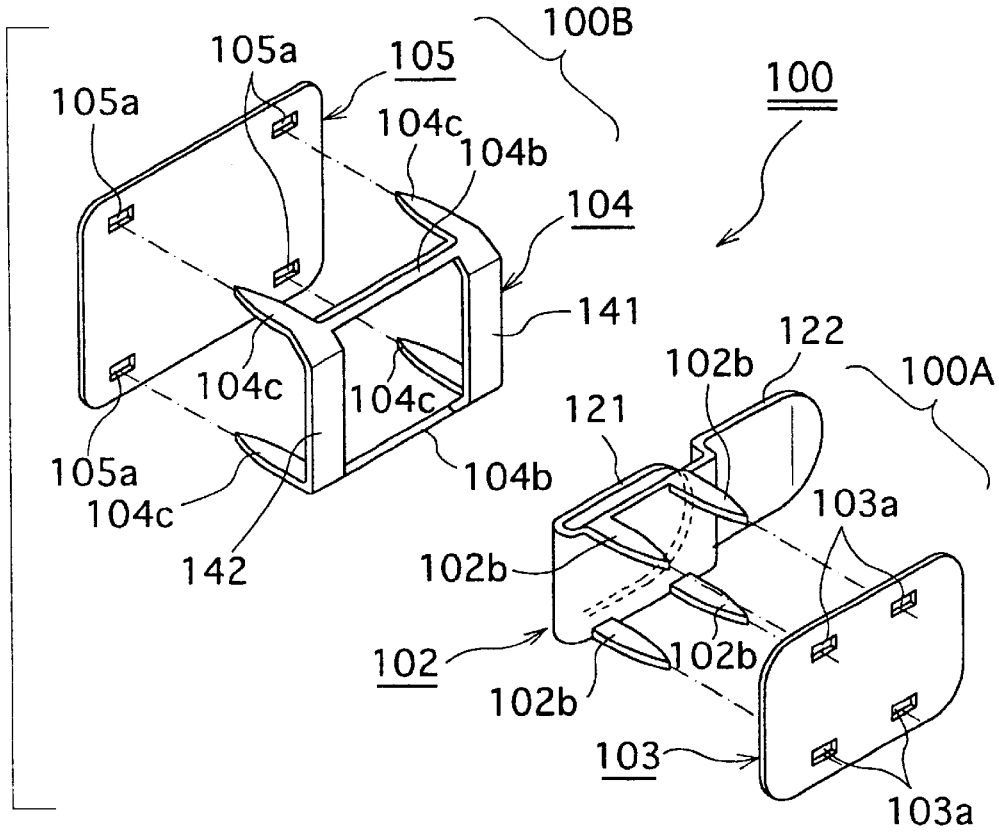
FIG. 1 is an exploded perspective view of a hook assembly according to a first embodiment of the invention.

Several embodiments of the invention are described hereafter referring to the attached drawings. The same reference numeral or symbol is attached to a same member or element throughout the several embodiments.

FIRST EMBODIMENT

Figure 2:
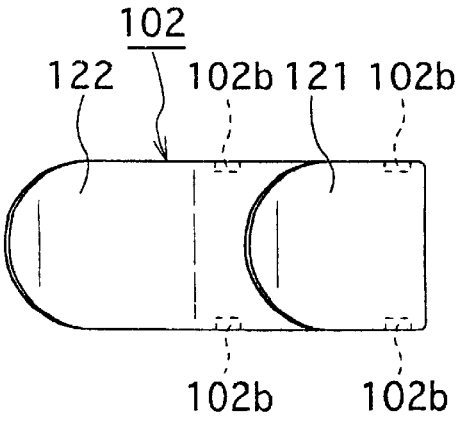
FIG. 2 is a front elevation of a hook body of a hook element of the hook assembly according to the first embodiment of the invention.
Figure 3:
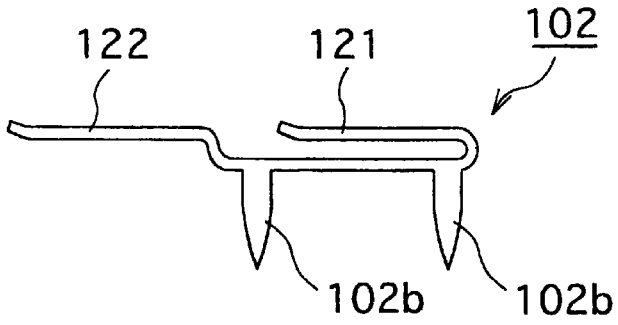
FIG. 3 is a plan view of the hook body of the hook element of the hook assembly according to the first embodiment of the invention.
Figure 4:
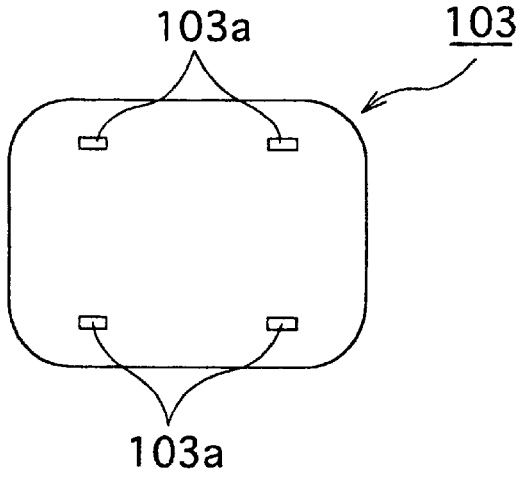
FIG. 4 is a front elevation of a hook attachment plate of the hook element of the hook assembly according to the first embodiment of the invention.
Figure 5:
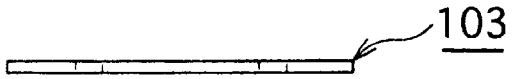
FIG. 5 is a plan view of the hook attachment plate of the hook element of the hook assembly according to the first embodiment of the invention.
Figure 6:
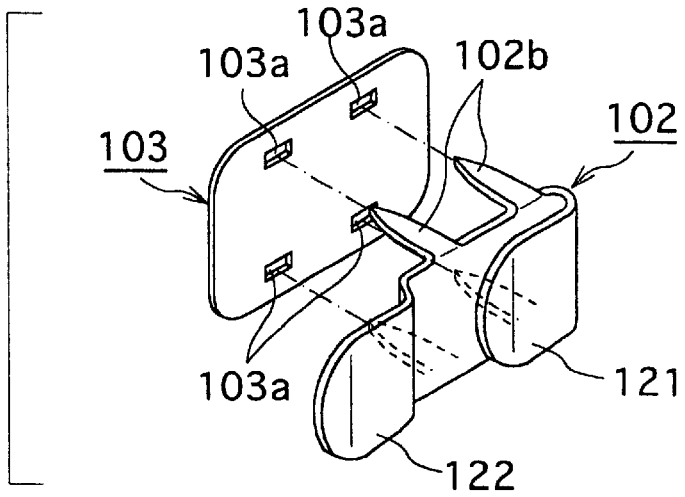
FIG. 6 is an exploded perspective view of the hook element of the hook assembly according to the first embodiment of the invention.

FIG. 1 is an exploded perspective view of a hook assembly according to a first embodiment of the invention. FIG. 2 is a front elevation of a hook body of a hook element of the hook assembly according to the first embodiment of the invention. FIG. 3 is a plan view of the hook body of the hook element of the hook assembly according to the first embodiment of the invention. FIG. 4 is a front elevation of a hook attachment plate of the hook element of the hook assembly according to the first embodiment of the invention. FIG. 5 is a plan view of the hook attachment plate of the hook element of the hook assembly according to the first embodiment of the invention. FIG. 6 is an exploded perspective view of the hook element of the hook assembly according to the first embodiment of the invention.

Figure 7:
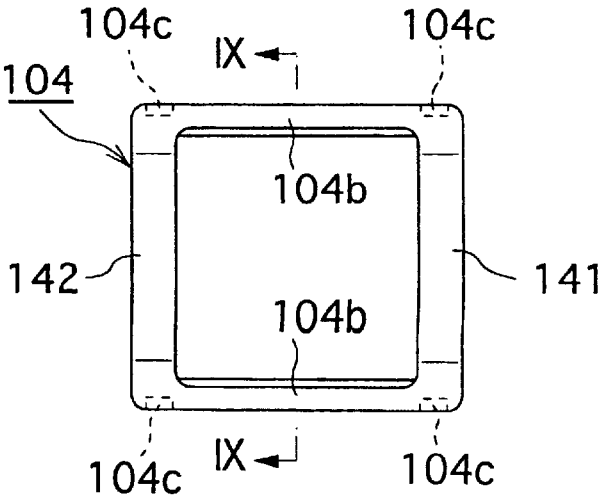
FIG. 7 is a front elevation of a socket body of a socket element of the hook assembly according to the first embodiment of the invention.
Figure 8:
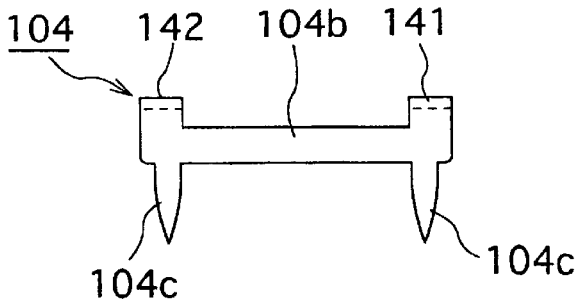
FIG. 8 is a plan view of the socket body of the socket element of the hook assembly according to the first embodiment of the invention.
Figure 9:
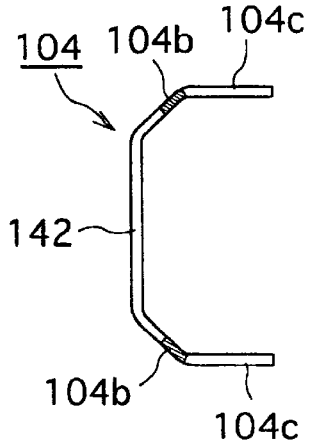
FIG. 9 is a cross-sectional view taken along the line IX—IX of FIG. 7.
Figure 10:
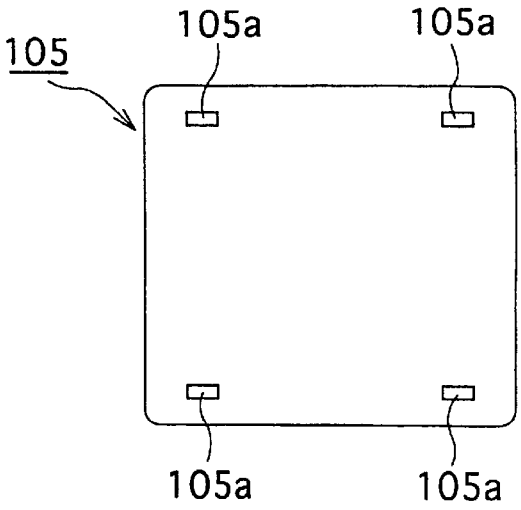
FIG. 10 is a front elevation of a socket attachment plate of the socket element of the hook assembly according to the first embodiment of the invention.
Figure 11:
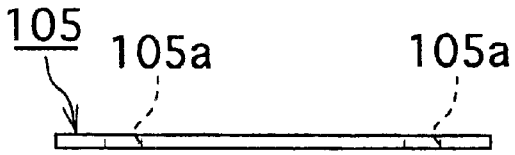
FIG. 11 is a side elevation of the socket attachment plate of the socket element of the hook assembly according to the first embodiment of the invention.

FIG. 7 is a front elevation of a socket body of a socket element of the hook assembly according to the first embodiment of the invention. FIG. 8 is a plan view of the socket body of the socket element of the hook assembly according to the first embodiment of the invention. FIG. 9 is a cross-sectional view taken along the line IX—IX of FIG. 7. FIG. 10 is a front elevation of a socket attachment plate of the socket element of the hook assembly according to the first embodiment of the invention. FIG. 11 is a side elevation of the socket attachment plate of the socket element of the hook assembly according to the first embodiment of the invention.

As shown in FIG. 1 to FIG. 11, a hook assembly 100 according to a first embodiment is made of a metal or a synthetic resin. Describing schematically the hook assembly, it has a hook element 100A and a socket element 100B. The hook element 100A is composed of a hook body 102 and a hook attachment plate 103. The hook body 102 has two hooks 121 and 122 that are lined at a fixed interval in a hooking direction, which is a direction along a waist of pants or a skirt. The socket element 100B is composed of a socket body 104 and a socket attachment plate 105. The socket body 104 has two sockets 141 and 142 that are lined at a fixed interval in the hooking direction and that are engageable with the hooks 121 and 122, respectively. The hook body 102 and the hook attachment plate 103 hold therebetween one of parted portions of a waist of the pants or skirt, so that the hook element 100A is secured at the one of the parted portions. On the other hand, the socket body 104 and the socket attachment plate 105 hold therebetween the other of the parted portions of the waist of the pants or skirt, so that the socket element 100B is secured at the other of the parted portions. The hook element 100A and the socket element 100B are made of a metal or a synthetic resin.

The hook body 102 is fabricated by cutting and bending a metal sheet, which is hard to deform, into a desired shape. Those two hooks 121 and 122 of the hook body 102 stand in a line at a predetermined interval in such a direction as hooked on the sockets 141 and 142 of the socket body 104. Four hook claws 102*b* are formed on a circumference of the hook body 102 except a part of the hooks 121 and 122. These hook claws 102*b* are bent generally at right angles toward a rear side of the hook body 102. Particularly, it is not preferable to bend the hook 122 of the hook body 102 so that its bent portion extends from the hook body 102 while gradually changing its angle. It is preferable to bend it so that such portion is bent perpendicularly or in a reverse direction so that the socket 141, 142 is hooked thereon. Thus, the hook 122 is stably engageable with the socket 141, 142.

Those four hook claws 102*b* have a sharp pointed end so that their end can go through a cloth or the like. Particularly, it is preferable to form each in a wedge shape or make their length short so that they are not overlaid on each other when they are bent.

The hook attachment plate 103 is made of a metal sheet that is hard to deform as the hook body 102. The hook attachment plate 103 has through holes 103*a* so as to insert those four hook claws 102*b* therein, respectively.

The socket body 104 is fabricated by cutting and bending a metal sheet, which is hard to deform, into a desired shape. Those two sockets 141 and 142 of the socket body 104 stand in a line at a predetermined interval in such a direction as engaged with the hooks 121 and 122 of the hook body 102. Opposite ends of the sockets 141 and 142 are bridged by connecting portions 104*b*, respectively. Socket claws 104*c* are formed on the opposite ends of the sockets 141 and 142, respectively. These socket claws 104*c* are bent generally at right angles toward a rear side of the socket 141, 142.

The socket attachment plate 105 is made of a metal sheet that is hard to deform. The socket attachment plate 105 has through holes 105*a* so as to insert those four socket claws 104*c* therein, respectively.

Figure 12:
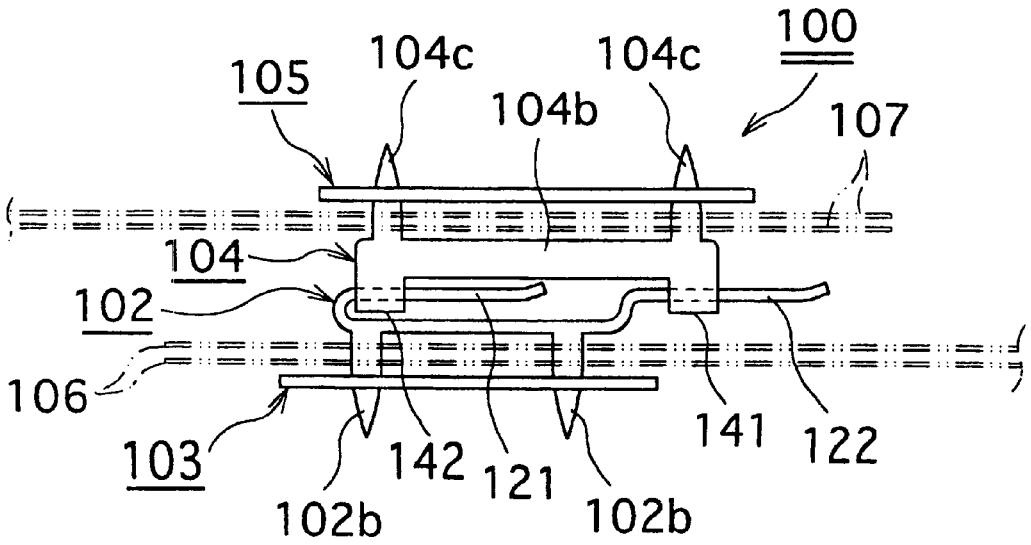
FIG. 12 is a plan view showing how the hook element and the socket element are coupled with each other in the first embodiment of the invention.

The hook assembly 100 is used while fixed on the parted portions of the pants or skirt as shown in FIG. 12, thereby making it possible for the parted portions to be joined and separated.

FIG. 12 is a plan view showing how the hook element 100A and the socket element 100B are coupled with each other in the first embodiment of the invention.

The hook body 102 is attached to the rear side of the outer cloth 106 of the pants or skirt so that the outer cloth 106 is held between the hook body 102 and the hook attachment plate 103. At this time, those four hook claws 102*b* of the hook body 102 are inserted into the corresponding through holes 103*a* of the hook attachment plate 103, respectively, and bent thereafter. Thus, the hook body 102 and the hook attachment plate 103 are joined each other. Moreover, the hooking direction of the hook 121, 122 is directed inward of the edge of the outer cloth 106.

The socket body 104 is attached to the front side of the inner cloth 107 of the pants or skirt so that the inner cloth 107 is held between the socket body 104 and the socket attachment plate 105. At this time, those four socket claws 104*c* of the socket body 104 are inserted into the corresponding through holes 105*a* of the socket attachment plate 105, respectively, and bent thereafter. Thus, the socket body 104 and the socket attachment plate 105 are joined each other. Moreover, the socket 141, 142 is faced in such a direction as to be hooked by the hook 121, 122.

The outer cloth 106 and the inner cloth 107 shown by two-dot chain lines in FIG. 12 have only a belt interlining. However, each of the outer cloth 106 and the inner cloth 107 actually has a cloth covering an outside of the belt interlining. Then, the hook attachment plate 103 and the socket attachment plate 105 are embedded inside the covered portion of the belt interlining.

The hook 121, 122 of the hook body 102 is engaged with the socket 141, 142 of the socket body 104 so as to join the waist-parted portions of the pants or skirt.

Next, it is described how the hook 121, 122 of the hook body 102 and the socket 141, 142 of the socket body 104 are joined.

FIG. 13*a* to FIG. 13*d* are explanatory drawings, in plan views, showing one way of coupling between the hook body and the socket body according the first embodiment of the invention. FIG. 14*a* to FIG. 14*d* are explanatory drawings, in plan views, showing another way of coupling between the hook body and the socket body according the first embodiment of the invention.

As shown in FIG. 13*a* to FIG. 13*d*, if the distance between the hooks 121 and 122 is at least smaller than an inner dimension between the sockets 141 and 142, each of the hooks 121 and 122 can be engaged with each of the sockets 141 and 142 without any stress.

Figure 13A:
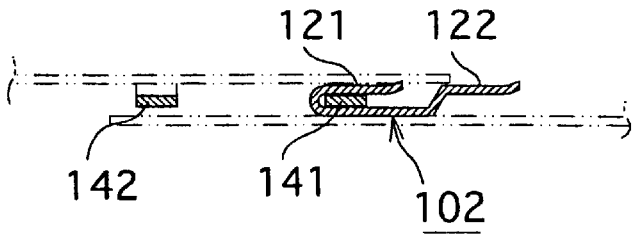
FIG. 13*a* to FIG. 13*d* are explanatory drawings, in plan views, showing one way of coupling between the hook body and the socket body according the first embodiment of the invention.

FIG. 13*a* to FIG. 13*d* show several states as follows:

FIG. 13*a* shows a state in which the hook 121 of the hook body 102 is hooked on the socket 142 of the socket body 104.

Figure 13B:
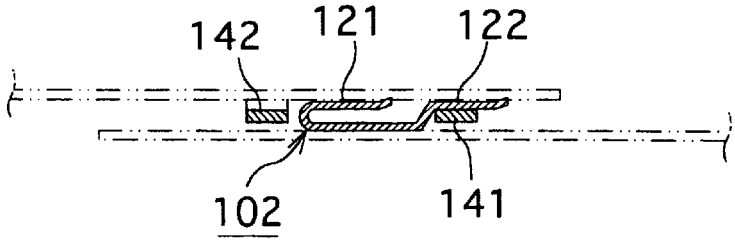

FIG. 13*b* shows a state in which the hook 121 of the hook body 102 is hooked on the socket 141 of the socket body 104.

Figure 13C:
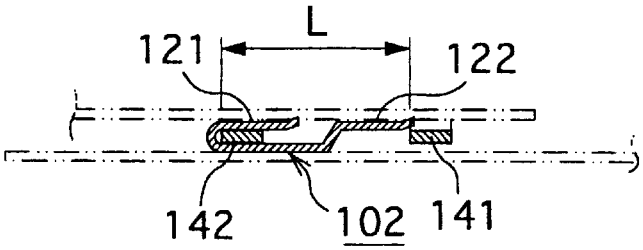

FIG. 13*c* shows a state in which the hook 122 of the hook body 102 is hooked on the socket 141 of the socket body 104.

Figure 13D:
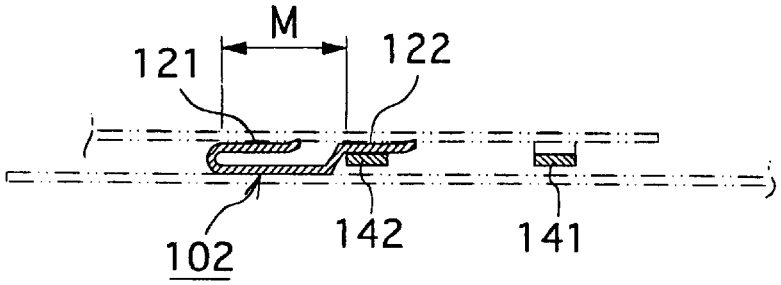

FIG. 13*d* shows a state in which the hook 122 of the hook body 102 is hooked on the socket 142 of the socket body 104.

It will be seen that a joining depth between the hook body 102 and the socket body 104 changes according to the states of FIG. 13*a* to FIG. 13*d*.

That is, the hook assembly 100 of the first embodiment can adjust the waist size of the pants or skirt in four steps. When the hook body 102 moves from the state shown in FIG. 13*a* to the state shown in FIG. 13*c*, the hook body 102 changes its position by the distance L between the sockets 141 and 142 of the socket body 104. When the hook body 102 moves from the state shown in FIG. 13*c* to the state shown in FIG. 13*d*, the hook body 102 changes its position by the distance M between the hooks 121 and 122 thereof.

Therefore, the hook assembly 100 can adjust the waist size of the pants or skirt within a distance L+M which adds the distance between the sockets 141 and 142 and the distance between the hooks 121 and 122. Particularly, if the distance between the hooks 121 and 122 is at least smaller than the inner dimension between the sockets 141 and 142, the waist size of the pants or skirt can be adjusted in four steps without any stress.

Similarly, the hook assembly 100 can adjust the waist size of the pants or skirt in four steps without any stress even if the distance between the hooks 121 and 122 is at least larger than an outer dimension between the sockets 141 and 142, as shown in FIG. 14*a* to FIG. 14*d*. In this case, the hook assembly 100 can adjust the waist size of the pants or skirt within a distance L+M which adds the distance between the sockets 141 and 142 and the distance between the hooks 121 and 122, too.

Figure 14A:
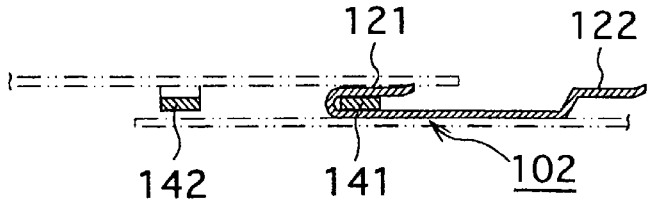
FIG. 14*a* to FIG. 14*d* are explanatory drawings, in plan views, showing another way of coupling between the hook body and the socket body according the first embodiment of the invention.

FIG. 14*a* to FIG. 14*d* show several states as follows:

FIG. 14*a* shows a state in which the hook 121 of the hook body 102 is hooked on the socket 142 of the socket body 104.

Figure 14B:
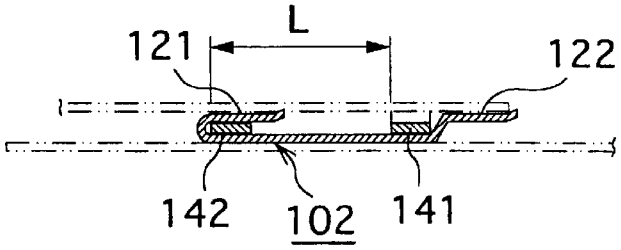

FIG. 14*b* shows a state in which the hook 121 of the hook body 102 is hooked on the socket 141 of the socket body 104.

Figure 14C:
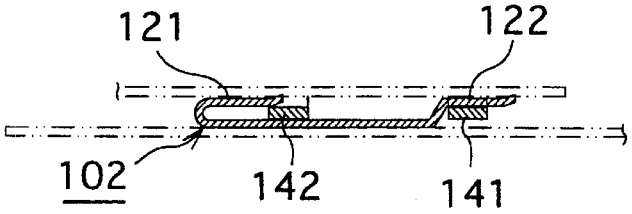

FIG. 14*c* shows a state in which the hook 122 of the hook body 102 is hooked on the socket 141 of the socket body 104.

Figure 14D:
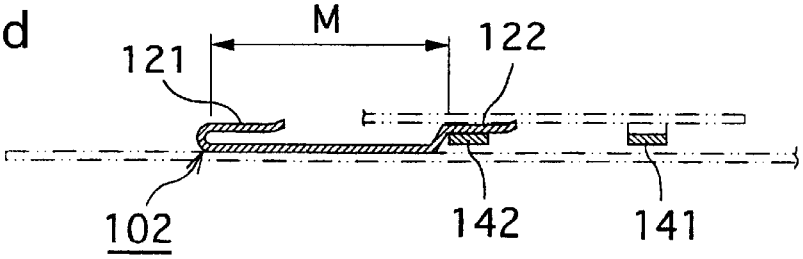

FIG. 14*d* shows a state in which the hook 122 of the hook body 102 is hooked on the socket 142 of the socket body 104.

It will be seen that the joining depth between the hook body 102 and the socket body 104 changes according to the states of FIG. 14*a* to FIG. 14*d*.

That is, when the hook body 102 moves from the state shown in FIG. 14*a* to the state shown in FIG. 14*b*, the hook body 102 changes its position by the distance L between the sockets 141 and 142. When the hook body 102 moves from the state shown in FIG. 14*b* to the state shown in FIG. 134, the hook body 102 changes its position by the distance M between the hooks 121 and 122.

As mentioned above, the hook assembly 100 can adjust the waist size of the pants or skirt in four steps within the distance L+M which adds the distance between the sockets 141 and 142 and the distance between the hooks 121 and 122. Therefore, it is possible to adjust the size as has not been realized in the conventional art.

Moreover, the hook assembly 100 is simpler in structure than the waist size adjusting art shown in Japanese Patent Nos. 2518803, 2518804, 2518807 and 2578079, thereby being capable of reducing the costs or price.

Particularly, if the distance between the hooks 121 and 122 is at least smaller than the inner dimension between the sockets 141 and 142 or at least larger than the outer dimension between the sockets 141 and 142, the waist size of the pants or skirt can be adjusted in four steps without stress. It is preferable to set the relation between the distance L and the distance M at one to two or two to one. If the relation between the distance L and the distance M is set at one to one, the hook assembly 100 of the present embodiment can move in three positions and has an overlapped state in one position.

In the above description, the number of the hooks 121 and 122 of the hook body 102 and the number of the sockets 141 and 142 of the socket body 104 are two, respectively. However, the number of each of the hooks 121, 122 and the sockets 141, 142 may be more than two. Any modification is possible as long as the hook body 102 has plural hooks 121, 122 lined at fixed intervals in the hooking direction of the hook element 100A, while the socket body has plural sockets 141, 142 lined at fixed intervals in the hooking direction of the socket element 100B so as to be hooked by the hooks 121, 122. Namely, even if the number of each of the hooks 121, 122 and the sockets 141, 142 is more than two, the hook element 100A is attached to one of the parted portions of the waist of the pants or skirt so that the hooks 121, 122 are lined along the waist. On the other hand, the socket element 100B is attached to the other of the parted portions so that the sockets 141, 142 are lined along the waist. Then, the waist size is adjustable by changing the hook 121, 122 of the hook body 102 to be hooked on the socket 141, 142 of the socket body 104 within a range where the plural hooks 121, 122 are provided. Similarly, the waist size is adjustable by changing the socket 141, 142 of the socket body 104 to be engaged with the hook 121, 122 of the hook body 102 within a range where the plural sockets 141, 142 are provided. That is, the waist size is adjustable in a distance that adds the range where the plural hooks 121, 122 are provided and the range where the plural sockets 141, 142 are provided. Therefore, the adjustable range of the waist size of the pants or skirt can increase to a degree far beyond the limit of the hook assembly with the conventional size adjusting mechanism.

Generally, the waist size of men's pants on the market is standardized in 3 cm such as 76 cm, 79 cm, 82 cm, 85 cm and so on. The hook assembly 100 of the first embodiment can adjust the waist size of the pants or skirt in the range more than 3 cm. With the hook assembly 100A, at least half the number of kinds of pants can deal with all the waist sizes of the prior art. For example, four kinds of waist sizes such as 76 cm, 79 cm 82 cm and 85 cm can be substituted by two kinds of waist sizes such as 76 to 79 cm and 82 to 85 cm.

Specifically, if the total of the distance M where the plural hooks 121, 122 are located and the distance L where the plural sockets 141, 142 are located is 3 cm or more, the waist size of the pants or skirt can be adjusted in the range of 3 cm or more. Thus, the hook assembly 100 makes it possible to substitute one kind of pants or skirt for at least two kinds of pants or skirts on the market that are different in the waist size, while the waist size changing every 3 cm. Consequently, it is possible to alleviate burden of a stock of pants and skirts and supply the pants and skirts at low prices.

SECOND EMBODIMENT

Figure 15:
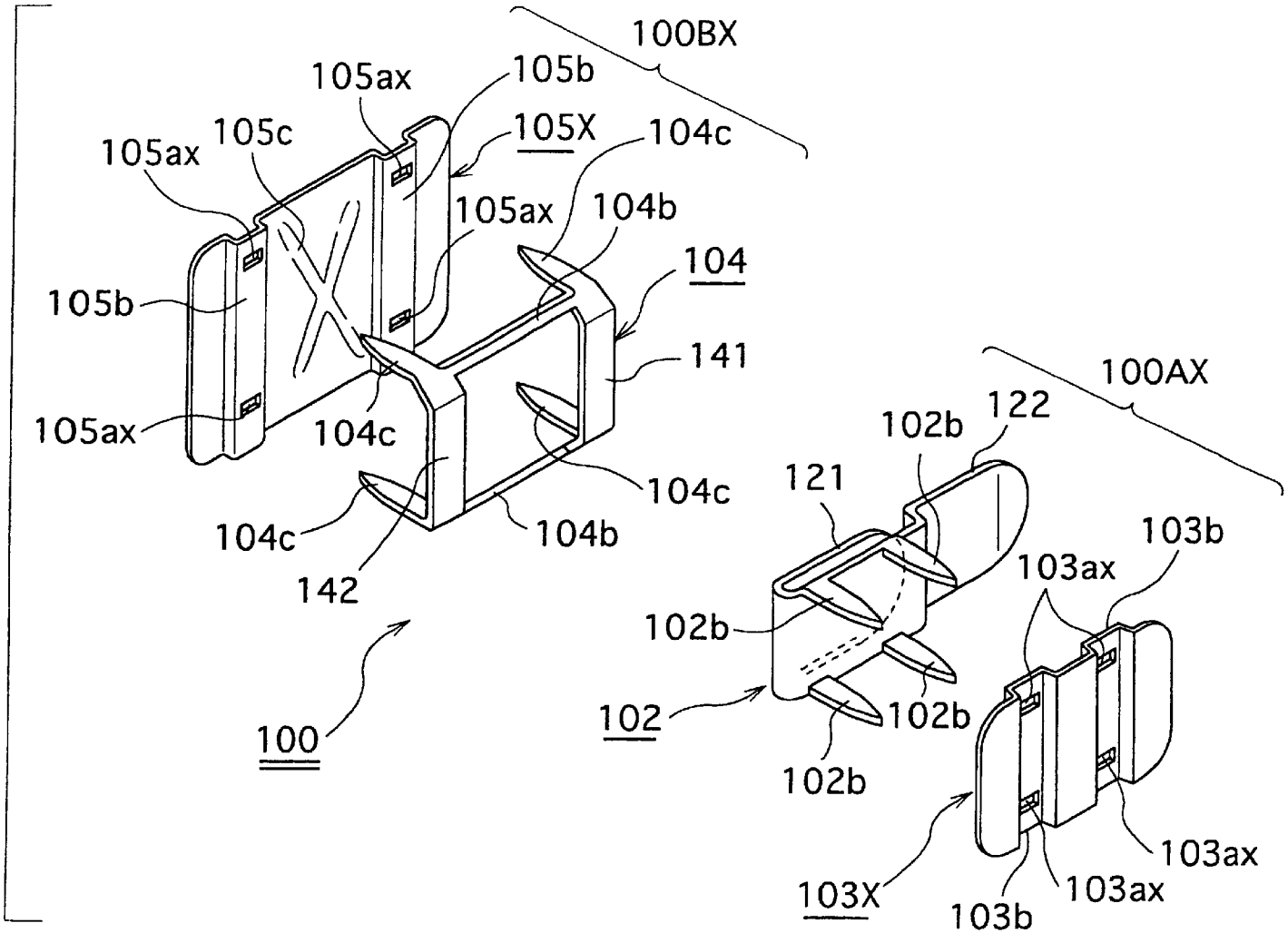
FIG. 15 is an exploded perspective view of a hook assembly according to a second embodiment of the invention.

A second embodiment is describer hereafter. FIG. 15 is an exploded perspective view of a hook assembly according to a second embodiment of the invention.

In a hook assembly 100 according to the second embodiment, a hook attachment plate 103X of a hook element 100X has accommodating dents 103*b* at a jointed portion with the hook body 102 so as to accommodate the hook claws 102*b*, in contrast with the hook assembly of the first embodiment. Moreover, a socket attachment plate 105X of a socket element 100BX has accommodating dents 105*b* at a jointed portion with the socket body 104 so as to accommodate the socket claws 104*c*. The hook attachment plate 103X has through holes 103*ax* corresponding to the through holes 103*a*. Furthermore, the socket attachment plate 105X has through holes 105*ax* corresponding to the through holes 105*a*.

In addition, the socket attachment plate 105X has a bulged portion 105*c* configured by an X-shaped groove between those two accommodating dents 105*b*.

The hook assembly 100 according to the second embodiment has similar function and effects to those of the hook assembly 100 of the first embodiment. Moreover, when the hook body 102 of the hook element 100AX is joined to the hook attachment plate 103X, the hook claws 102*b* are housed in the accommodating dents 103*b* of the hook attachment plate 103X. Similarly, when the socket body 104 of the socket element 100BX is joined to the socket attachment plate 105X, the socket claws 104*c* are housed in the accommodating dents 105*b* of the socket attachment plate 105X. Therefore, the cloth is never caught or rubbed by the hook claws 102*b* or the socket claws 104*c* thereby to be prevented from breaking. Moreover, if the user touches them, he or she does not feel strange. Furthermore, the sheet metals of the hook attachment plate 103X and the socket attachment plate 105X increase their mechanical strength by the dented or bulged portions formed thereon such as the accommodating dents 103*b*, 105*b* and so on. At the same time, the sheet metals are prevented from deformation. Thus, the hook body 102 can be fixed more strongly to the pants or skirt. In addition, since the socket attachment plate 105X is prevented from deformation by the bulged portion 105*c*, the socket body 104 can be fixed more strongly to the pants or skirt.

While, in the above description, one bulged portion 105*c* of X-shape is provided on the socket attachment plate 105X, the number or dimension or shape of the bulged portion 105*c* is not limited thereto. The bulged portion 105*c* may be formed in a desired number depending on the dimension and the shape.

THIRD EMBODIMENT

Figure 16:
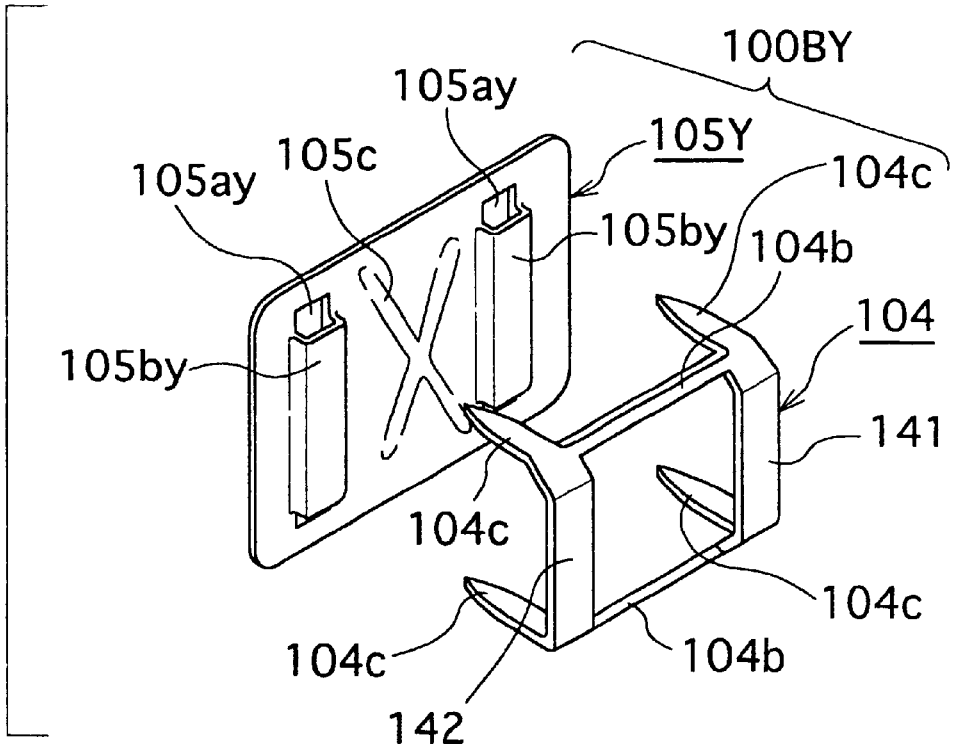
FIG. 16 is an exploded perspective view of socket element of a hook assembly according to a third embodiment of the invention.

A third embodiment is describer hereafter. FIG. 16 is an exploded perspective view of socket element 100BY of a hook assembly 100 according to a third embodiment of the invention.

In the third embodiment, a socket attachment plate 105Y of a socket element 100BY has accommodating dents 105*by* at a jointed portion with the socket body 104 so as to accommodate the socket claws 104*c*.

At the jointed portion of the socket attachment plate 105Y with the socket body 104, the accommodating dents 105*by* are provided only at an area where the socket claws 104*c* are housed. Thus, there is provided a room where connecting bridges 104*b* of the socket body 104 are fitted without interruption. The socket attachment plate 105Y has through holes 105*ay* corresponding to the through holes 105*a*.

In addition, the socket attachment plate 105Y has a bulged portion 105*c* configured by an X-shaped groove between those two accommodating dents 105*b*.

The hook assembly 100 according to the third embodiment has similar function and effects to those of the hook assembly 100 of the first or second embodiment. Moreover, the jointed portion of the socket body 104 with the socket attachment plate 105Y is housed in the accommodating dents 105*b* of the socket attachment plate 105Y. Therefore, the cloth is never caught or rubbed by the hook claws 104*c* thereby to be prevented from breaking. Moreover, if the user touches them in assembled state, he or she does not feel strange. Furthermore, since the accommodating dents 105*by* are provided only at an area where the socket claws 104*c* are housed, the connecting bridges 104*b* are placed near the socket attachment plate 105Y and part of the bridges 104*b* are accommodated in the cloth. Thus, the appearance improves if the hook assembly 100 is fitted to the pants or skirt. Of course, the mechanical strength of the sheet metal of the socket attachment plate 105Y is enlarged by the dented or bulged portions formed thereon such as the accommodating dents 105*b* and so on. At the same time, the bulged portion 105*c* prevent the sheet metals from deformation. Thus, the hook body 102 can be fixed more strongly to the pants or skirt, while the socket body 104 can be fixed more strongly to the pants or skirt.

The third embodiment is described as an example that uses the hook element 100AX and the socket element 100BY. However, the hook element 100AX and the socket element 100BY may be combined with the socket element 200B and the hook element 200A, respectively.

FOURTH EMBODIMENT

Figure 17:
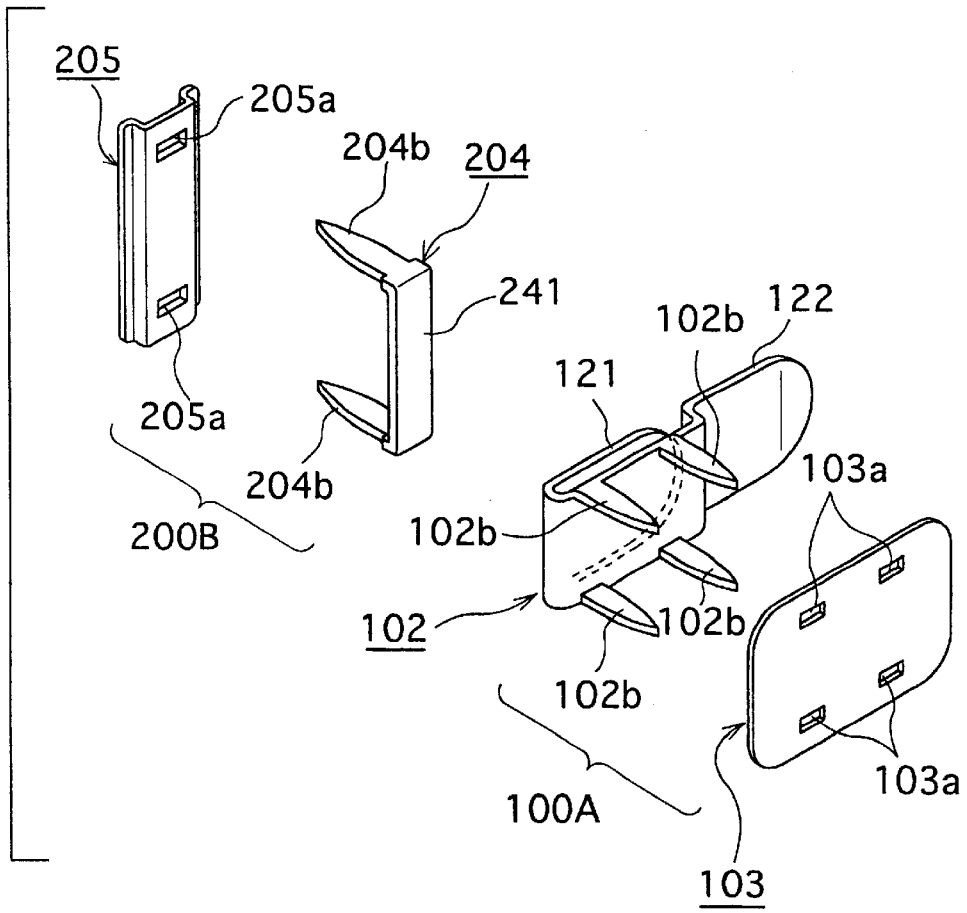
FIG. 17 is an exploded perspective view of a hook assembly according to a fourth embodiment of the invention.

A fourth embodiment is describer hereafter. FIG. 17 is an exploded perspective view of a hook assembly according to a fourth embodiment of the invention.

The fourth embodiment of hook assembly 100 uses the first embodiment of hook element 100A and the conventional socket element 200B in combination. Specifically, the socket body 204 has a single socket 241 that is caught by the hook 121, 122 of the hook body 102.

With such structure, the hook element 100A can be easily assembled by inserting the bendable hook claws 102*b* in the through holes 103*a* of the hook attachment plate 103 and bending them thereafter. Similarly, the socket element 200B can be easily assembled by inserting the bendable socket claws 204*b* in the through holes 205*a* of the socket attachment plate 205 and bending them thereafter. Then, the hook element 100A is attached to one of the parted portions of the waist of the pants or skirt, and the socket element 200B is attached to the other of the parted portions along the waist, for example. Thus, the waist size is adjustable within a range where the plural hooks 121, 122 are located on the hook element 100A by changing the catching position of the hook 121, 122 to the socket 241 of the socket element 200B. That is, the size is adjustable according to the relative position of the hook element 100A and the socket element 200B within a range where the plural hooks 121, 122 are located or within a range where the single socket 241 is located. The preferable number of the hooks 121, 122 formed on the hook element 100A is generally about two in view of decorative effects. However, it is possible to provide them in three or more.

FIFTH EMBODIMENT

Figure 18:
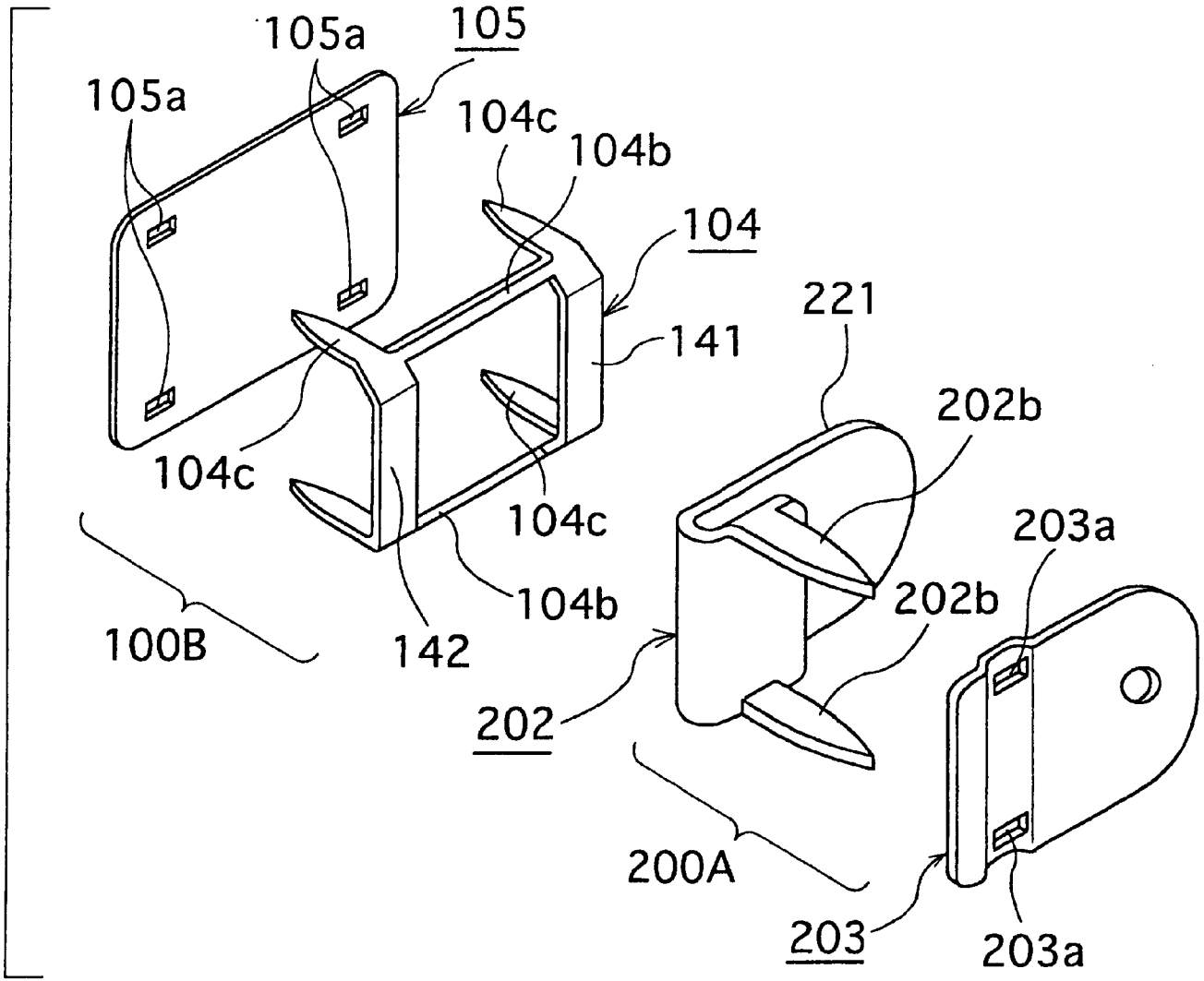
FIG. 18 is an exploded perspective view of a hook assembly according to a fifth embodiment of the invention.

A fifth embodiment is describer hereafter. FIG. 18 is an exploded perspective view of a hook assembly according to a fifth embodiment of the invention.

The fifth embodiment of hook assembly 100 can be structured to have the conventional hook element 200A and the first embodiment of socket element 100B. Specifically, the socket element 100B has the plural sockets 141, 142 formed at a fixed interval in the hooking direction so as to be caught by the hook 221 of the hook body 202.

With such structure, the hook element 200A can be easily assembled by inserting the bendable hook claws 202*b* in the through holes 203*a* of the hook attachment plate 203 and bending them thereafter. Similarly, the socket element 100B can be easily assembled by inserting the bendable socket claws 104*b* in the through holes 105*a* of the socket attachment plate 105 and bending them thereafter. Then, the hook element 200A is attached to one of the parted portions of the waist of the pants or skirt, and the socket element 100B is attached to the other of the parted portions so as to be lined along the waist, for example. Thereafter, the catching position of the single hook 221 of the hook element 200A is changed relative to the plural sockets 141, 142 of the socket element 100B. Thus, the waist size is adjustable according to the relative catching position of the single hook 221 of the hook element 200A and the plural sockets 241, 242 of the socket element 100B. That is, the size is adjustable according to the relative position between the plural sockets 141, 142 of the socket element 100B and the single hook 221 of the hook element 200A. The preferable number of the sockets 141, 142 formed on the socket element 100B is generally about two in view of decorative effects. However, it is possible to provide them in three or more.

SIXTH EMBODIMENT

Figure 19:
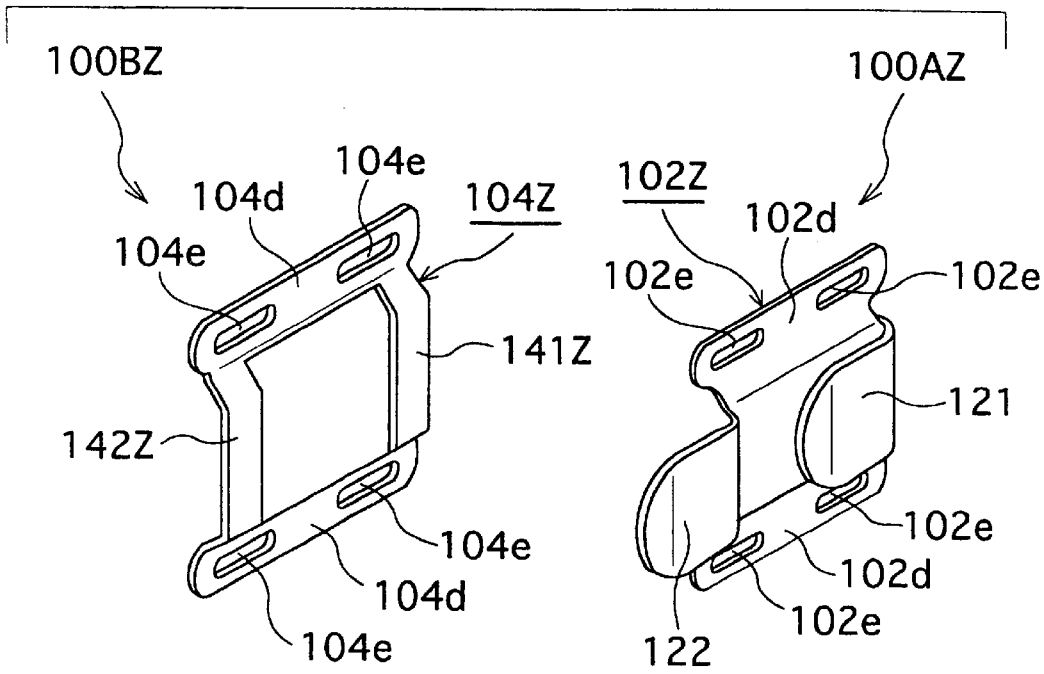
FIG. 19 to FIG. 21 are exploded perspective views respectively showing a variety of combinations of a hook assembly according t a sixth embodiment of the invention.
Figure 20:
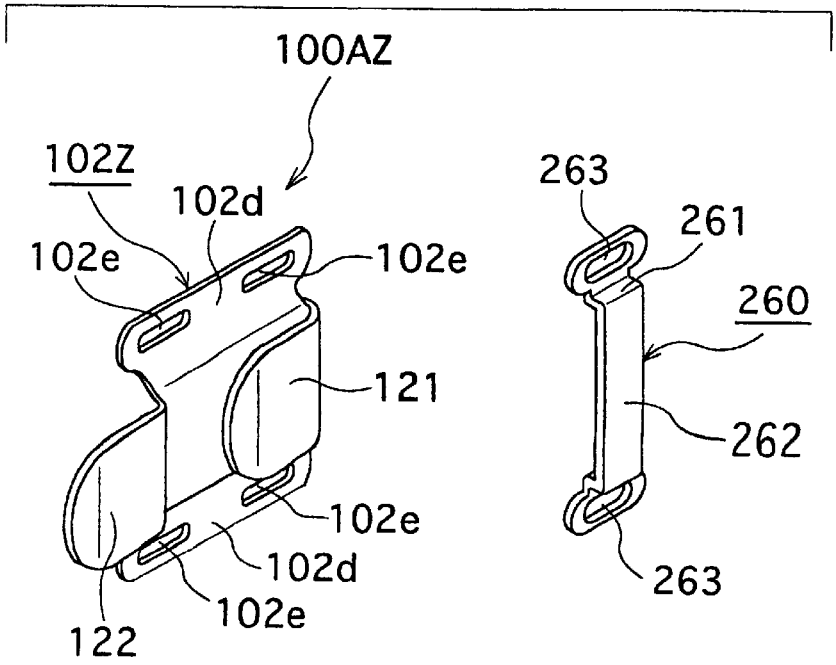
Figure 21:
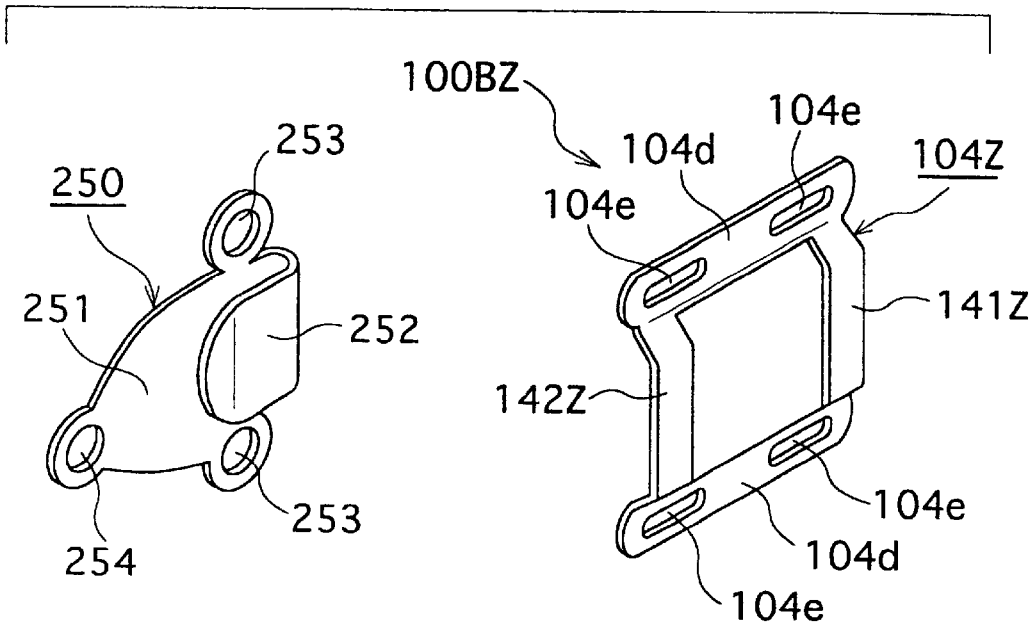

A sixth embodiment is describer hereafter. FIG. 19 to FIG. 21 are exploded perspective views respectively showing a variety of combinations of a hook assembly 100 according to a sixth embodiment of the invention. Specifically, the sixth embodiment combines a hook element 100AZ and a socket element 100BZ. Alternatively, the sixth embodiment uses each of them in combination with the conventional hook element 250 or socket element 260.

First, in an example shown in FIG. 19, the hook assembly 100 has the hook element 100AZ and the socket element 100BZ. The hook element 100AZ is composed of a hook body 102Z that has a plurality of hooks 121, 122 formed at predetermined intervals in the hooking direction on a specific surface side. The hook element 100AZ has four hook fitting holes 102*e* formed at positions perpendicular to the hooking direction of the hook body 102Z. The socket element 100BZ is composed of a socket body 104Z that has a plurality of sockets 141, 142 formed at predetermined intervals in the hooking direction so as to be caught by the hook 121, 122 of the hook body 102. The socket element 100BZ has four socket fitting holes 104*e* formed at positions perpendicular to the hooking direction of the socket body 104Z.

Specifically, the example of FIG. 19 eliminates the hook attachment plate 103 and the socket attachment plate 105 of the first to fifth embodiments. Moreover, it substitutes a hook base 102*d* and the hook fitting holes 102*e* for the hook claws 102*b*, while substituting a socket base 104*d* and the socket fitting holes 104*e* for the socket claws 104*c*.

With such structure, the hook element 100AZ can be easily fitted on the pants or skirt by sewing the hook body 102Z thereto via the hook fitting holes 102*e*. Similarly, the socket element 100BZ can be easily fitted on the garment by sewing the socket body 104Z thereto via the socket fitting holes 104*e*. Then, the hook element 100AZ is attached to one of the parted portions of the waist of the pants or skirt, and the socket element 100BZ is attached to the other of the parted portions so as to be lined along the waist, for example. Thereafter, the catching position of the hooks 121, 122 of the hook element 100AZ is changed relative to sockets 141Z, 142Z of the socket element 100BZ. Thus, the waist size is adjustable according to the relative position between the plural hooks 121, 122 of the hook element 100AZ and the sockets 141Z, 142Z of the socket element 100BZ. That is, the size is adjustable according to the relative position between the plural sockets 141Z, 142Z of the socket element 100BZ and the range where the plural hooks 121, 122 of the hook element 100AZ are located.

The preferable number of the hooks 121, 122 formed on the hook element 100AZ and the number of the sockets 141Z, 142Z formed on the socket element 100BZ are generally about two, respectively, in view of decorative effects. However, each or both of them may be provided in three or more.

Particularly, the hook element 100AZ and the socket element 100Bz of the hook assembly of the sixth embodiment can be used in combination with the hook element 250 or the socket element 260 of the conventional hook assembly.

Specifically, as shown in FIG. 20, the conventional hook element 260 is composed of a socket body 261 that has a socket 262. The socket body 261 has socket fitting holes 263 formed at opposite ends, respectively. As shown in FIG. 21, the conventional hook element 250 is composed of a hook body 251 that has a hook 252. The hook body 251 has hook fitting holes 253 formed at opposite ends, respectively, and a hook fitting hole 264 formed at a position opposite to the hook 252.

The example of FIG. 20 has the hook element 100AZ and the socket element 260.

With such structure, the hook element 100AZ can be easily fitted on the garment by sewing the hook body 102Z thereto via the hook fitting holes 102*e*. Similarly, the socket element 260 can be easily fitted on the garment by sewing the socket body 261 thereto via the socket fitting holes 104*e*. Then, the hook element 100AZ is attached to one of the parted portions of the waist of the pants or skirt, and the socket element 260 is attached to the other of the parted portions so as to be lined along the waist, for example. Thereafter, the catching position of the hooks 121, 122 of the hook element 100AZ is changed relative to the socket 262 of the socket element 260. Thus, the waist size is adjustable according to the relative position between the plural hooks 121, 122 of the hook element 100AZ and the socket 262 of the socket element 260. That is, the size is adjustable according to the relative position between the range where the plural hooks 121, 122 of the hook element 100AZ are located and the single socket 262 of the socket element 260.

The example of FIG. 21 has the hook element 250 and the socket element 100BZ.

With such structure, the hook element 250 can be easily fitted on the garment by sewing the hook body 251 thereto via the hook fitting holes 253, 254. Similarly, the socket element 100BZ can be easily fitted on the garment by sewing the socket body 104Z thereto via the socket fitting holes 104*e*. Then, the hook element 250 is attached to one of the parted portions of the waist of the pants or skirt, and the socket element 100BZ is attached to the other of the parted portions so as to be lined along the waist, for example. Thereafter, the catching position of the hook 252 of the hook element 250 is changed relative to the plural sockets 141*z*, 142Z of the socket element 100BZ. Thus, the waist size is adjustable according to the relative catching position between the single hook 252 of the hook element 250 and the plural sockets 141Z, 142Z of the socket element 100BZ. That is, the size is adjustable according to the relative position between the plural sockets 141Z, 142Z of the socket element 100BZ and the single hook 252 of the hook element 250.

SEVENTH EMBODIMENT

A seventh embodiment of a garment with a waist-adjusting mechanism using the first to sixth embodiments is described hereafter.

The seventh embodiment is described with respect to the pants with a waist-adjusting mechanism (waist-adjustable pants) as the inventive garment with the waist-adjusting mechanism (waist-adjustable garment). However, the invention can be embodied into a waist-adjustable skirt that is applicable to a variety of skirts such as culottes.

Figure 22:
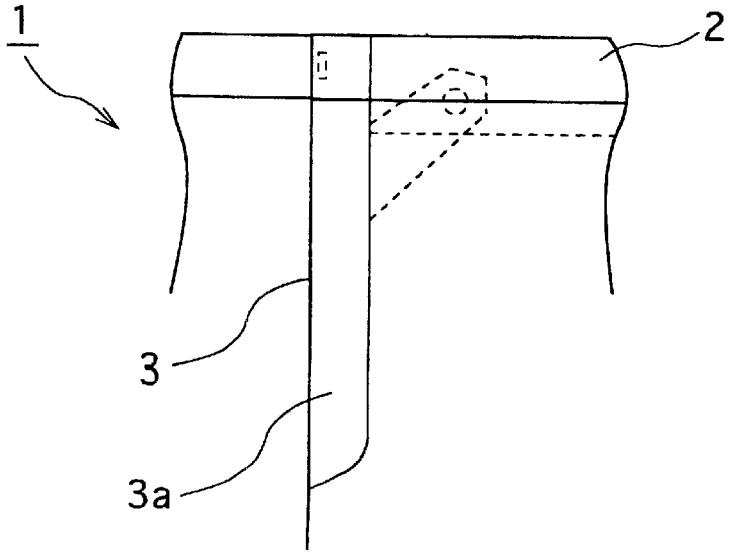
FIG. 22 is a front elevation of a major part of a garment having a waist-adjusting mechanism according to a seventh embodiment of the invention.
Figure 23:
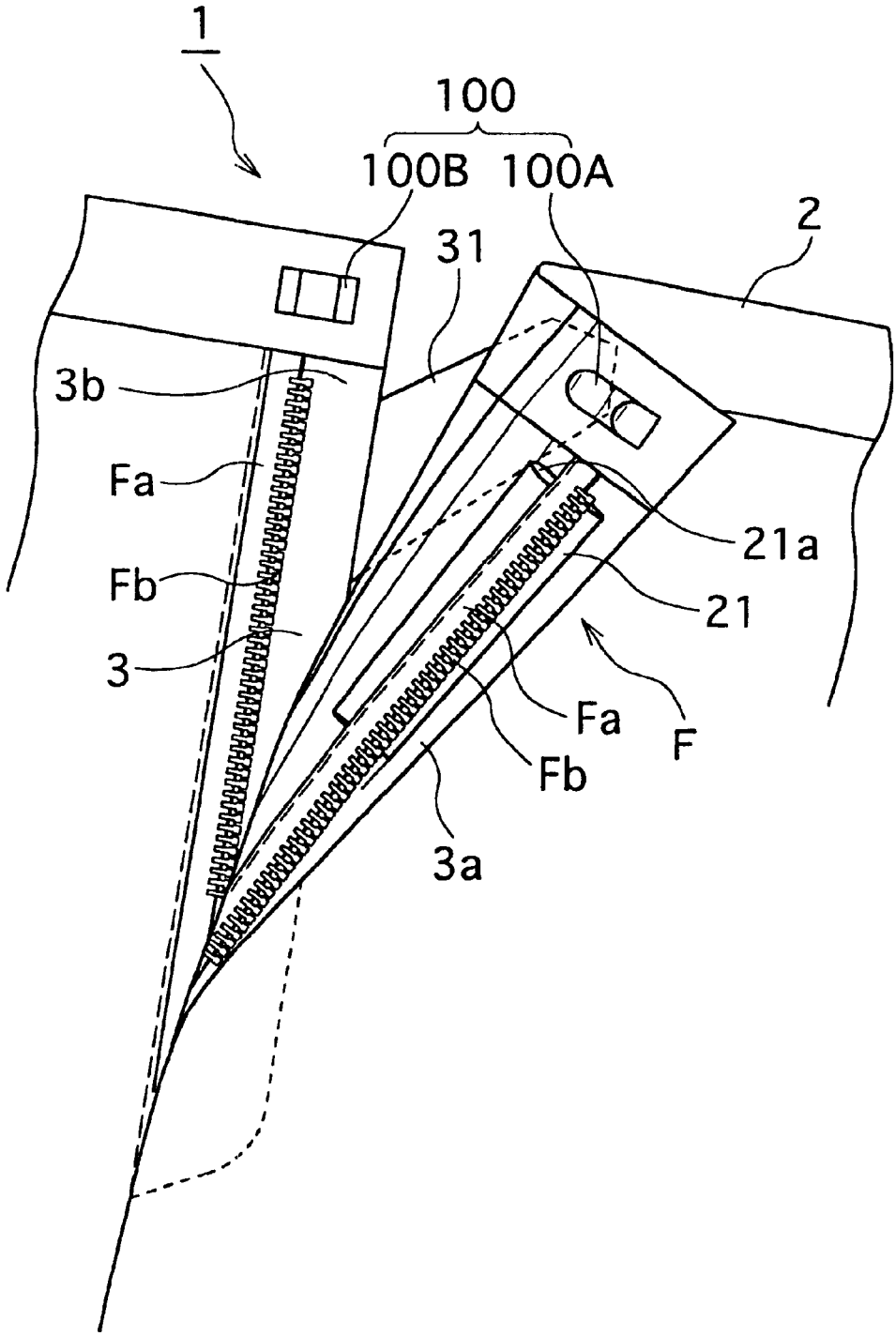
FIG. 23 is an explanatory drawing showing the major part of the garment having the waist-adjusting mechanism according to the seventh embodiment of the invention.
Figure 24:
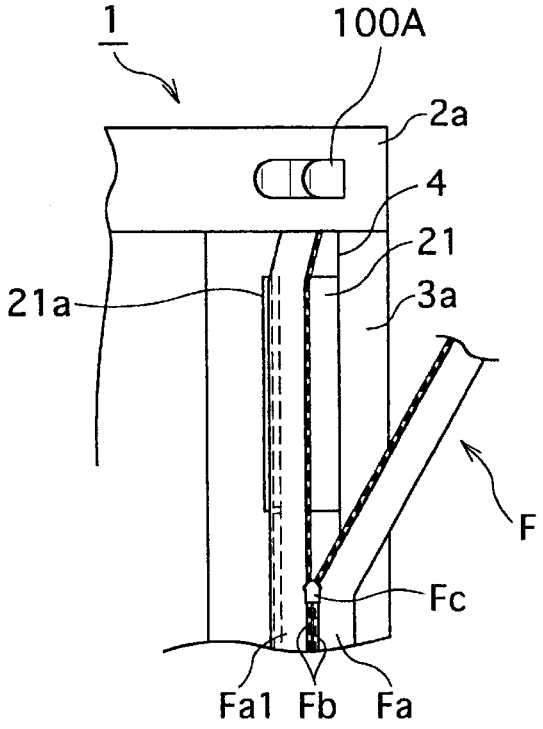
FIG. 24 is an explanatory drawing showing one example of sewing a zip fastener and an adjusting cloth on the garment having the waist-adjusting mechanism according to the seventh embodiment of the invention.
Figure 25:
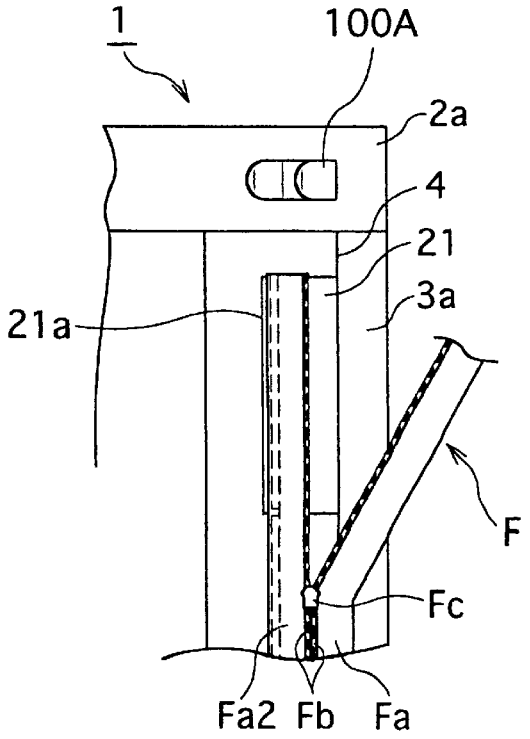
FIG. 25 is an explanatory drawing showing another example of sewing a zip fastener and the adjusting cloth on the garment having the waist-adjusting mechanism according to the seventh embodiment of the invention.
Figure 26:
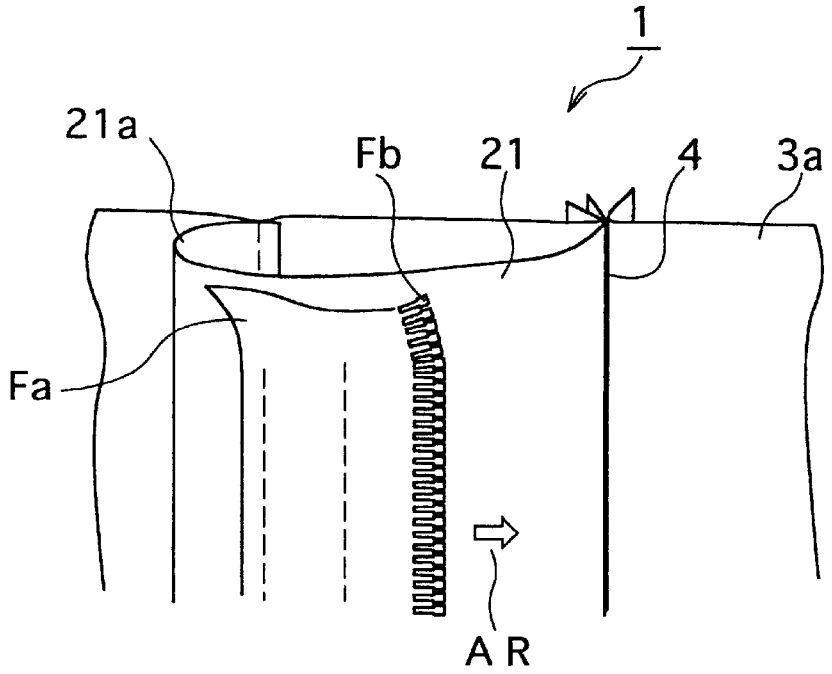
FIG. 26 is a perspective view, enlarged in part, of the example of sewing the zip fastener and the adjusting cloth on the garment having the waist-adjusting mechanism according to the seventh embodiment of the invention.
Figure 27:
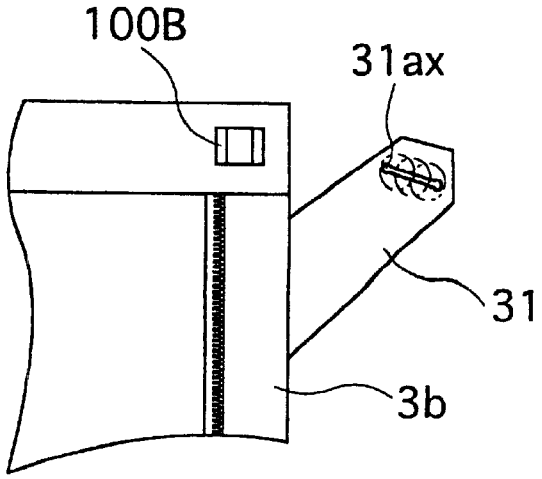
FIG. 27 is an explanatory drawing showing a buttonhole piece of the garment having the waist-adjusting mechanism according to the seventh embodiment of the invention.

FIG. 22 is a front elevation of a major part of a garment having a waist-adjusting mechanism according to a seventh embodiment of the invention. FIG. 23 is an explanatory drawing showing the major part of the garment having the waist-adjusting mechanism according to the seventh embodiment of the invention. FIG. 24 is an explanatory drawing showing one example of sewing a zip fastener and an adjusting cloth on the garment having the waist-adjusting mechanism according to the seventh embodiment of the invention. FIG. 25 is an explanatory drawing showing another example of sewing a zip fastener and the adjusting cloth on the garment having the waist-adjusting mechanism according to the seventh embodiment of the invention. FIG. 26 is a perspective view, enlarged in part, of the example of sewing the zip fastener and the adjusting cloth on the garment having the waist-adjusting mechanism according to the seventh embodiment of the invention. FIG. 27 is an explanatory drawing showing a buttonhole piece of the garment having the waist-adjusting mechanism according to the seventh embodiment of the invention.

As shown in FIG. 22 to FIG. 27, the waist-adjustable pants 1 as the waist-adjustable garment (referred to as "pants 1" hereafter) have a front opening 3 that is openable up to an upper end of the pants 1. The pants 1 have a zip fastener F to open and close the front opening 3 and a hook assembly 100 to join the upper ends of the front opening 3 in a separable way. The pants 1 further have an adjusting cloth 21 sewed between a fastener tape Fa and an outer cloth 3*a* of the front opening 3. The fastener tape Fa becomes a seam allowance for the zip fastener F. The pants 1 further have a buttonhole piece 31 on which a buttonhole 31*a* is formed to catch a button (not shown) provided on the outer cloth 3*a*. Women's pants have no buttonhole piece 31. The seventh embodiment is described with respect to the men's pants.

The hook assembly 100 is composed of the hook element 100A and the socket element 100B. The combination of the hook element 100A and the socket element 100B is set such that they can move from 10 mm to 30 mm relative to each other. The hook assembly 100 serves to join the upper parts of the outer cloth 3*a* and an inner cloth 103*b* in a separable way by making the hook element 100A caught on the socket element 100B fixed at the upper part of the inner cloth 3*b*. Therefore, if an external force is applied to the pants 1 in such a direction as to enlarge the dimension of the waist belt 2, the hook element 100A is pulled by the socket element 100*b*. Thus, the size of the waist belt 2 becomes longer at the jointed area in plural steps. Specifically, the hook assembly 100 not only joins the upper parts of the front opening 3 of the pants 1 in a separable way but also adjusts the waist size of the pants 1 at the jointed area within a predetermined range.

The adjusting cloth 21 is made of a sash-shaped cloth having fixed flexibility. The adjusting cloth 21 have its opposite lateral edges sewed on the outer cloth 3*a* along an inside of the outer cloth 3*a*, while keeping one lateral part loose. Specifically, the adjusting cloth 21 is sewed on one of the front opening or the outer cloth 3*a*. At this time, the adjusting cloth 21 is shaped substantially into a pipe by vertically extending stitching between the upper and lower ends of the front opening 3 made into a V-shape, thereby to change the shape within a range in which the hook assembly 100 adjusts the waist size of the pants 1.

As shown in FIG. 26, one lateral end portion of the adjusting cloth 21, which is located away from the edge of the outer cloth 3*a*, is folded at an adjacent position and stitched to the outer cloth 3*a* so as to form an overlap 21*a*. The opposite lateral end portions of the adjusting cloth 21 are stitched on one and the other of stitching positions of the outer cloth 3*a*. A lining of the outer cloth 3*a* has a slit 4 formed at the other stitching position that is located nearer to the edge of the outer cloth 3*a* than the one stitching position. The other lateral end portion of the adjusting cloth 21 is inserted into the slit 4 and stitched on the outer cloth 3*a* from the rear side. The other end portion of the adjusting cloth 21 is inserted in the slit 4, so that its stitched part is hidden therein. Moreover, if the user touches that part, he or she never feels strange. Furthermore, the appearance improves. The overlap 21*a* forms an extra length in the width direction of the adjusting cloth 21. The adjusting cloth 21 is pressed and heated by a press machine such as an iron after stitching so as to keep a shape of the overlap 21*a*, thereby specifying the shape. The adjusting cloth 21 works well if it is provided from the upper end to the lower end of the outer cloth 3*a* over ⅓ to ½ of length of the outer cloth 3*a*. Alternatively, the adjusting cloth 21 may be provided up to a position lower than that.

The area where the adjusting cloth 21 is stitched is a portion to which the zip fastener F is sewed directly thereon. In the pants 1 of the present embodiment, the fastener tape Fa to be the seam allowance of the zip fastener F is sewed on the adjusting cloth 21 in an area where the adjusting cloth 21 is provided. The fastener tape Fa is sewed directly on the inside of the outer cloth 3*a* where the adjusting cloth 21 is not provided. An upper end of a fastener tape Fa1 is held and sewed inside the belt lining 2*a* while slanted outwardly of the edge of the outer cloth 3*a* as shown in FIG. 24. Alternatively, an upper end of a fastener tape Fa2 is sewed only on the adjusting cloth 21 up to the same height as the upper end of the adjusting cloth 21 as shown in FIG. 25.

Thus, the portion of the fastener tape Fa sewed on the adjusting cloth 21 can be pulled and moved outwardly of the edge of the outer cloth 3*a* as shown by an arrow AR in FIG. 26, within a range of the extra length by the overlap 21*a*. That is, the overlap a of the adjusting cloth 21 is formed at the side away from the edge of the outer cloth 3*a* in the width direction of the adjusting cloth 21. Therefore, if the adjusting cloth 21 is pulled outwardly of the edge of the outer cloth 3*a* via the fastener tape FA, the overlap 21*a* is stretched. Then, the fixed position of the fastener tape Fa with the adjusting cloth 21 is moved. Consequently, the fastener tape Fa can be moved outwardly of the edge of the outer cloth 3*a*. Moreover, the upper end of the fastener tape Fa is held and sewed inside the belt lining 2*a* while slanted outwardly of the edge of the outer cloth 3*a* as shown by Fa1. Alternatively, the upper end of the fastener tape Fa is sewed only on the adjusting cloth 21 up to the same height as the upper end of the adjusting cloth 21 as shown by Fa2. Thus, when the portion of the fastener tape Fa stitched to the adjusting cloth 21 moves outwardly from the edge of the outer cloth 3*a*, the upper end of the fastener tape Fa moves in such a direction as to make a room. Consequently, it is never hindered from moving.

The fastener tape F is composed of two fastener tapes Fa, worms Fb lined along each of the fastener tape Fa and a slider Fc that makes the worms Fb geared with each other so as to join those two fastener tapes Fa. The other fastener tape Fa is sewed on the inner cloth 3*b*. The front center opening 3 is opened and closed if the slider Fc of the zip fastener F is moved up and down.

If an external force is applied in such a direction as to widen the waist belt 2 of the pants 1 while the front center opening 3 is closed by the zip fastener F, the adjusting cloth 21 permits the waist size of the pants 1 to become longer within such a length as to stretch the overlap 21*a* at an area where the adjusting cloth 21 exists between the fastener tape Fa and the outer cloth 3*a*. Then, the lower portion of the waist belt 2 becomes longer, too.

Figure 75:
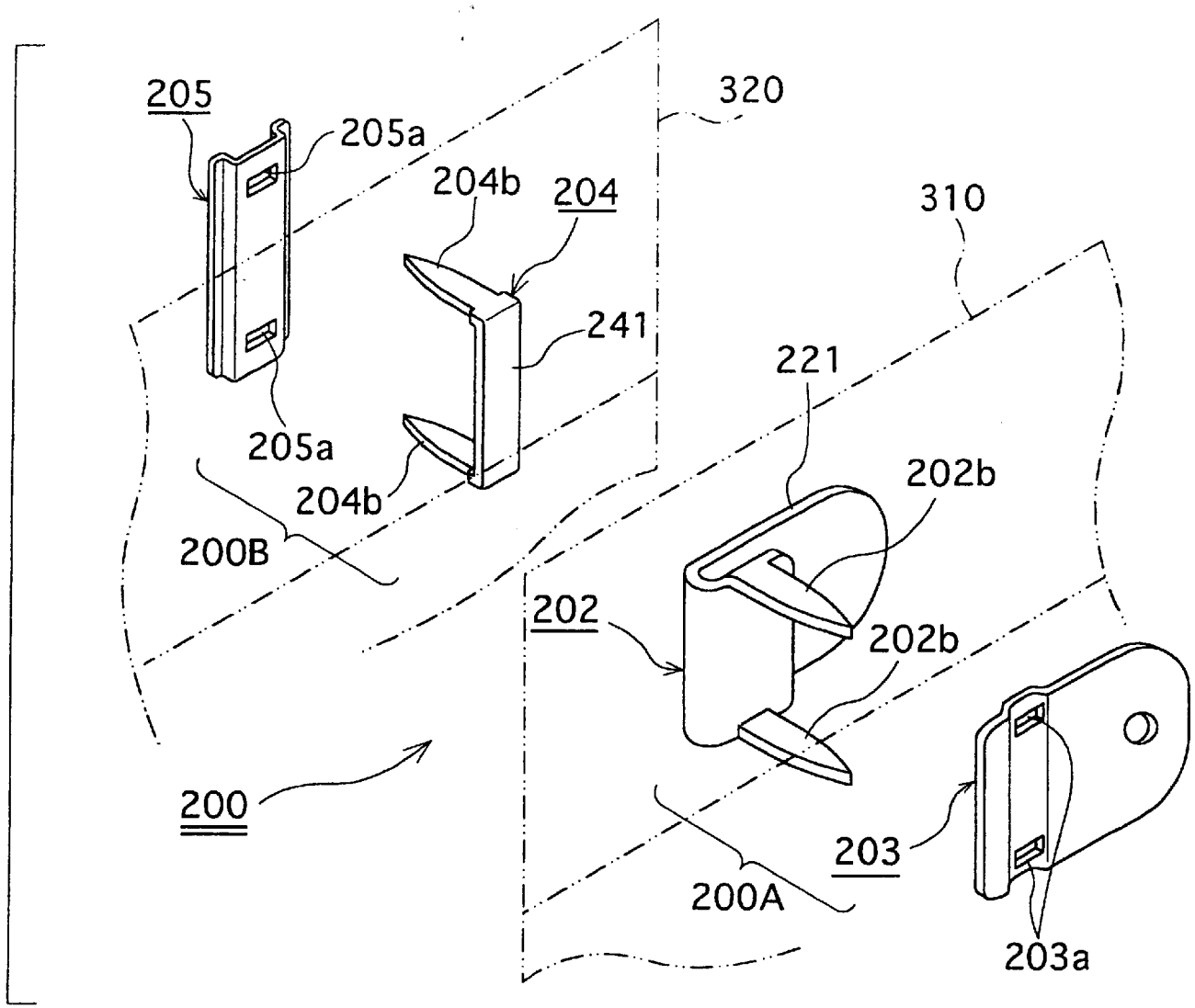
FIG.75 (PRIOR ART)
FIG. 75 is an exploded perspective view of a conventional hook assembly.
Figure 76:
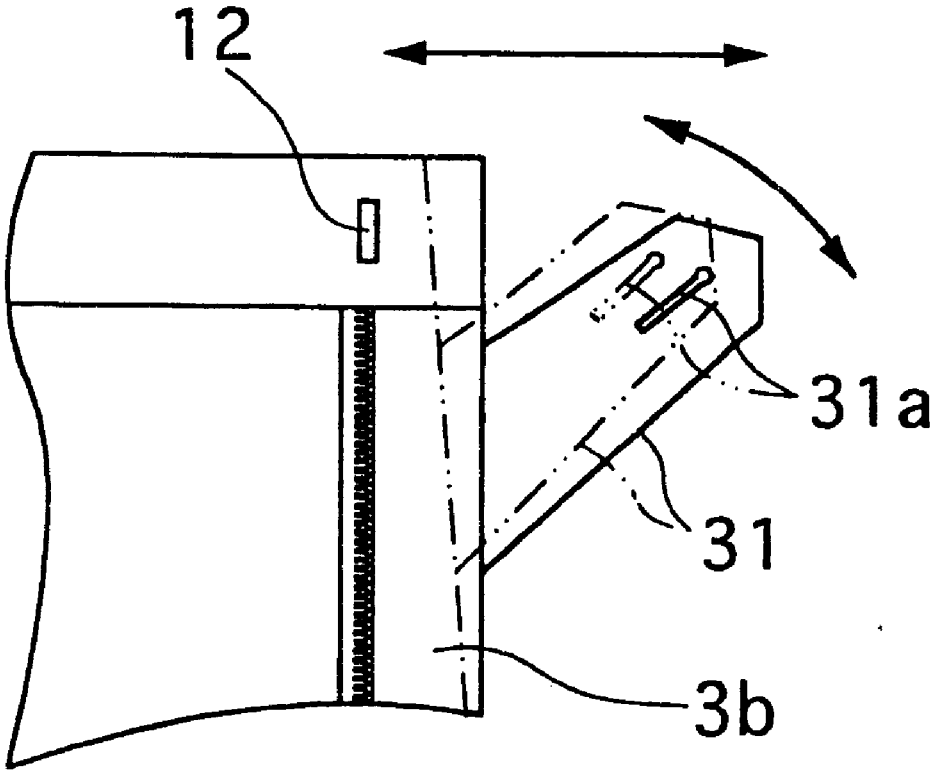
FIG.76 (PRIOR ART)
FIG. 76 is an explanatory drawing showing a conventional buttonhole piece of a garment.

The buttonhole piece 31 is protruded from the edge of the inner cloth 3*b*. The buttonhole piece 31 is made of a cloth having a buttonhole 31*a*, in which a button (not shown) fitted on the outer cloth 3*a* is caught so as to join the inner cloth 3*b* and the outer cloth 3*a*. The common buttonhole 31*a* of the buttonhole piece 31 is a slot extended along a length of the buttonhole piece 31 as shown in FIG. 75 (Prior Art).

In this case, if the button of the outer cloth 3*a* is caught in the buttonhole 31*a*, the button is positioned at an end of the buttonhole 31*a* that is located away from the inner cloth 3*b*. Therefore, the outer cloth 3*a* cannot move from that position in a direction away from the inner cloth 3*b*. Thus, it is possible that the pants 1 are obstructed from enlarging the waist size. However, the pants 1 of the present embodiment have a buttonhole 31*ax* that is extended substantially in a horizontal direction, as shown in FIG. 27. Therefore, the button of the outer cloth 3*a* can move to a variety of positions of the buttonhole 31*ax* as shown by two-dot chain line in FIG. 27. Consequently, the outer cloth 3*a* can change its position to the inner cloth 3*b*, at which it is restricted from moving in the waist direction of the pants 1, in accordance with the position of the button thereof along the slot of the buttonhole 3 lax. That is, since the buttonhole 31*ax* is the slot that has a component extending in the waist direction of the pants 1, the waist size of the pants 1 is not restricted within a fixed range where the button of the outer cloth 3*a* is movable.

Processing such as a buttonhole stitch may be completed by a machine work such as a sewing machine or by handiwork. Particularly, if the buttonhole 31*ax* becomes long by enlarging the adjusting range of the hook assembly, a common sewing machine may be not able to deal with the stitch for the buttonhole 31*ax*, since it is normally used for a short buttonhole stitch. Then, a specially made sewing machine may be introduced. In this case, the handiwork is advantageous.

As described above, the pants 1 according to the seventh embodiment has the following advantageous effects.

If an external force is applied in such a direction as to enlarge the size of the waist belt 2 of the pants 1, the size of the waist belt 2 can be prolonged at the joined portion by the hook assembly 100 located at the upper ends of the front center opening 3. Specifically, the upper ends of the front center opening 3 can be joined by the hook assembly 100 in an adjusted state so as to fit to the waist size of the user who puts on the pants 1. Moreover, at the area from the upper part to a predetermined part downward of the outer cloth 3*a* (area where the adjusting cloth 21 is sewed between the outer cloth 3*a* and the fastener tape FA), the waist size of the pants 1 can be prolonged within an extendible length of the overlap 21*a*. Furthermore, since the buttonhole 31*ax* of the buttonhole piece 31 is the slot that has a component extending substantially in a horizontal direction, the outer cloth 3*a* can change its position to the inner cloth 3*b*, at which it is restricted from moving in the waist direction of the pants 1, in accordance with the position of the button thereof along the slot of the buttonhole 31*ax*. Therefore, the buttonhole piece 31 never restrict an extension of the waist size of the pants 1 within the fixed range where the button of the outer cloth 3*a* is movable.

The upper end of the fastener tape Fa is held and sewed inside the belt lining 2*a* while slanted outwardly of the edge of the outer cloth 3*a* as shown in FIG. 24 or sewed only on the adjusting cloth 21 up to the same height as the upper end of the adjusting cloth 21 as shown in FIG. 25. Therefore, the upper end of the fastener tape Fa and the portion of the fastener tape Fa stitched to the adjusting cloth 21 moves outwardly from the edge of the outer cloth 3*a*. Thus, a section where the waist size of the pants 1 is adjustable is completely continuous from the upper end of the pants 1 downward to the portion of the adjusting cloth 21. Therefore, it is possible to lessen more a tight feeling of the user when he or she puts on the pants 1 and decrease an influence on the appearance by a periphery of the front center opening 3 being pulled or wrinkled.

Specifically, if the size of the waist belt 2 of the pants 1 becomes long, the size of the portion around the waist becomes long accordingly. Consequently, it is impossible to get rid of the tight feeling if a room is provided only on the waist belt. With the pants 1 of the seventh embodiment, the waist belt 2 of each part of the pants 1 becomes long according not only to a change of the waist size of the user but also to a change of a size of a portion around the waist. Thus, the user has no tight feeling. Moreover, it also prevents the peripheral part of the front center opening 3 from being pulled or wrinkled, thereby improving the appearance thereof.

EIGHTH EMBODIMENT

Figure 28:
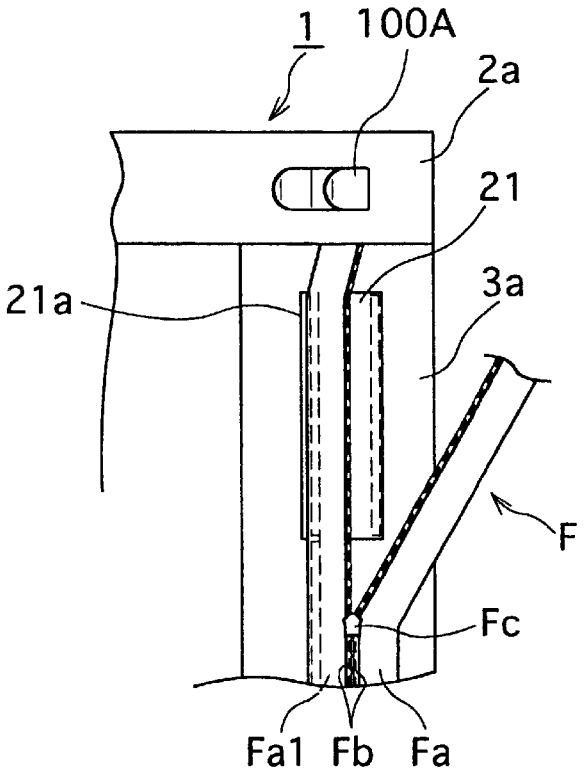
FIG. 28 is an explanatory drawing showing one example of sewing a zip fastener and an adjusting cloth on a garment having a waist-adjusting mechanism according to an eighth embodiment of the invention.
Figure 29:
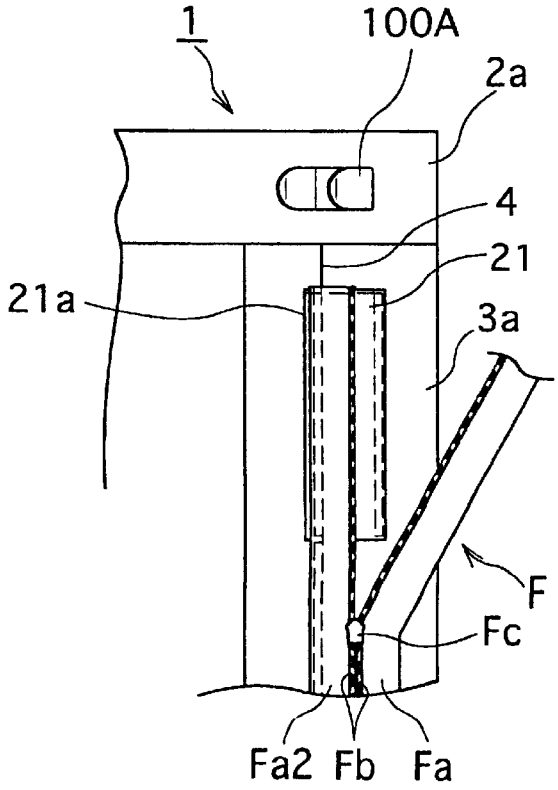
FIG. 29 is an explanatory drawing showing another example of sewing a zip fastener and the adjusting cloth on the garment having the waist-adjusting mechanism according to the eighth embodiment of the invention.
Figure 30:
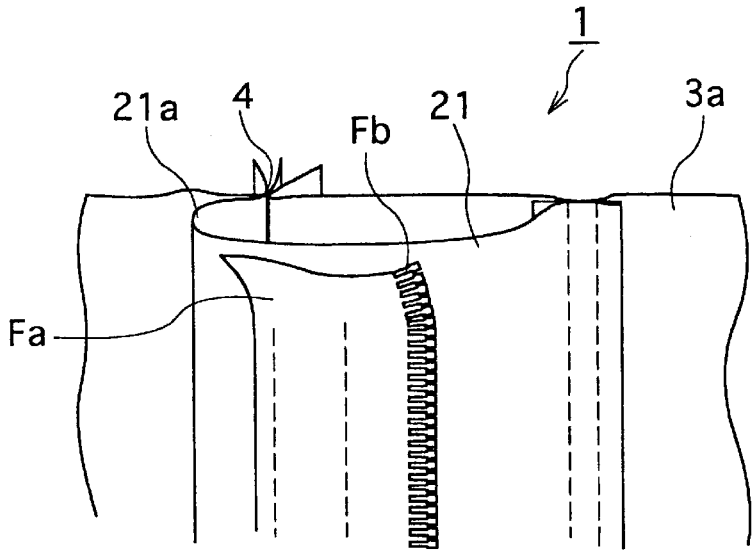
FIG. 30 is a perspective view, enlarged in part, of the example of sewing the zip fastener and the adjusting cloth on the garment having the waist-adjusting mechanism according to the eighth embodiment of the invention.

An eighth embodiment is described hereafter. FIG. 28 is an explanatory drawing showing one example of sewing a zip fastener and an adjusting cloth on a garment having a waist-adjusting mechanism according to an eighth embodiment of the invention. FIG. 29 is an explanatory drawing showing another example of sewing a zip fastener and the adjusting cloth on the garment having the waist-adjusting mechanism according to the eighth embodiment of the invention. FIG. 30 is a perspective view, enlarged in part, of the example of sewing the zip fastener and the adjusting cloth on the garment having the waist-adjusting mechanism according to the eighth embodiment of the invention.

As shown in FIG. 28 to FIG. 30, a waist-adjustable garment according to the eighth embodiment is different from the seventh embodiment in the position of the slit 4 that is cut vertically on the lining of the outer cloth 3*a* for stitching the lateral end portion of the adjusting cloth 21. Specifically, it forms the slit 4 not at the other stitching position, which is located nearer to the edge of the outer cloth 3*a*, but at the one stitching position, which is located away from the edge of the outer cloth 3*a*.

In the pants 1 of the eighth embodiment, as shown in FIG. 30, the one lateral end portion of the adjusting cloth 21, which is located away from the edge of the outer cloth 3*a*, is inserted into the slit 4 and stitched to the rear side. The other lateral end portion of the adjusting cloth 21 is sewed in an overlapped way so as to have a portion of a fixed width folded in two sheets. The present embodiment is different from the seventh embodiment in the end portion of the adjusting cloth 21 to be inserted in the slit 4 of the outer cloth 3*a*. However, such end portion has its stitched part hidden. Moreover, if the user touches that part, he or she never feels strange. Furthermore, the appearance improves.

NINTH EMBODIMENT

Figure 31:
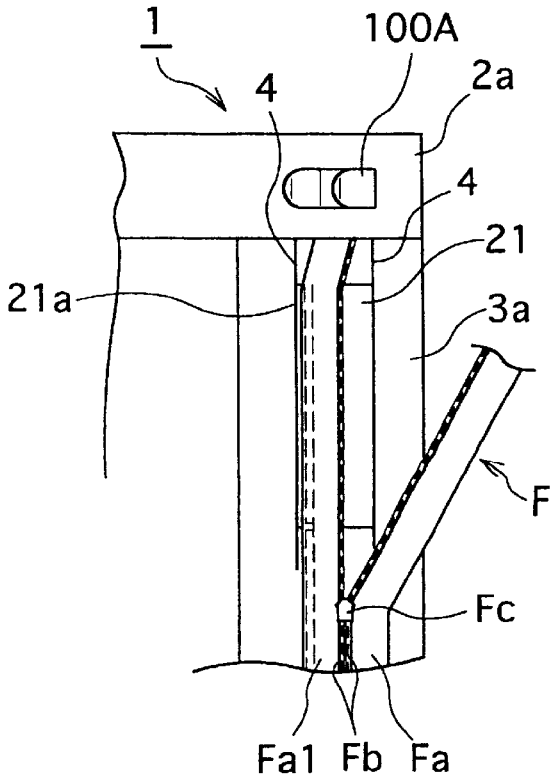
FIG. 31 is an explanatory drawing showing one example of sewing a zip fastener and an adjusting cloth on a garment having a waist-adjusting mechanism according to a ninth embodiment of the invention.
Figure 32:
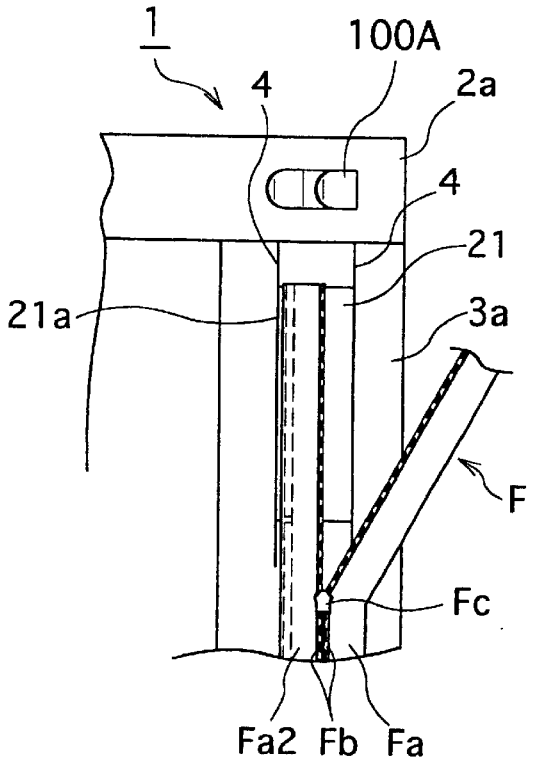
FIG. 32 is an explanatory drawing showing another example of sewing a zip fastener and the adjusting cloth on the garment having the waist-adjusting mechanism according to the ninth embodiment of the invention.
Figure 33:
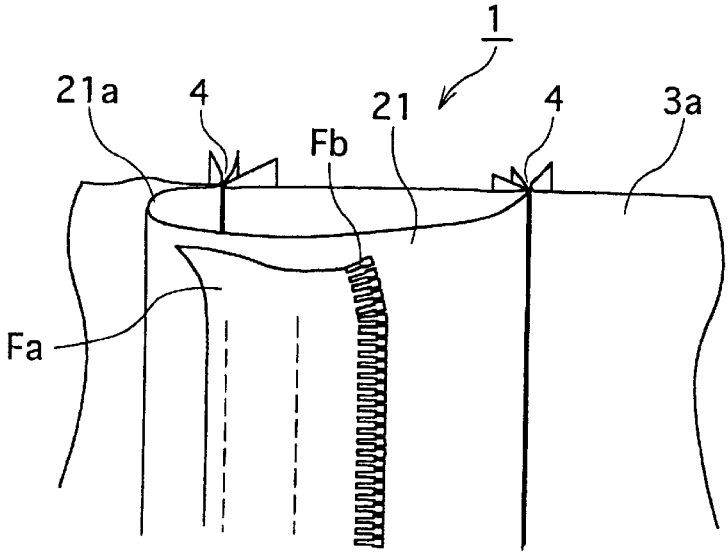
FIG. 33 is a perspective view, enlarged in part, of the example of sewing the zip fastener and the adjusting cloth on the garment having the waist-adjusting mechanism according to the ninth embodiment of the invention.

A ninth embodiment is described hereafter. FIG. 31 is an explanatory drawing showing one example of sewing a zip fastener and an adjusting cloth on a garment having a waist-adjusting mechanism according to a ninth embodiment of the invention. FIG. 32 is an explanatory drawing showing another example of sewing a zip fastener and the adjusting cloth on the garment having the waist-adjusting mechanism according to the ninth embodiment of the invention. FIG. 33 is a perspective view, enlarged in part, of the example of sewing the zip fastener and the adjusting cloth on the garment having the waist-adjusting mechanism according to the ninth embodiment of the invention.

As shown in FIG. 31 to FIG. 33, a waist-adjustable garment according to the ninth embodiment is different from the seventh embodiment in the position of the slit 4 which is cut vertically on the lining of the outer cloth 3*a*. Specifically, it forms the slits 4 not only at the other stitching position, which is located nearer to the edge of the outer cloth 3*a*, but also at the one stitching position, which is located away from the edge of the outer cloth 3*a*. In the pants 1 of the ninth embodiment, as shown in FIG. 33, two slits 4 are formed vertically on the lining of the outer cloth 3*a*. Both the lateral end portions of the adjusting cloth 21 are inserted into the corresponding slits 4, respectively, and stitched to the rear side. In the present embodiment, both the lateral end portions of the adjusting cloth 21 are inserted and hidden in the slit 4 of the outer cloth 3*a*. Therefore, the appearance improves very much.

TENTH EMBODIMENT

Figure 34:
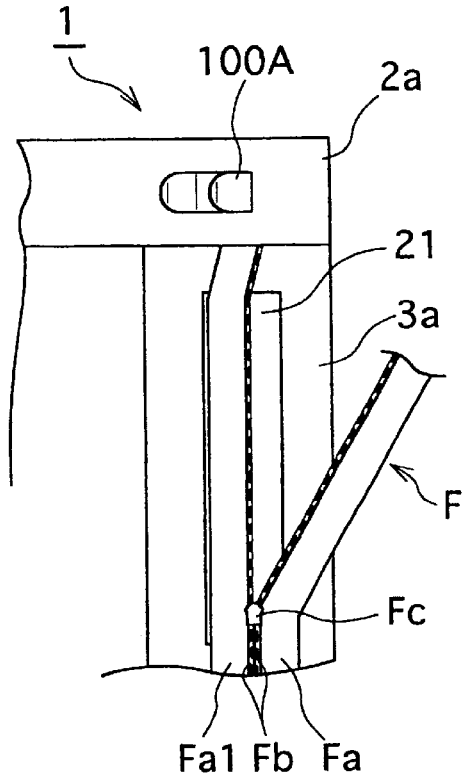
FIG. 34 is an explanatory drawing showing one example of sewing a zip fastener and an adjusting cloth on a garment having a waist-adjusting mechanism according to a tenth embodiment of the invention.
Figure 35:
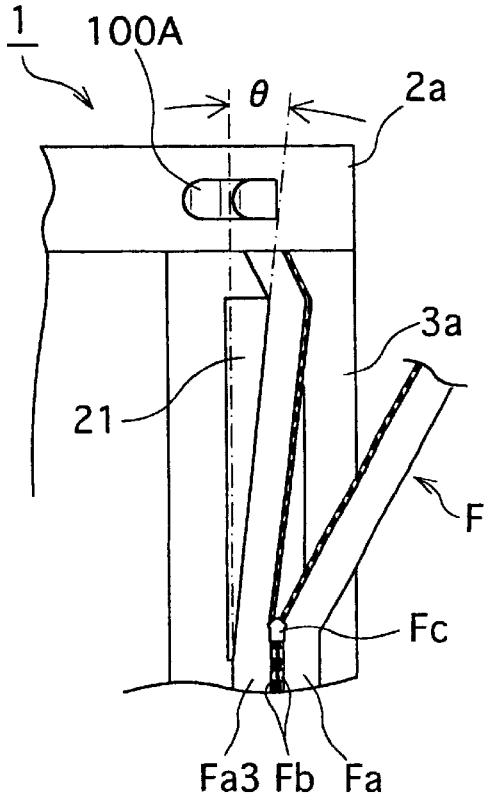
FIG. 35 is an explanatory drawing showing another example of sewing a zip fastener and the adjusting cloth on the garment having the waist-adjusting mechanism according to the tenth embodiment of the invention.
Figure 36:
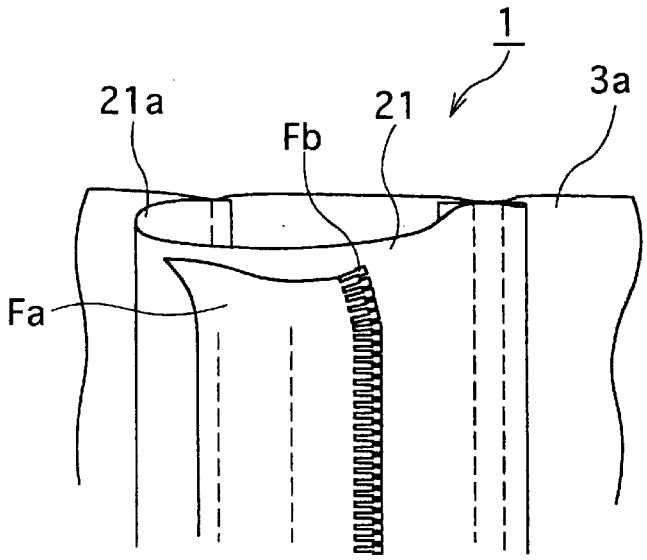
FIG. 36 is a perspective view, enlarged in part, of the example of sewing the zip fastener and the adjusting cloth on the garment having the waist-adjusting mechanism according to the tenth embodiment of the invention.

A tenth embodiment is described hereafter. FIG. 34 is an explanatory drawing showing one example of sewing a zip fastener and an adjusting cloth on a garment having a waist-adjusting mechanism according to a tenth embodiment of the invention. FIG. 35 is an explanatory drawing showing another example of sewing a zip fastener and the adjusting cloth on the garment having the waist-adjusting mechanism according to the tenth embodiment of the invention. FIG. 36 is a perspective view, enlarged in part, of the example of sewing the zip fastener and the adjusting cloth on the garment having the waist-adjusting mechanism according to the tenth embodiment of the invention.

The seventh to ninth embodiments of waist-adjustable garment have the vertical slit 4 on the lining or the outer cloth 3*a* so that the lateral end portion of the adjusting cloth 21 is inserted and stitched in the slit 4. However, as shown in FIG. 34 to FIG. 36, the tenth embodiment of pants 1 has no slit 4 on the lining of the outer cloth 3*a*. Instead, both the lateral end portions of the adjusting cloth 21 are stitched directly to the lining of the outer cloth 3*a*. It makes easier the stitching work of the adjusting cloth 21 to the outer cloth 3*a*.

In the present embodiment, as shown in FIG. 35, a fastener tape Fa3 that is stitched at the side of the outer cloth 3*a* may have an upper end held inside the belt lining 2*a* and its general portion stitched to the adjusting cloth 21 at an inclination. That is, the fastener tape Fa3 is slanted outwardly at an angle θ relative to the adjusting cloth 21. Specifically, the fastener tape Fa3 is stitched to the adjusting cloth 21 so that it is inclined upward at the angle θ. Thus, a size variation is obtained depending on the hooking state of the hook element 100A and the socket element 100B. Particularly, such size variation is obtained by the stitching of the fastener tape Fa to the adjusting cloth 21. In case the fastener tape Fa is stitched parallel to the adjusting cloth 21 at an angle zero, there may be generated a bulged portion on the pants 1 due to a useless room when the user sits down. Such useless room is provided, while the size variation being obtained depending on the hooking state of the hook element 100A and the socket element 100B, if the fastener tape Fa3 is stitched to the adjusting cloth 21 so as to be inclined upward at the angle θ.

In the eight to tenth embodiments of waist adjustable garment, the upper end of the fastener tape Fa may be held and sewed inside the belt lining 2*a* while slanted outwardly of the edge of the outer cloth 3*a* as shown by the example Fa1 in FIG. 28 or FIG. 31. Alternatively, the upper end of the fastener tape Fa may be sewed only on the adjusting cloth 21 up to the same height as the upper end of the adjusting cloth 21 as shown by the example Fa2 in FIG. 29 or FIG. 32. With such structure, the upper end of the fastener tape Fa never hinders the stitched portion to the adjusting cloth 21 from moving outward beyond the edge of the outer cloth 3*a*. Then, a section where the waist size of the pants 1 is adjustable is completely continuous from the end of the pants 1 downward to the portion where the adjusting cloth 21 is provided. Thus, the user never feels tight when he or she puts on the pants 1. The appearance is prevented from being worse due to the periphery of the front center opening 3 being pulled or wrinkled. Moreover, there is not generated useless room thereon.

The eighth to tenth embodiments of the pants 1 have generally the same structure as the seventh embodiment of the pants 1 and exhibit generally the same function and effects as the seventh embodiment.

ELEVENTH EMBODIMENT

Figure 37:
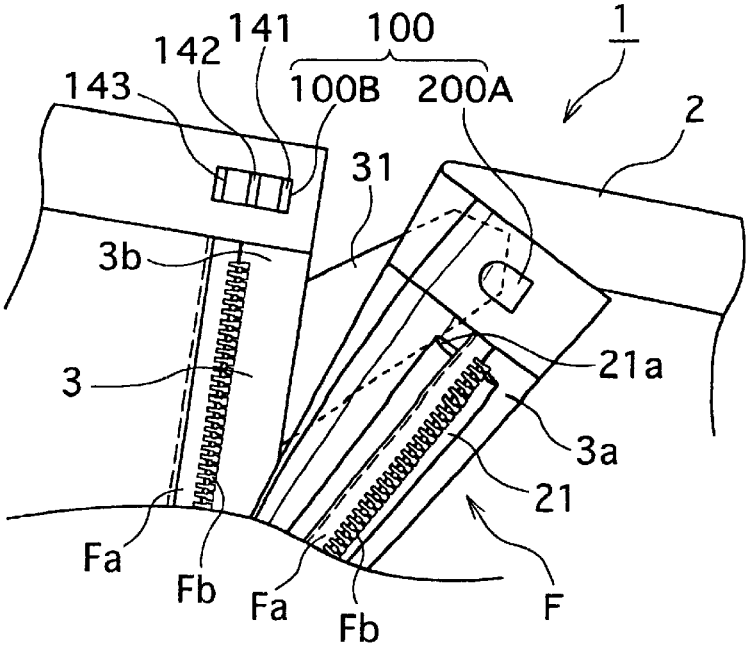
FIG. 37 is an explanatory drawing entirely showing a size-adjusting mechanism of a garment having a waist-adjusting mechanism according to an eleventh embodiment of the invention.

An eleventh embodiment is described hereafter. FIG. 37 is an explanatory drawing entirely showing a size-adjusting mechanism of a garment having a waist-adjusting mechanism according to an eleventh embodiment of the invention.

As shown in FIG. 37, pants 1 as a waist adjustable garment according to the eleventh embodiment have a hook assembly 100. The hook assembly 100 is composed of a socket element 100B and a hook element 200A. The socket element 100B is fixed at the upper part of the inner cloth 3*b* so as be lined along the waist belt 2. The hook element 200A catches one of plural sockets 141, 142, 143 of the socket element 100B at different positions. Thus, the hook element 100 joins the waist belt 2 of the pants 1. The socket element 100B can be configured by adding one additional socket 153 to the sockets 141 and 142 of the socket element 100B of the first embodiment, for example. Such hook assembly 100 not only joins the upper ends of the front center opening 3 in a separable way but also adjusts the size of the waist belt 2 within a predetermined range. Therefore, the hook assembly 100 can join the upper ends of the front center opening 3 while adjusting the waist size of the pants 1 so as to fit to the waist size of the user.

The eleventh embodiment of the hook assembly 100 may be used in the eight to tenth embodiments of the waist adjustable garment. The eleventh embodiment of the pants 1 have generally the same structure as the seventh embodiment of the pants 1 and exhibit generally the same function and effects as the seventh embodiment of the pants 1.

TWELFTH EMBODIMENT

Figure 38:
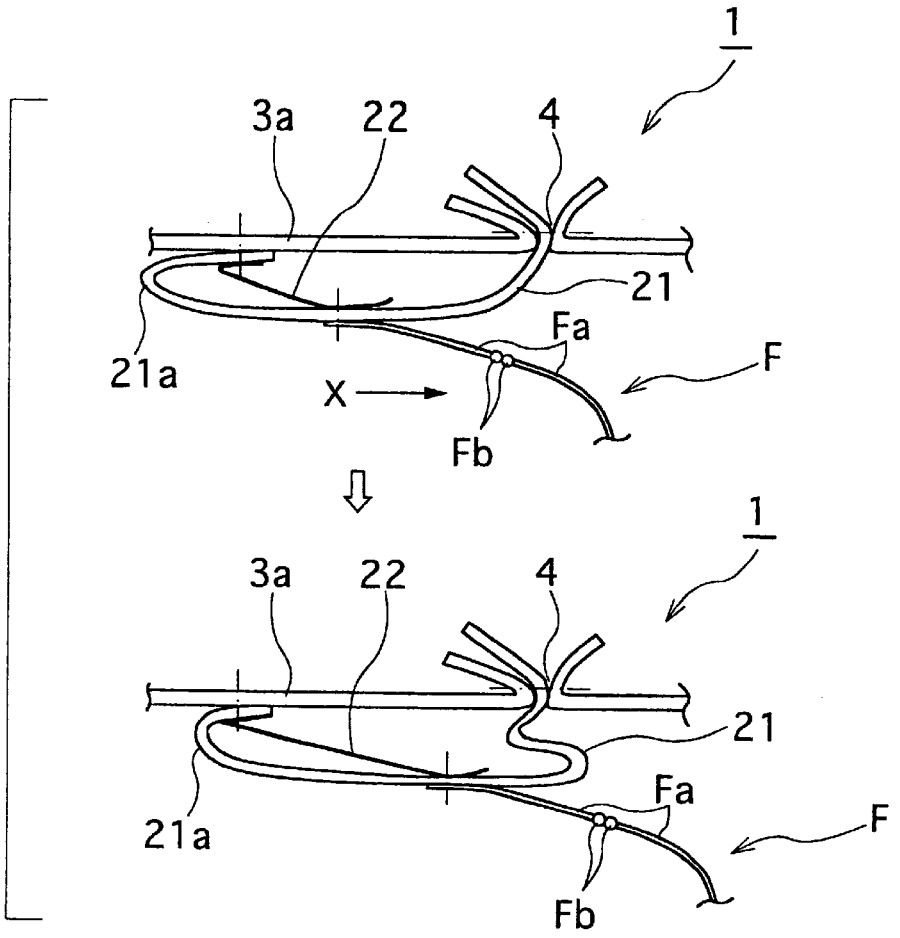
FIG. 38 is an explanatory drawing showing a structure of an adjusting cloth of a garment having a waist-adjusting mechanism according to a twelfth embodiment of the invention.
Figure 39:
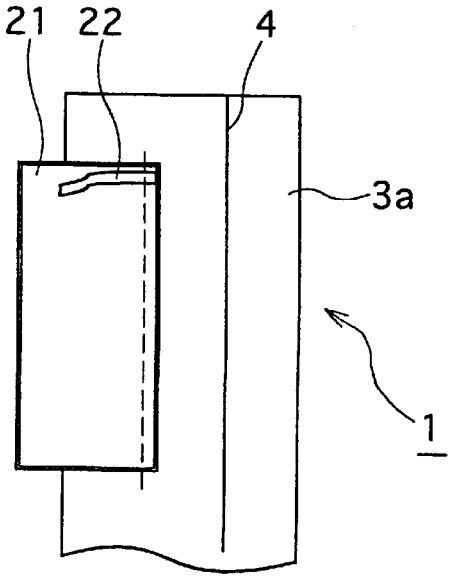
FIG. 39 is an explanatory drawing showing a step of sewing the adjusting cloth of the garment having the waist-adjusting mechanism according to the twelfth embodiment of the invention.
Figure 40:
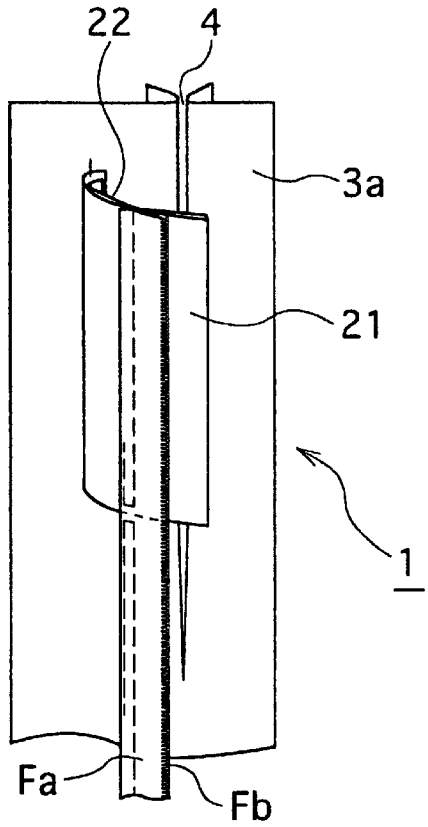
FIG. 40 is an explanatory drawing showing a step, next to the step of FIG. 39, of sewing the adjusting cloth of the garment having the waist-adjusting mechanism according to the twelfth embodiment of the invention.
Figure 41:
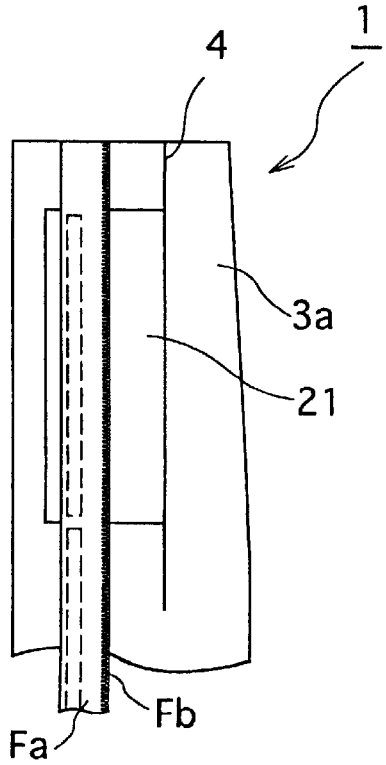
FIG. 41 is an explanatory drawing showing a step, next to the step of FIG. 40, of sewing the adjusting cloth of the garment having the waist-adjusting mechanism according to the twelfth embodiment of the invention.
Figure 42:
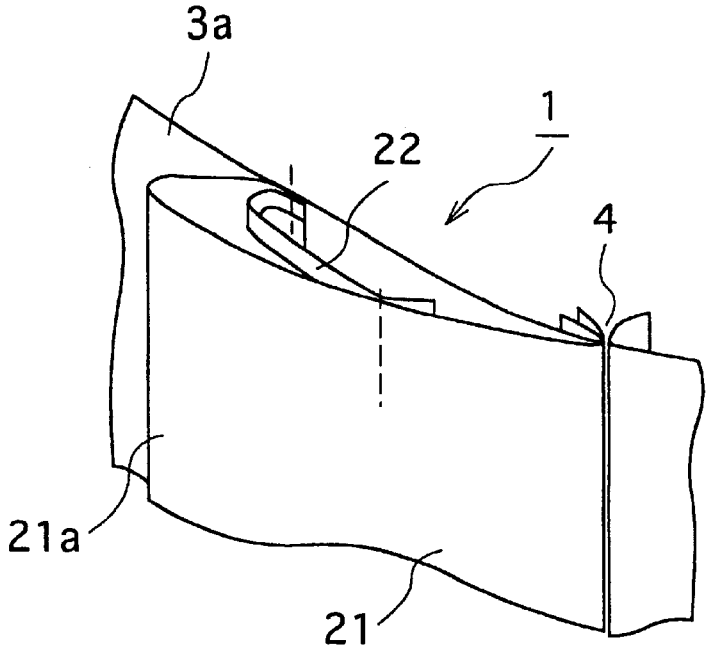
FIG. 42 is an explanatory drawing showing a step, next to the step of FIG. 41, of sewing the adjusting cloth of the garment having the waist-adjusting mechanism according to the twelfth embodiment of the invention.

A twelfth embodiment is described hereafter. FIG. 38 is an explanatory drawing showing a structure of an adjusting cloth of a garment having a waist-adjusting mechanism according to a twelfth embodiment of the invention. FIG. 39 is an explanatory drawing showing a step of sewing the adjusting cloth of the garment having the waist-adjusting mechanism according to the twelfth embodiment of the invention. FIG. 40 is an explanatory drawing showing a step, next to the step of FIG. 39, of sewing the adjusting cloth of the garment having the waist-adjusting mechanism according to the twelfth embodiment of the invention. FIG. 41 is an explanatory drawing showing a step, next to the step of FIG. 40, of sewing the adjusting cloth of the garment having the waist-adjusting mechanism according to the twelfth embodiment of the invention. FIG. 42 is an explanatory drawing showing a step, next to the step of FIG. 41, of sewing the adjusting cloth of the garment having the waist-adjusting mechanism according to the twelfth embodiment of the invention.

As shown in FIG. 38 to FIG. 42, a waist adjustable garment according to the twelfth embodiment provides a rubber sheet or rubber band 22 as a shape keeper on the seventh embodiment of the pants 1, for the purpose of urging the overlap 21*a* of the adjusting cloth 21 so as to be closed or overlapped. One end of the rubber band 22 is sewed on the stitching position of the other lateral end portion of the adjusting cloth 21, which is located away from the edge of the outer cloth 3*a*. The other end of the rubber band 22 is sewed on a position of the fastener tape Fa that is stitched to the adjusting cloth 21 at the same time, while the rubber band 22 being in a contracted state.

Specifically, as shown in FIG. 39, the other end portion of the adjusting cloth 21, which is located away from the edge of the outer cloth 3*a*, is first stitched together with the one end of the rubber band 22 along the outer cloth 3*a*. Next, as shown in FIG. 40, the adjusting cloth 21 is turned back so as to show its front side. Then, the fastener tape Fa is stitched along nearly a lateral center of the front side of the adjusting cloth 21. At the same time, the other end of the rubber band 22 is sewed on the stitching position of the fastener tape Fa. At this time, the rubber band 22 is kept contracted. Thereafter, as shown in FIG. 41 and FIG. 42, the one end portion of the adjusting cloth 21, which is nearer to the edge of the outer cloth 3*a*, is inserted in the vertical slit 4 of the lining of the outer cloth 3*a* and sewed thereto from the rear side.

According to the structure of the twelfth embodiment, if the fastener F is pulled outwardly of the edge outer cloth 3*a* as shown by an arrow S in FIG. 38, the overlap 21*a* of the adjusting cloth 21 is extended. As the overlap 21*a* is extended, the rubber band 22 is stretched. To the contrary, if the fastener F is released from the force pulling it in the direction of the arrow X, the extended overlap 21*a* is urged in a contracting direction of the rubber band 22. Therefore, the overlap 21*a* easily returns to its original stitched state. Consequently, the overlap 21*a* is prevented from being kept extended unintentionally. As a result, the size of the area below the waist of the pants 1 does not become excessively long, so that the pants 1 do not generate any loose portion or wrinkles. The rubber band 22 urges the overlap 21*a* so as to facilitate its returning to the original sewing state. Such rubber band 22 may be provided not only in the present embodiment but also in the waist adjustable garment according to the eighth to eleventh embodiments. If the pants 1 according to the eighth to eleventh embodiments are provided with the rubber band 22, they have the same function and effects as the pants according to the twelfth embodiment. The twelfth embodiment of the pants 1 uses the rubber band 22 as the shape keeper for urging the overlap 21*a* of the adjusting cloth 21 so as to be folded. Alternatively, the shape keeper may be embodied by weaving fibers of a shape memory alloy into the adjusting cloth 21, for example.

In conclusion, the waist size of the pants 1 can be adjusted so as to fit the waist size of the user at the upper end joining portions of the front center opening 3 by the hook assembly 100, according to the seventh to twelfth embodiments. Moreover, the waist size of the pants 1 can be prolonged within the length in which the overlap 21*a* of the adjusting cloth 21 is extendible, at the area from the upper part downwardly to a fixed position of the front center opening 3 (area where the adjusting cloth 21 is stitched between the outer cloth 3*a* and the fastener tape Fa as the seam allowance of the fastener F). Therefore, the waist size of each part of the pants 1 can be prolonged according not only to the change of the waist size of the user but also to a change of the size of the portion around the waist. For example, not only the waist belt 2 of the pants 1 but also a lower portion around the waist belt 2 can be prolonged. Thus, the user has no tight feeling when he or she puts on the pants 1. Moreover, the peripheral part of the front center opening 3 is prevented from being pulled or wrinkled, thereby improving the appearance thereof.

The above embodiments are described provided that the waist adjustable garment has the buttonhole piece 31. However, the invention may be embodied into pants 1 that have no buttonhole piece 31. Particularly, the women's pants do not use it generally. Moreover, the buttonhole piece can be eliminated from the men's pants.

In the waist adjustable garments according to the above embodiments, the adjusting cloth 21 has a constant width. However, the invention may be embodied such that the adjusting cloth 21 has an upper end longer and a lower end shorter. Moreover, the adjusting cloth 21 is provided on the outer cloth 3*a* up to the area of about ⅓ to ½ of the length of the outer cloth 3*a* from the upper side to the lower side thereof. However, the upper end of the adjusting cloth 21 has much influence on the size adjustment, while the lower end thereof has less influence. Therefore, the adjusting cloth 21 may be eliminated at the lower part. Of course, it is not always necessary to eliminate the lower part.

THIRTEENTH EMBODIMENT

A thirteenth embodiment is described hereafter. The thirteenth embodiment of waist adjustable garment is also described with respect to waist-adjustable pants. however, the invention can be embodied into a waist-adjustable skirt that is applicable to a variety of skirts such as culottes.

Figure 43:
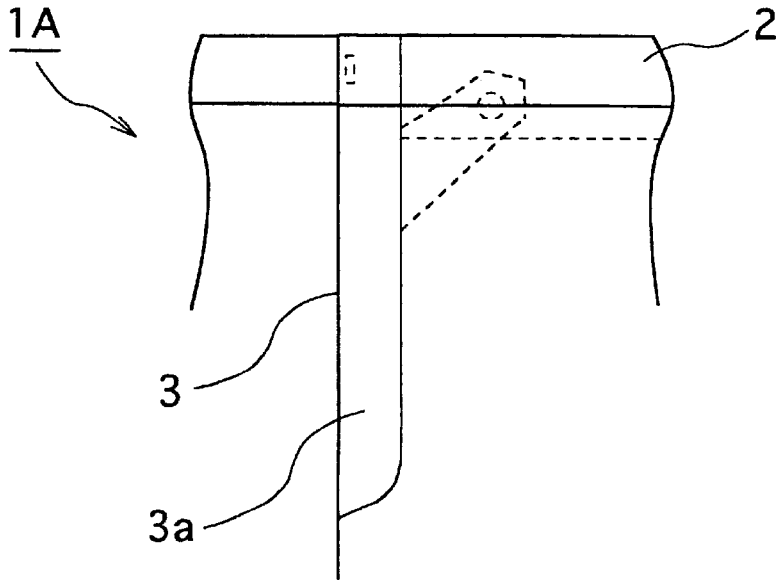
FIG. 43 is a front elevation, seen from an outside, of a portion of a garment having a waist-adjusting mechanism according to a thirteenth embodiment of the invention on which a size adjusting mechanism is assembled.
Figure 44:
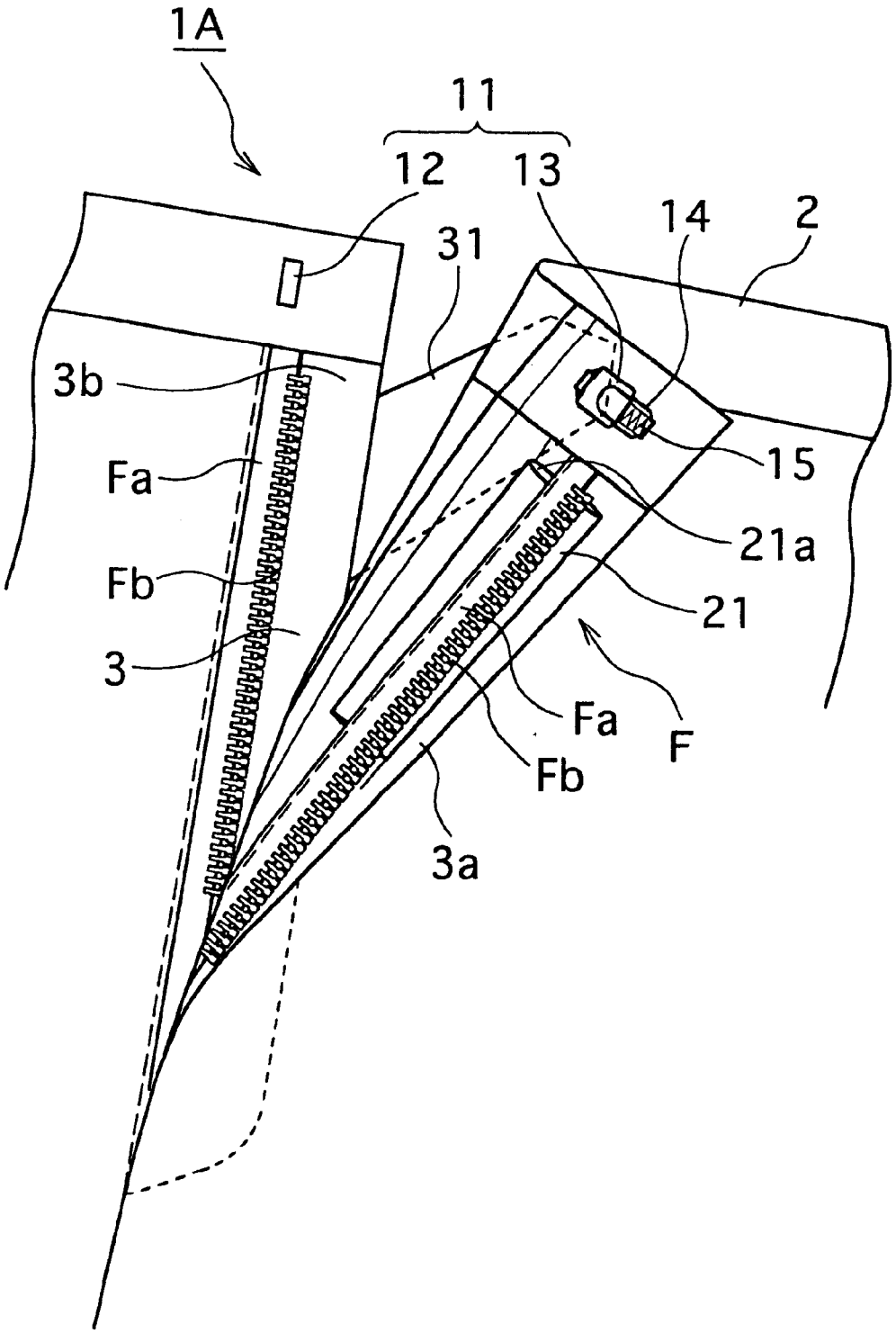
FIG. 44 is an explanatory drawing showing a major part of the garment having the waist-adjusting mechanism according to the thirteenth embodiment of the invention.
Figure 45:
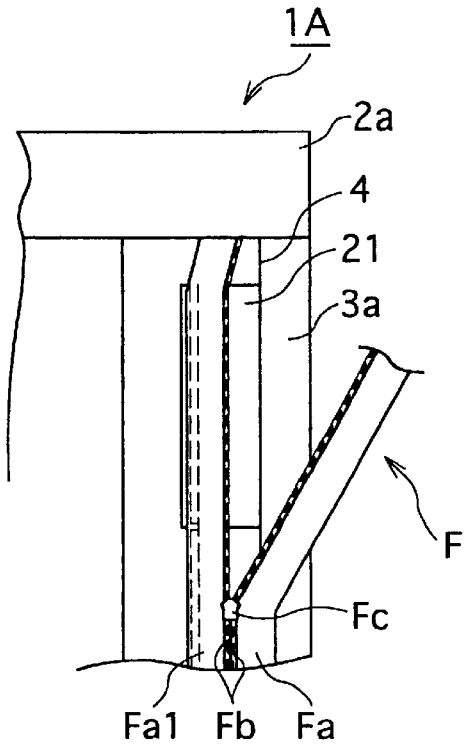
FIG. 45 is an explanatory drawing showing one example of sewing a zip fastener and an adjusting cloth on the garment having the waist-adjusting mechanism according to the thirteenth embodiment of the invention.
Figure 46:
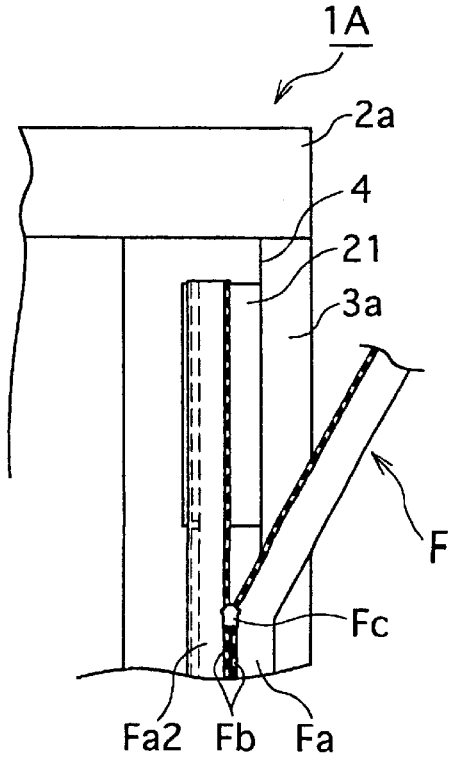
FIG. 46 is an explanatory drawing showing another example of sewing a zip fastener and the adjusting cloth on the garment having the waist-adjusting mechanism according to the thirteenth embodiment of the invention.
Figure 47:
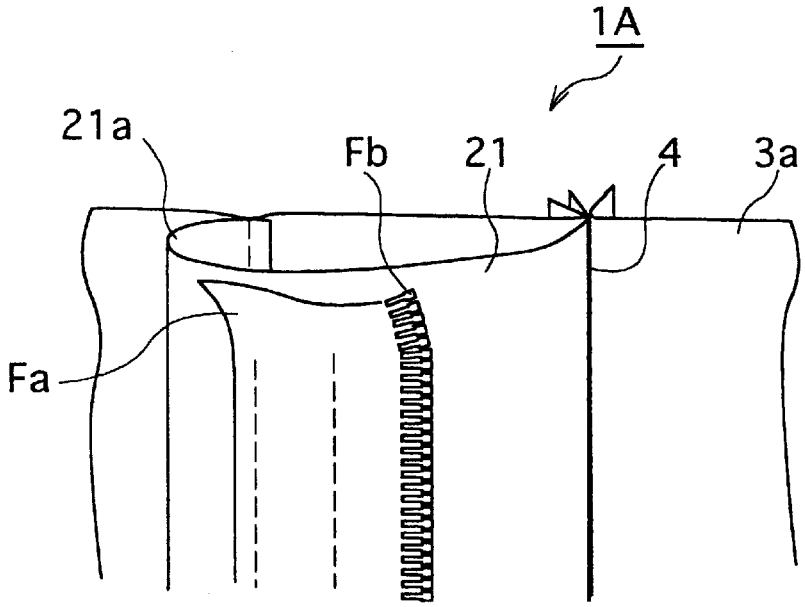
FIG. 47 is a perspective view, enlarged in part, of the example of sewing the zip fastener and the adjusting cloth on the garment having the waist-adjusting mechanism according to the thirteenth embodiment of the invention.
Figure 48:
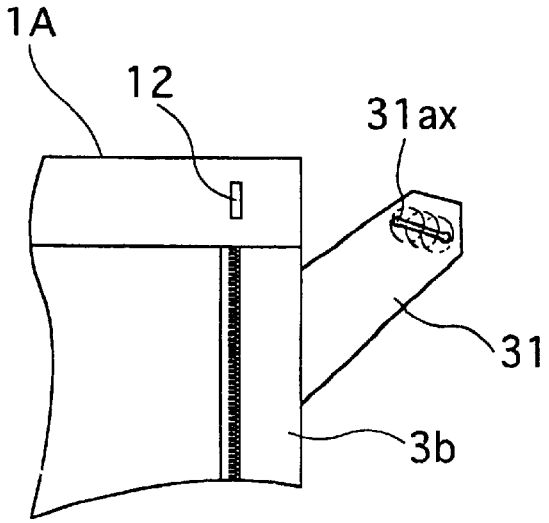
FIG. 48 is an explanatory drawing showing a buttonhole piece of the garment having the waist-adjusting mechanism according to the thirteenth embodiment of the invention.

FIG. 43 is a front elevation, seen from an outside, of a portion of a garment having a waist-adjusting mechanism according to a thirteenth embodiment of the invention on which a size adjusting mechanism is assembled. FIG. 44 is an explanatory drawing showing a major part of the garment having the waist-adjusting mechanism according to the thirteenth embodiment of the invention. FIG. 45 is an explanatory drawing showing one example of sewing a zip fastener and an adjusting cloth on the garment having the waist-adjusting mechanism according to the thirteenth embodiment of the invention. FIG. 46 is an explanatory drawing showing another example of sewing a zip fastener and the adjusting cloth on the garment having the waist-adjusting mechanism according to the thirteenth embodiment of the invention. FIG. 47 is a perspective view, enlarged in part, of the example of sewing the zip fastener and the adjusting cloth on the garment having the waist-adjusting mechanism according to the thirteenth embodiment of the invention. FIG. 48 is an explanatory drawing showing a buttonhole piece of the garment having the waist-adjusting mechanism according to the thirteenth embodiment of the invention.

As shown in FIG. 43 to FIG. 48, the pants 1A as the thirteenth embodiment of the waist adjustable garment has a similar structure to that of the seventh embodiment of the pants 1. In contrast therewith, the pants 1A has a hook assembly 11 to join the upper ends of the front center opening 3 in a separable way.

The hook assembly 11 is composed of a socket 12 and a hook 13. A guide 14 is fixed on the upper part of the outer cloth 3. The hook 13 is supported on the guide 14 so as to slide within a range of 10 mm to 30 mm, while urged by a spring 14 inwardly of the edge of the outer cloth 3*a*. The hook 13 is caught by the socket 12, which is secured to the upper part of the outer cloth 3*a*. Thus, the hook assembly 11 joins the upper parts of the outer cloth 3*a* and the inner cloth 3*b* with each other in a separable way. Consequently, if an external force is applied in such a direction as to increase the size of the waist belt 2 of the pants 1, the hook 13 moves in a direction pulled by the socket 12 against an urging force of the spring 15, while guided by the guide 14. Thereby, the size of the waist belt 2 of the pants is prolonged. That is, the hook assembly 11 made of the socket 12 and the hook 13 constitutes a joint tool that not only joins the upper ends of the front center opening 3 of the pants 1 in a separable way but also adjusts the waist size of the pants 1 in a fixed range.

The adjusting cloth 21 has the same structure as that of the seventh embodiment and permits the joint tool defined by the hook assembly 11 or the like to smoothly adjust the waist size of the pants 1. That is, the adjusting cloth 21 of the present embodiment has the same function and effects as that of the seventh embodiment.

As shown in FIG. 48, the thirteenth embodiment of the pants 1A has the buttonhole 31*ax* extending generally in a horizontal direction with the same function and effects as the seventh embodiment in view thereof, too.

As described above, the thirteenth embodiment of the pants 1A has substantially the same function and effects as the seventh embodiment as a whole.

Specifically, if an external force is applied in a direction to enlarge the size of the waist belt 2 of the pants 1, the size of the waist belt 2 can be enlarged at the joint portion by the hook assembly 11 around the upper ends of the front center opening 3. That is, the tipper ends of the front center opening 3 can be joined by the hook assembly 11 in an adjusted state so as to make the waist size of the pants 1 fit to the waist size of the user.

FOURTEENTH EMBODIMENT

Figure 49:
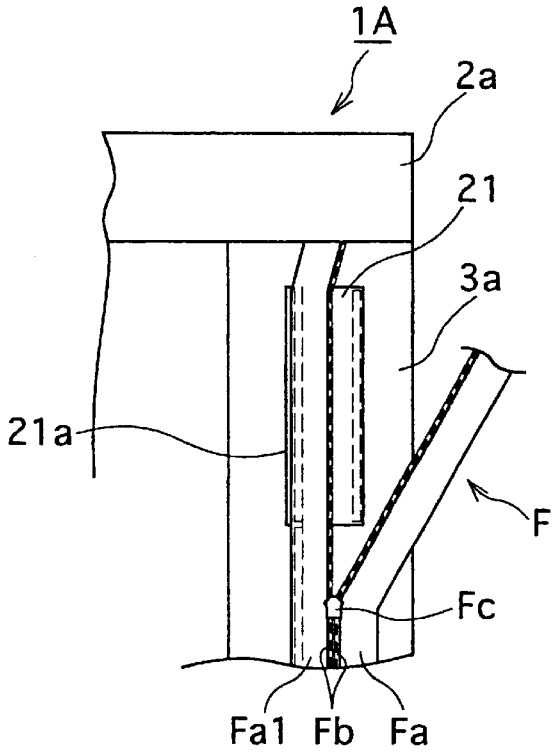
FIG. 49 is an explanatory drawing showing one example of sewing a zip fastener and an adjusting cloth on a garment having a waist-adjusting mechanism according to a fourteenth embodiment of the invention.
Figure 50:
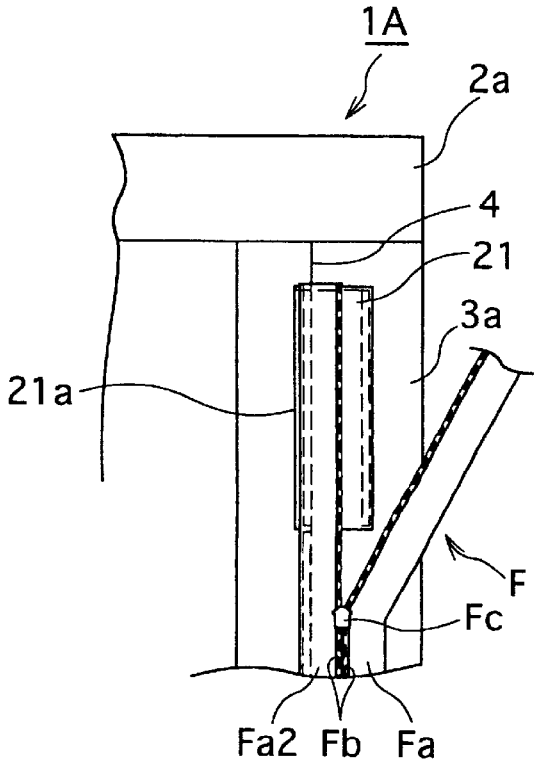
FIG. 50 is an explanatory drawing showing another example of sewing a zip fastener and the adjusting cloth on the garment having the waist-adjusting mechanism according to the fourteenth embodiment of the invention.
Figure 51:
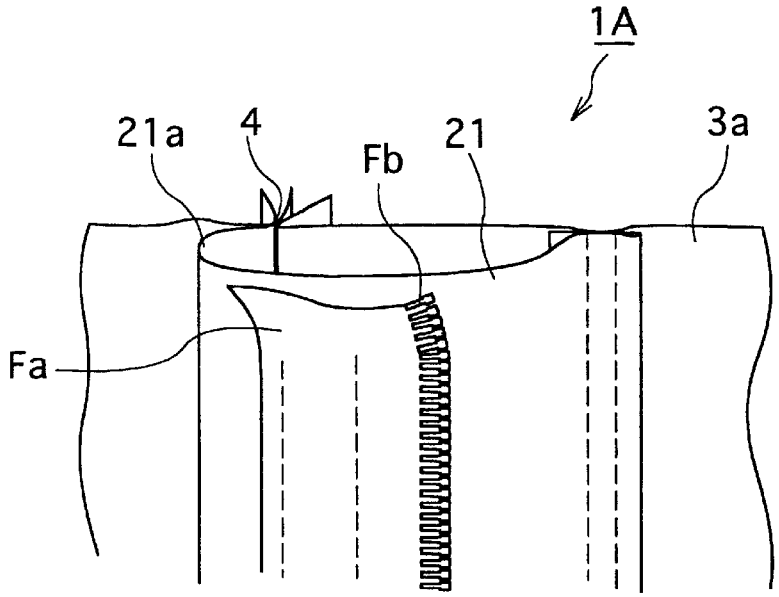
FIG. 51 is a perspective view, enlarged in part, of the example of sewing the zip fastener and the adjusting cloth on the garment having the waist-adjusting mechanism according to the fourteenth embodiment of the invention.

A fourteenth embodiment is described hereafter. FIG. 49 is an explanatory drawing showing one example of sewing a zip fastener and an adjusting cloth on a garment having a waist-adjusting mechanism according to a fourteenth embodiment of the invention. FIG. 50 is an explanatory drawing showing another example of sewing a zip fastener and the adjusting cloth on the garment having the waist-adjusting mechanism according to the fourteenth embodiment of the invention. FIG. 51 is a perspective view, enlarged in part, of the example of sewing the zip fastener and the adjusting cloth on the garment having the waist-adjusting mechanism according to the fourteenth embodiment of the invention.

As shown in FIG. 49 to FIG. 51, a waist adjustable garment according to the fourteenth embodiment has such a relation to the thirteenth embodiment as the eighth embodiment has in relation to the seventh embodiment. Specifically, in the fourteenth embodiment, the slit 4 is cut not at the stitching position of the one lateral end portion of the adjusting cloth 21 that is located nearer to the edge of the outer cloth 3*a*, but at the position which is located away from the edge of the outer cloth 3*a*.

FIFTEENTH EMBODIMENT

Figure 52:
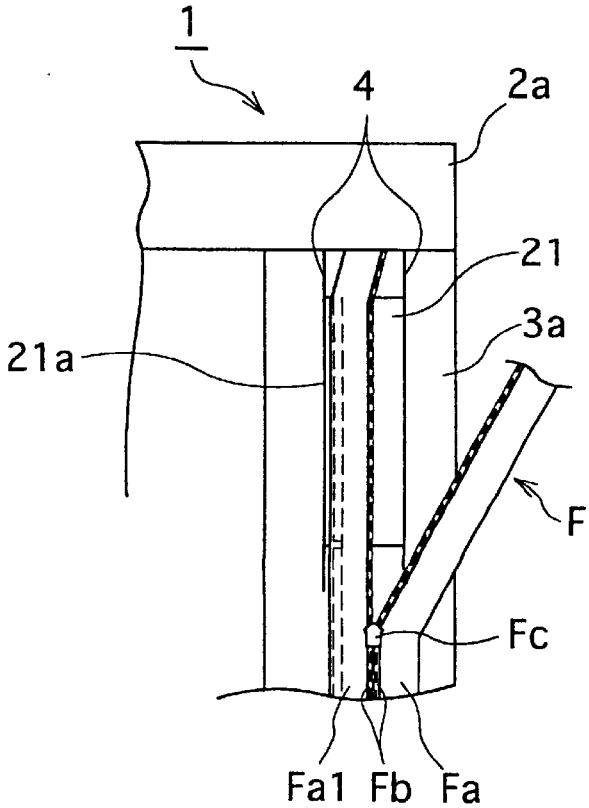
FIG. 52 is an explanatory drawing showing one example of sewing a zip fastener and an adjusting cloth on a garment having a waist-adjusting mechanism according to a fifteenth embodiment of the invention.
Figure 53:
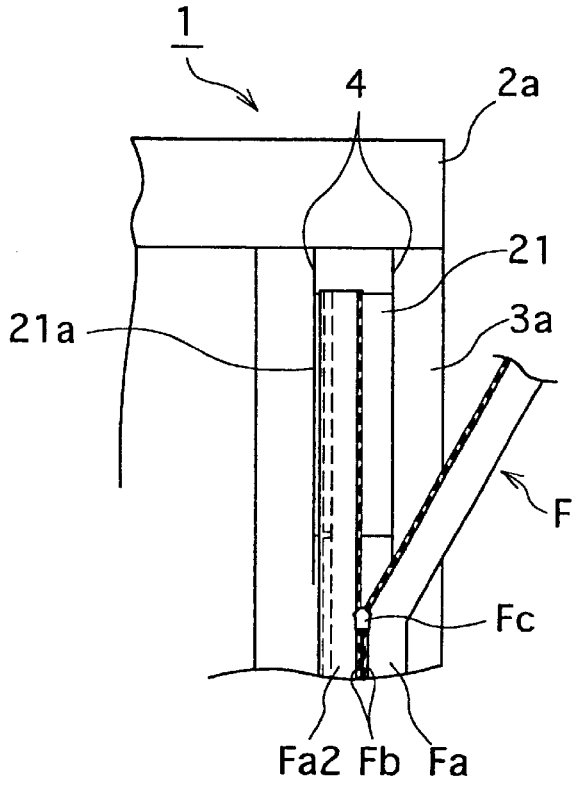
FIG. 53 is an explanatory drawing showing another example of sewing a zip fastener and the adjusting cloth on the garment having the waist-adjusting mechanism according to the fifteenth embodiment of the invention.
Figure 54:
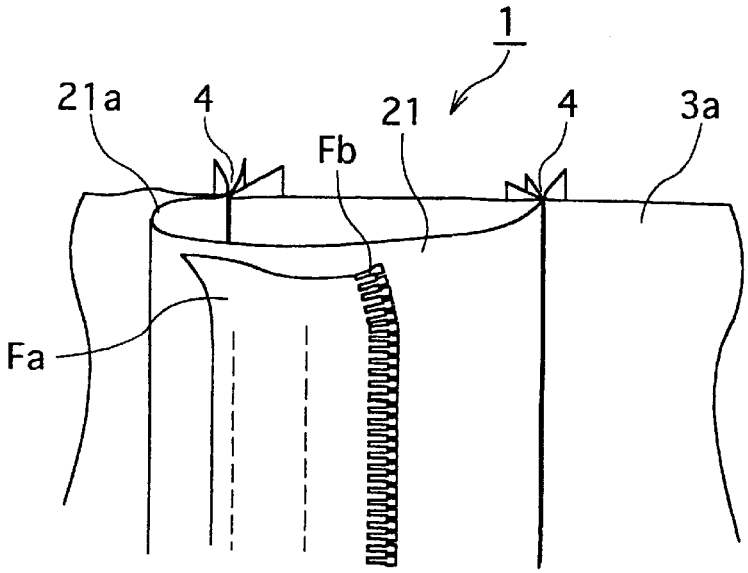
FIG. 54 is a perspective view, enlarged in part, of the example of sewing the zip fastener and the adjusting cloth on the garment having the waist-adjusting mechanism according to the fifteenth embodiment of the invention.

A fifteenth embodiment is described hereafter. FIG. 52 is an explanatory drawing showing one example of sewing a zip fastener and an adjusting cloth on a garment having a waist-adjusting mechanism according to a fifteenth embodiment of the invention. FIG. 53 is an explanatory drawing showing another example of sewing a zip fastener and the adjusting cloth on the garment having the waist-adjusting mechanism according to the fifteenth embodiment of the invention. FIG. 54 is a perspective view, enlarged in part, of the example of sewing the zip fastener and the adjusting cloth on the garment having the waist-adjusting mechanism according to the fifteenth embodiment of the invention.

As shown in FIG. 52 to FIG. 54, a waist adjustable garment according to the fifteenth embodiment has such a relation to the thirteenth embodiment as the ninth embodiment has in relation to the seventh embodiment. Specifically, in the fifteenth embodiment, the slit 4 is cut not only at the stitching position of the one lateral end portion of the adjusting cloth 21 that is located nearer to the edge of the outer cloth 3*a*, but also at the position which is located away from the edge of the outer cloth 3*a*.

SIXTEENTH EMBODIMENT

Figure 55:
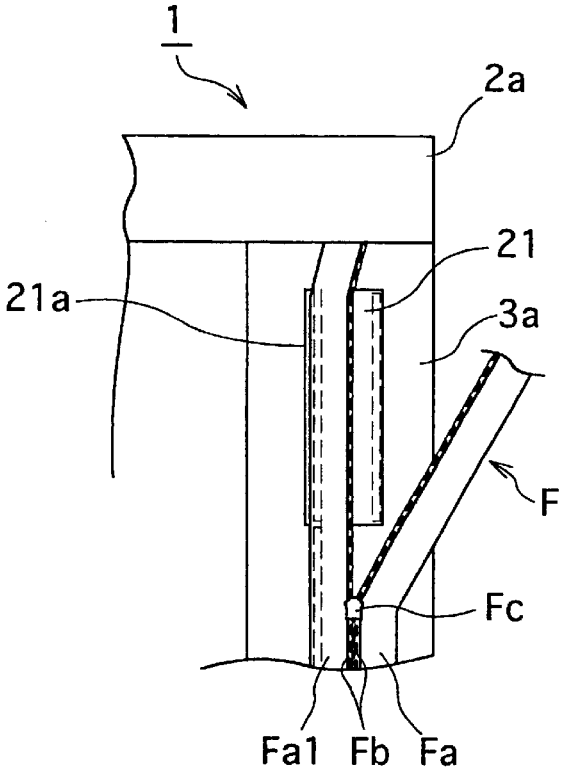
FIG. 55 is an explanatory drawing showing one example of sewing a zip fastener and an adjusting cloth on a garment having a waist-adjusting mechanism according to a sixteenth embodiment of the invention.
Figure 56:
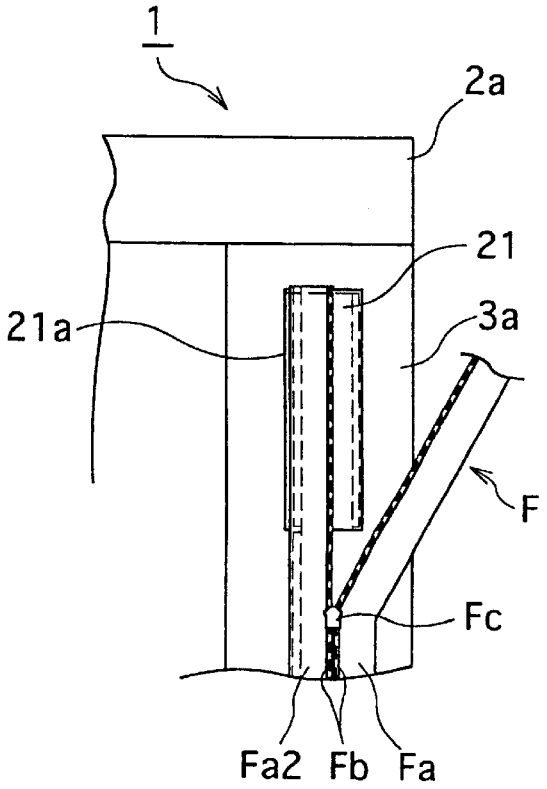
FIG. 56 is an explanatory drawing showing another example of sewing a zip fastener and the adjusting cloth on the garment having the waist-adjusting mechanism according to the sixteenth embodiment of the invention.
Figure 57:
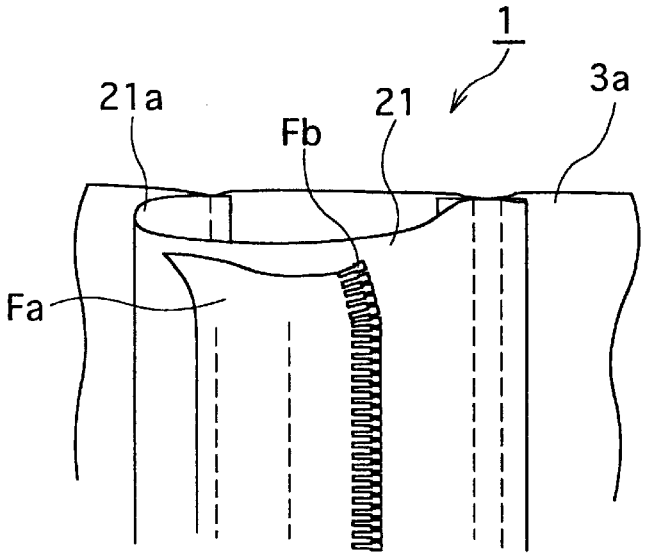
FIG. 57 is a perspective view, enlarged in part, of the example of sewing the zip fastener and the adjusting cloth on the garment having the waist-adjusting mechanism according to the sixteenth embodiment of the invention.

A sixteenth embodiment is described hereafter. FIG. 55 is an explanatory drawing showing one example of sewing a zip fastener and an adjusting cloth on a garment having a waist-adjusting mechanism according to a sixteenth embodiment of the invention. FIG. 56 is an explanatory drawing showing another example of sewing a zip fastener and the adjusting cloth on the garment having the waist-adjusting mechanism according to the sixteenth embodiment of the invention. FIG. 57 is a perspective view, enlarged in part, of the example of sewing the zip fastener and the adjusting cloth on the garment having the waist-adjusting mechanism according to the sixteenth embodiment of the invention.

In the waist adjustable garment according to the thirteenth to fifteenth embodiments, the vertical slit 4 is formed on the lining of the outer cloth 3*a* so that the lateral end of the adjusting cloth 21 is inserted and stitched therein. In contrast, as shown in FIG. 55 to FIG. 57, both the lateral end portions of the adjusting cloth 21 are stitched directly to the lining of the outer cloth 3*a* without any slit 4 formed on the lining, in the sixteenth embodiment of pants 1.

The fourteenth to sixteenth embodiments have generally the same structure in the other elements and have generally the same function and effects as the first embodiment of the pants 1.

SEVENTEENTH EMBODIMENT

Figure 58:
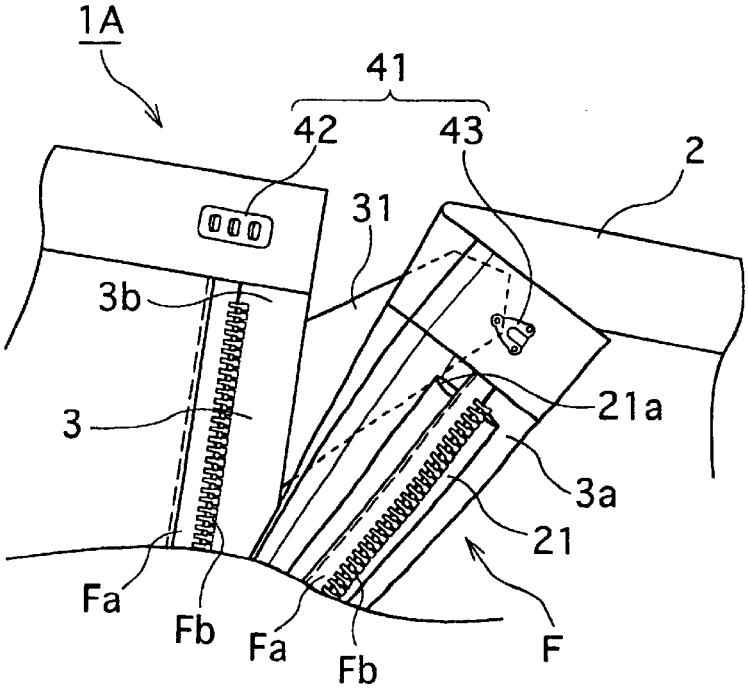
FIG. 58 is an explanatory drawing showing a major part of a garment having a waist-adjusting mechanism according to a seventeenth embodiment of the invention.

A seventeenth embodiment is described hereafter. FIG. 58 is an explanatory drawing showing a major part of a garment having a waist-adjusting mechanism according to a seventeenth embodiment of the invention.

As shown in FIG. 58, a seventeenth embodiment of waist adjustable garment substitutes a hook assembly 41 having plural hooking positions for the hook assembly 11 as the joint tool of the pants 1A of the thirteenth embodiment. The hook assembly as the joint tool in the present embodiment is composed of a socket 42 and a hook 43. The socket 42 is fixed on the upper portion of the inner cloth 3*b* so as to be lined along the waist belt 2. The hook 43 is secured to the upper part of the outer cloth 3*a* and caught on each of the plural socket holes of the socket 42 that are located in different positions. Thus, the hook assembly 41 joins the waist belt 2 of the pants 1. The hook assembly 41 constitutes a joint tool that not only joins the upper ends of the front center opening 3 of the pants 1 in a separable way but also adjusts the waist size of the waist belt 2 in a fixed range. Therefore, the upper ends of the front center opening 3 can be joined by the hook assembly 41 in an adjusted state so as to make the waist size of the pants 1 fit to the waist size of the user.

The hook assembly 41 of the seventeenth embodiment of the waist adjustable pants may be used for the waist adjustable garment according to the fourteenth to sixteenth embodiments. The seventeenth embodiment has substantially the same structure in the other elements and substantially the same function and effects as the thirteenth embodiment of the pants.

EIGHTEENTH EMBODIMENT

Figure 59:
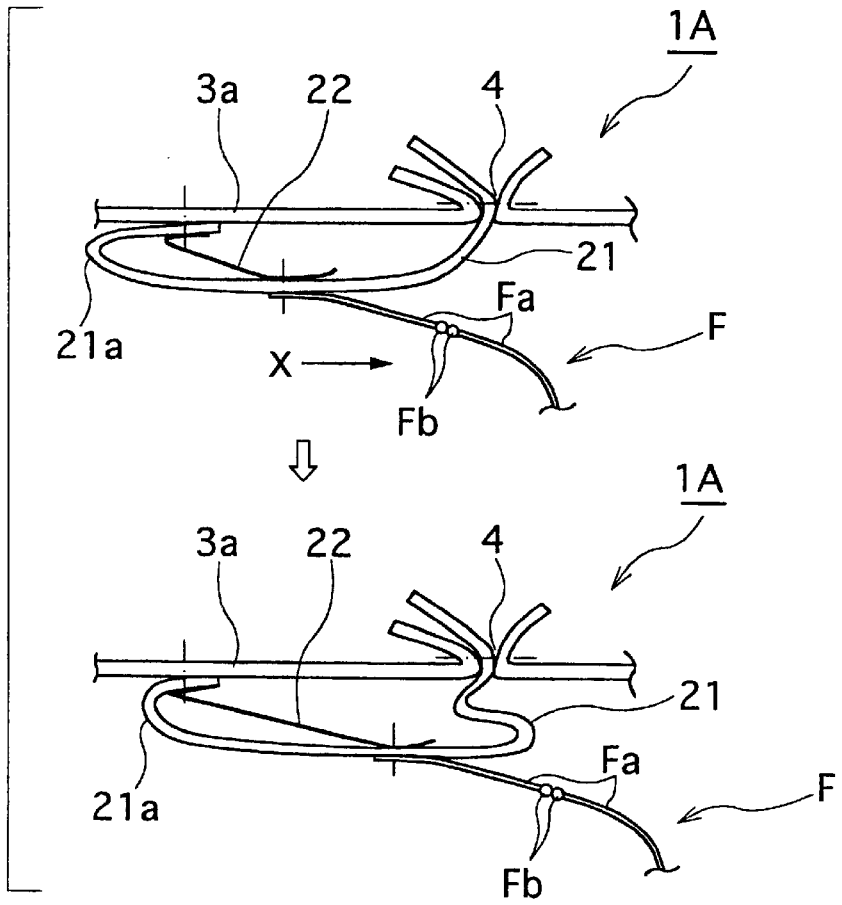
FIG. 59 is an explanatory drawing showing a structure of an adjusting cloth of a garment having a waist-adjusting mechanism according to an eighteenth embodiment of the invention.
Figure 60:
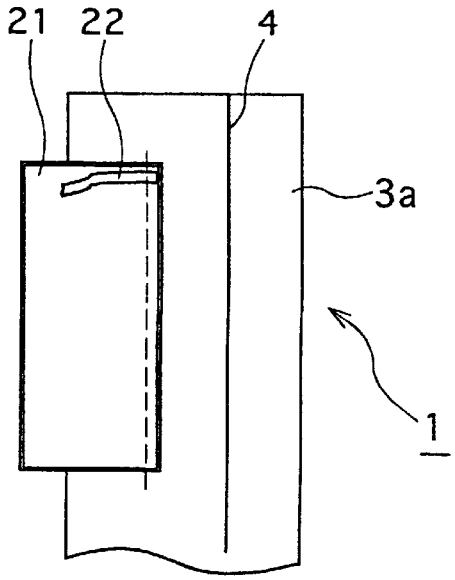
FIG. 60 is an explanatory drawing showing a step of sewing the adjusting cloth of the garment having the waist-adjusting mechanism according to the eighteenth embodiment of the invention.
Figure 61:
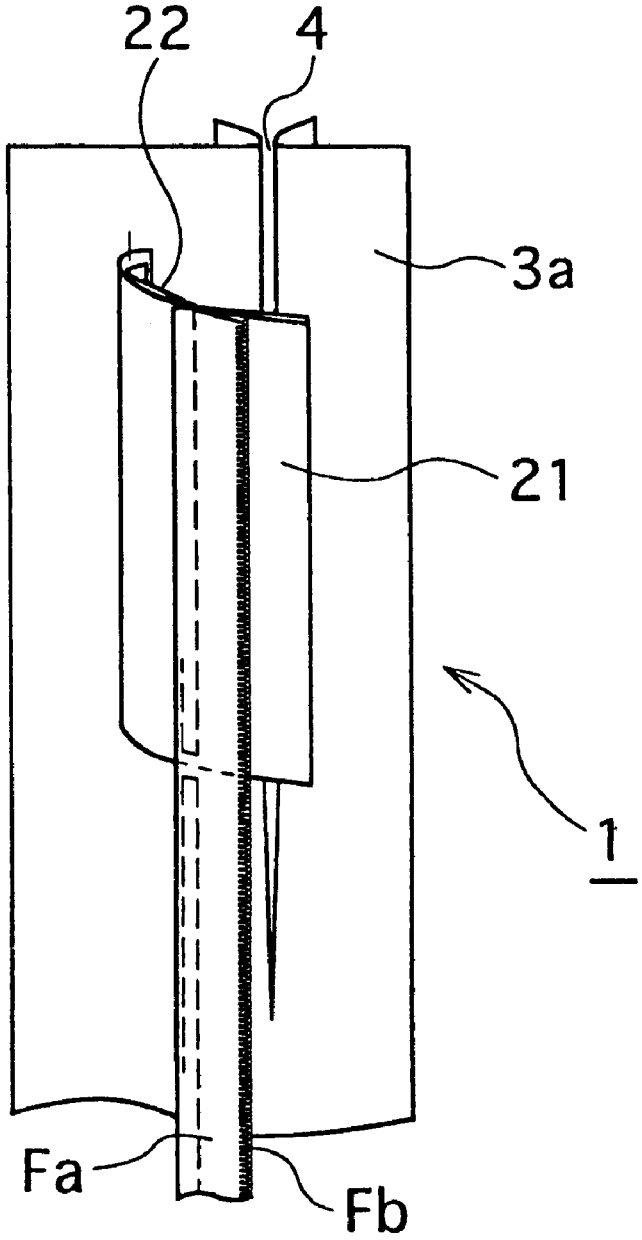
FIG. 61 is an explanatory drawing showing a step, next to the step of FIG. 60, of sewing the adjusting cloth of the garment having the waist-adjusting mechanism according to the eighteenth embodiment of the invention.
Figure 62:
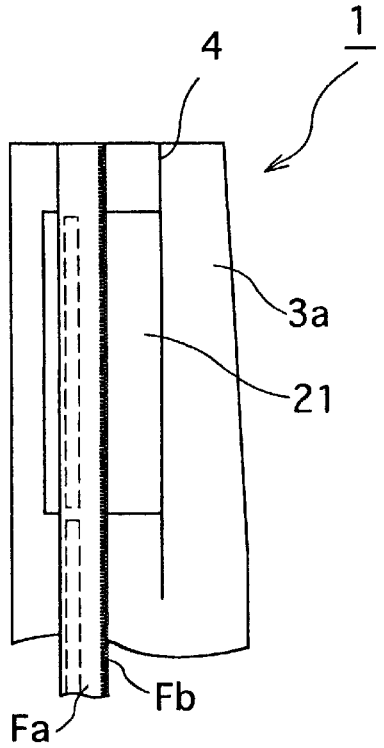
FIG. 62 is an explanatory drawing showing a step, next to the step of FIG. 61, of sewing the adjusting cloth of the garment having the waist-adjusting mechanism according to the eighteenth embodiment of the invention.
Figure 63:
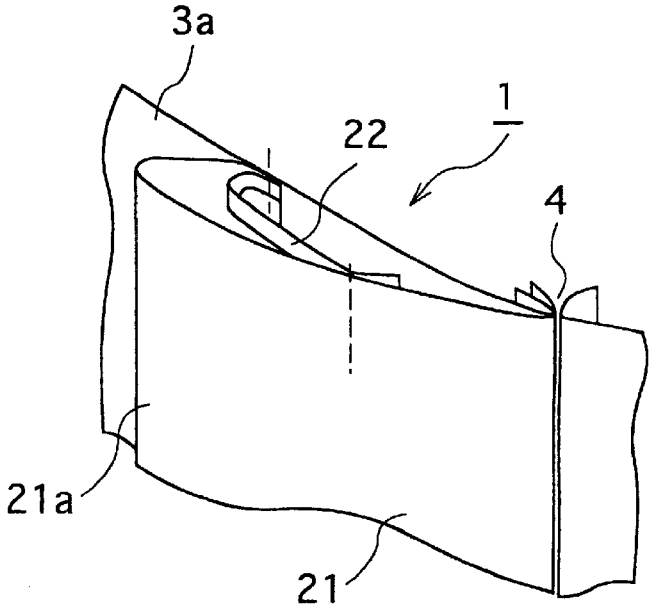
FIG. 63 is an explanatory drawing showing a step, next to the step of FIG. 62, of sewing the adjusting cloth of the garment having the waist-adjusting mechanism according to t he eighteenth embodiment of the invention.

An eighteenth embodiment is described hereafter. FIG. 59 is an explanatory drawing showing a structure of an adjusting cloth of a garment having a waist-adjusting mechanism according to an eighteenth embodiment of the invention. FIG. 60 is an explanatory drawing showing a step of sewing the adjusting cloth of the garment having the waist-adjusting mechanism according to the eighteenth embodiment of the invention. FIG. 61 is an explanatory drawing showing a step, next to the step of FIG. 60, of sewing the adjusting cloth of the garment having the waist-adjusting mechanism according to the eighteenth embodiment of the invention. FIG. 62 is an explanatory drawing showing a step, next to the step of FIG. 61, of sewing the adjusting cloth of the garment having the waist-adjusting mechanism according to the eighteenth embodiment of the invention. FIG. 63 is an explanatory drawing showing a step, next to the step of FIG. 62, of sewing the adjusting cloth of the garment having the waist-adjusting mechanism according to the eighteenth embodiment of the invention.

As shown in FIG. 59 to FIG. 63, a waist adjustable garment according to the eighteenth embodiment provides the rubber band 22 as the shape keeper on the thirteenth embodiment of the pants 1, for the purpose of urging the overlap 21*a* of the adjusting cloth 21 so as to be closed or folded, as shown in the twelfth embodiment.

Specifically, the other end of the rubber band 22 is stitched to the stitching position of the fastener tape Fa in steps of FIG. 60 to FIG. 63, as shown in the twelfth embodiment.

The eighteenth embodiment has substantially the same function and effects as the twelfth embodiment. The rubber band 22 may be provided not only on the present embodiment but also on each waist adjustable garment according to the fourteenth to seventeenth embodiments. The shape keeper may be embodied by weaving fibers of a shape memory alloy into the adjusting cloth 21, for example.

In conclusion, the waist size of the pants 1 can be adjusted so as to fit the waist size of the user at the upper end joining portions of the front center opening 3 by the joint tool made of the hook assembly 11 or 41, according to each of the thirteenth to eighteenth embodiments, thereby providing generally the same function and effects as the seventh to twelfth embodiments.

In the waist adjustable garments according to the thirteenth to eighteenth embodiments, the adjusting cloth 21 has a constant width, as in the seventh to twelfth embodiments. However, the invention may be embodied such that the adjusting cloth 21 has an upper end longer and a lower end shorter. Moreover, the adjusting cloth 21 is provided on the outer cloth 3*a* up to the area of about ⅓ to ½ of the length of the outer cloth 3*a* from the upper side to the lower side thereof. However, the upper end of the adjusting cloth 21 has much influence on the size adjustment, while the lower end thereof has less influence. Therefore, the adjusting cloth 21 may be eliminated at the lower part. Of course, it is not always necessary to eliminate the lower part.

NINETEENTH EMBODIMENT

Figure 64:
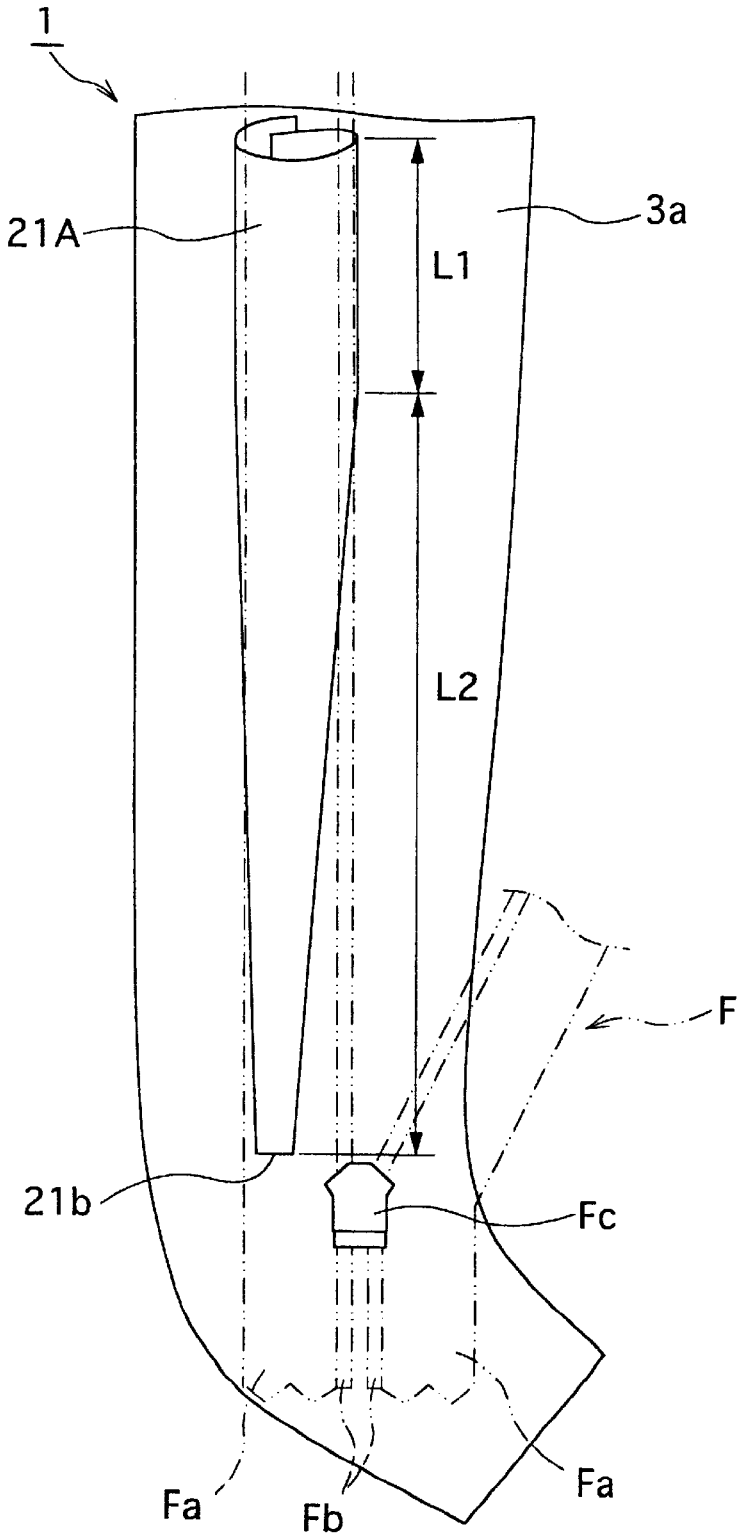
FIG. 64 is an explanatory drawing showing a structure of an adjusting cloth of a garment having a waist-adjusting mechanism according to a nineteenth embodiment of the invention.

A nineteenth embodiment is described hereafter. FIG. 64 is an explanatory drawing showing a structure of an adjusting cloth of a garment having a waist-adjusting mechanism according to a nineteenth embodiment of the invention.

As shown in FIG. 64, the nineteenth embodiment of waist adjustable garment modifies the seventh embodiment of the pants 1 so that a width of an adjusting cloth 21A is constant from an upper end by a length L1. The width becomes smaller in a section of a length L2 from there to a lower end 21*b*.

In the seventh embodiment of the pants 1, the width of the adjusting cloth 21 is constant up to the lower end, as shown in FIG. 23 to FIG. 25. The fastener tape Fa is sewed on the adjusting cloth 21 and directly on the outer cloth 3*a* at a section where the adjusting cloth 21 is not provided. Since the width of the adjusting cloth 21 is constant, there may be generated a step or irregularity at the lower end of the adjusting cloth 21 between a portion where the fastener tape Fa is movable and a portion where it is immovably fixed, thereby causing a distortion thereat. In this case, it is possible that wrinkles are generated or that the user has a strange feeling at such part, when the adjusting cloth 21 changes its shape.

In contrast, the nineteenth embodiment of the waist adjustable garment has the width of the adjusting cloth 21A becoming gradually narrower over the section of the length L2 from the position lower than the upper end by the length L1. Thus, the width of the adjusting cloth 21A is much smaller at the lower end 21*b* than at the upper end. Consequently, substantially no step or irregularity is generated on the fastener tape Fa at the lower end 21*b* of the adjusting cloth 21A, thereby solving the problem of the distortion and preventing disadvantages such as the wrinkles or the strange feeling of the user.

The nineteenth embodiment may set at desired values the length L1 of the section in which the width of the adjusting cloth 21A is constant, the length L2 of the section in which the width decreases downward, a length L1+L2 of the adjusting cloth 21A and the width of the lower end 21*b*. Moreover, it may be structured such that the adjusting cloth 21A becomes narrower from the upper end by setting the length L1=0. Alternatively, the width of the lower end 21*b* may be set at zero so that the adjusting cloth 21A has its width decrease gradually up to a pointed lower end.

The nineteenth embodiment is described as an example in which the seventh embodiment is modified such that the adjusting cloth 21 changes the width. Similarly, the width of the adjusting cloth 21 may be changed also in the waist adjustable garment according to the eighth to eighteenth embodiments. The nineteenth embodiment has substantially the same structure in the other elements and exhibits substantially the same function and effects as the seventh embodiment of the pants 1.

TWENTIETH EMBODIMENT

Figure 65:
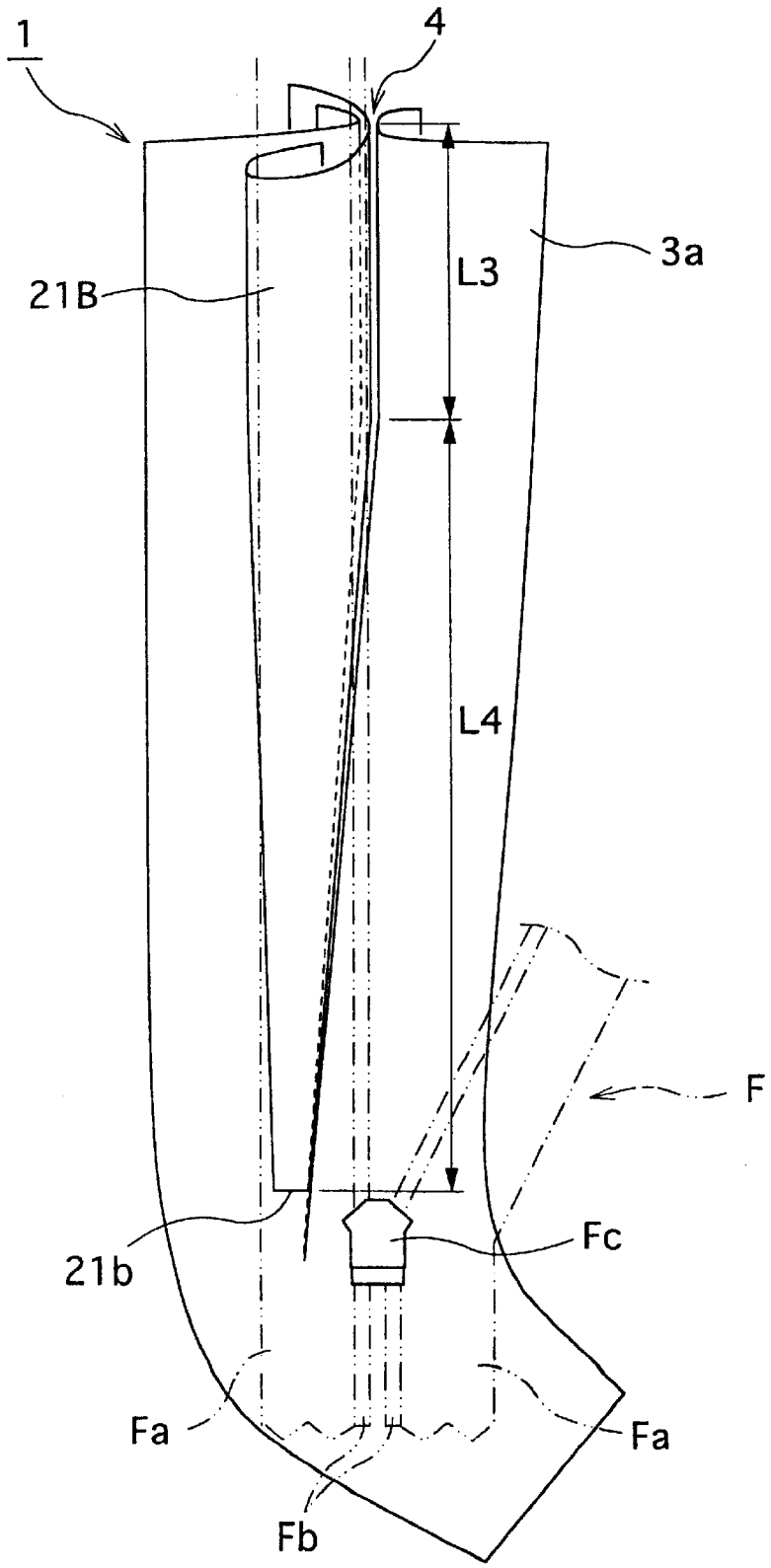
FIG. 65 is an explanatory drawing showing a structure of an adjusting cloth of a garment having a waist-adjusting mechanism according to a twentieth embodiment of the invention.

A twentieth embodiment is described hereafter. FIG. 65 is an explanatory drawing showing a structure of an adjusting cloth of a garment having a waist-adjusting mechanism according to a twentieth embodiment of the invention.

As shown in FIG. 65, the twentieth embodiment of waist adjustable garment modifies the seventh embodiment of the pants 1 so that a width of an adjusting cloth 21B is constant from an upper end by a length L3. The width becomes smaller in a section of a length L4 from there to a lower end 21*b*. Moreover, a slit 4 is vertically formed on a stitching position of the outer cloth 3*a*, on which a lateral end portion of the adjusting cloth 21B located nearer to the edge of the outer cloth 3*a* is stitched. The slit 4 has a shape corresponding to the change of the width of the adjusting cloth 21B. The one lateral end portion of the adjusting cloth 21B is inserted into the slit 4 and stitched from the rear side.

Consequently, the twentieth embodiment of the waist adjustable garment has the width of the adjusting cloth 21B becoming gradually narrower over the section of the length L4 from the position lower than the upper end by the length L3. Thus, the width of the adjusting cloth 21B is much smaller at the lower end 21*b* than at the upper end. Consequently, substantially no step or irregularity is generated on the fastener tape Fa at the lower end 21*b* of the adjusting cloth 21B, thereby solving the problem of the distortion and preventing disadvantages such as the wrinkles or the strange feeling of the user.

In addition, the end portion of the adjusting cloth 21B is inserted in the slit 4 so that the stitched part is hidden thereby. Moreover, there is no strange feeling when touched and its appearance improves.

The twentieth embodiment may set at desired values the length L3 of the section in which the width of the adjusting cloth 21B is constant, the length L4 of the section in which the width decreases downward, a length L3+L4 of the adjusting cloth 21B and the width of the lower end 21*b*. Moreover, it may be structured such that the adjusting cloth 21B becomes narrower from the upper end by setting the length L3=0. Alternatively, the width of the lower end 21*b* may be set at zero so that the adjusting cloth 21 has its width decrease gradually up to a pointed lower end.

The twentieth embodiment has substantially the same structure in the other elements and exhibits substantially the same function and effects as the seventh embodiment of the pants 1.

TWENTY-FIRST EMBODIMENT

Figure 66:
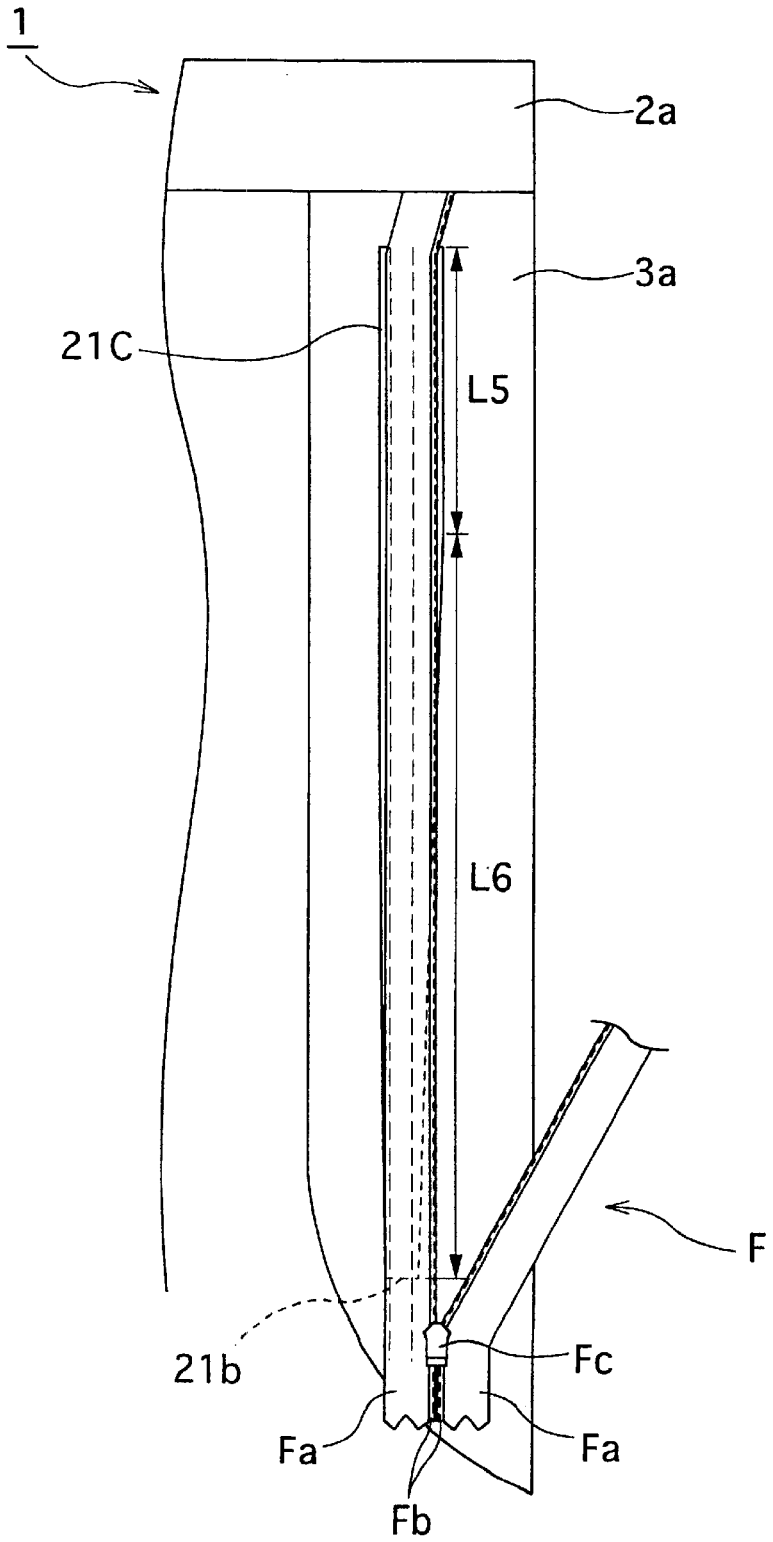
FIG. 66 is an explanatory drawing showing an example of sewing a zip fastener and an adjusting cloth on a garment having a waist-adjusting mechanism according to a twenty-first embodiment of the invention.

A twenty-first embodiment is described hereafter. FIG. 66 is an explanatory drawing showing an example of sewing a zip fastener and an adjusting cloth on a garment having a waist-adjusting mechanism according to a twenty-first embodiment of the invention.

As shown in FIG. 66, the twenty-first embodiment of waist adjustable garment modifies the seventh embodiment of the pants 1 so that a width of an adjusting cloth 21C is constant from an upper end by a length L5. The width becomes smaller in a section of a length L6 from there to a lower end 21*b*. The length (L5+L6) of the adjusting cloth 21C is set longer than the above nineteenth and twentieth embodiments. The lower end 21*b* reaches near the lower end of the outer cloth 3*a*. Then, the length L6 of the section where the width of the adjusting cloth 21C becomes narrow. Therefore, the width of the adjusting cloth 21C varies very gently.

Thus, the twenty-first embodiment of the waist adjustable garment makes the width of the adjusting cloth 21C much smaller at the lower end 21*b* than at the upper end, while keeping the width change of the adjusting cloth 21B very gentle. Consequently, substantially no step or irregularity is generated on the fastener tape Fa at the lower end 21*b* of the adjusting cloth 21C without affecting continuity of the shape change of the adjusting cloth 21C. Thereby, the problem of the distortion can be solved, and disadvantages such as the wrinkles or the strange feeling of the user can be prevented.

The twenty-first embodiment may eliminate the section of the constant width from the adjusting cloth 21C so that the width becomes narrower from the upper end. Alternatively, the width of the lower end 21*b* may be set at zero so that the adjusting cloth 21C has its width decrease gradually up to a pointed lower end.

The twenty-first embodiment has substantially the same structure in the other elements and exhibits substantially the same function and effects as the seventh embodiment of the pants 1.

TWENTY-SECOND EMBODIMENT

Figure 67:
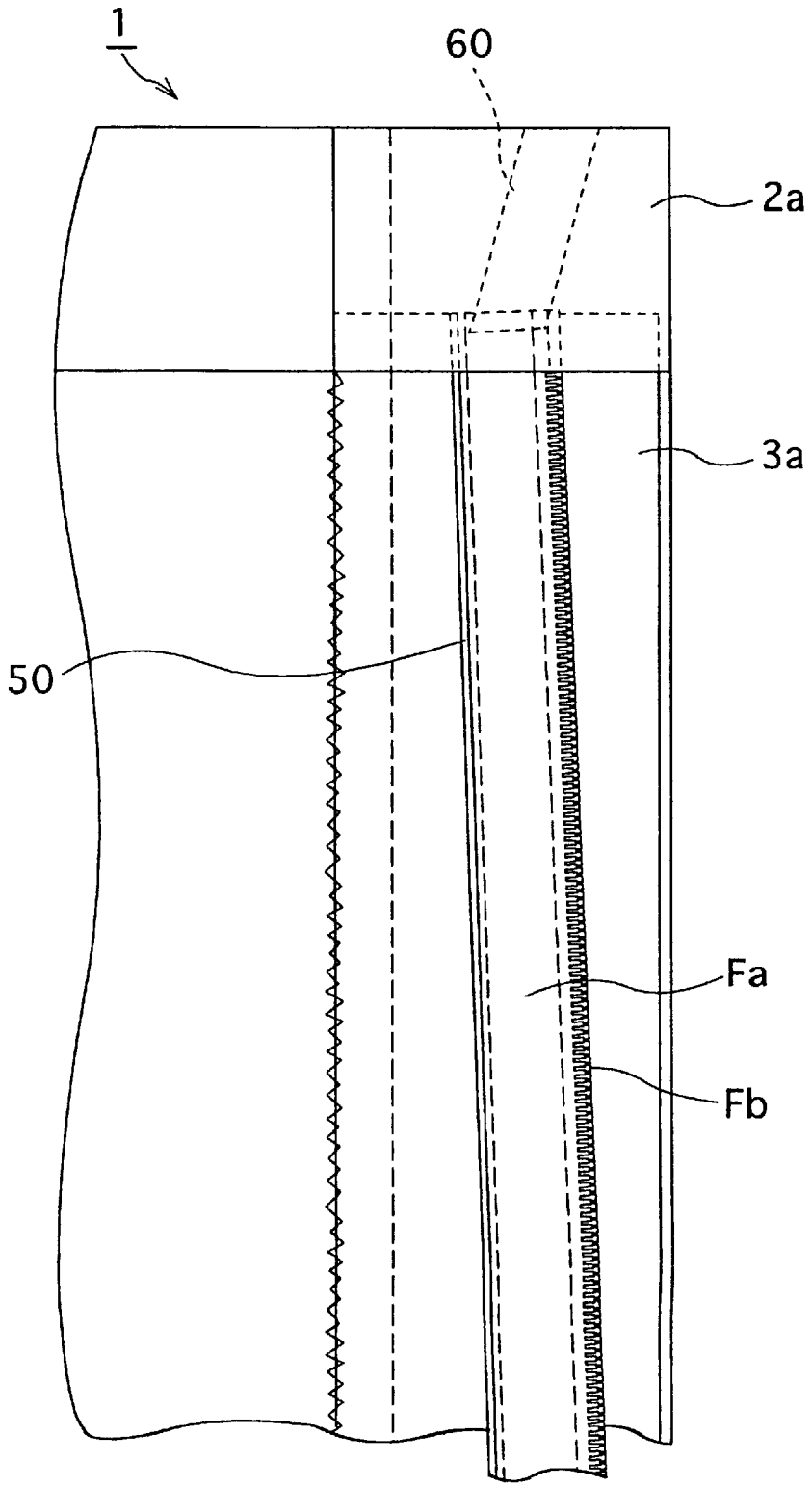
FIG. 67 is an explanatory drawing showing a structure of a garment having a waist-adjusting mechanism according to a twenty-second embodiment of the invention.
Figure 68:
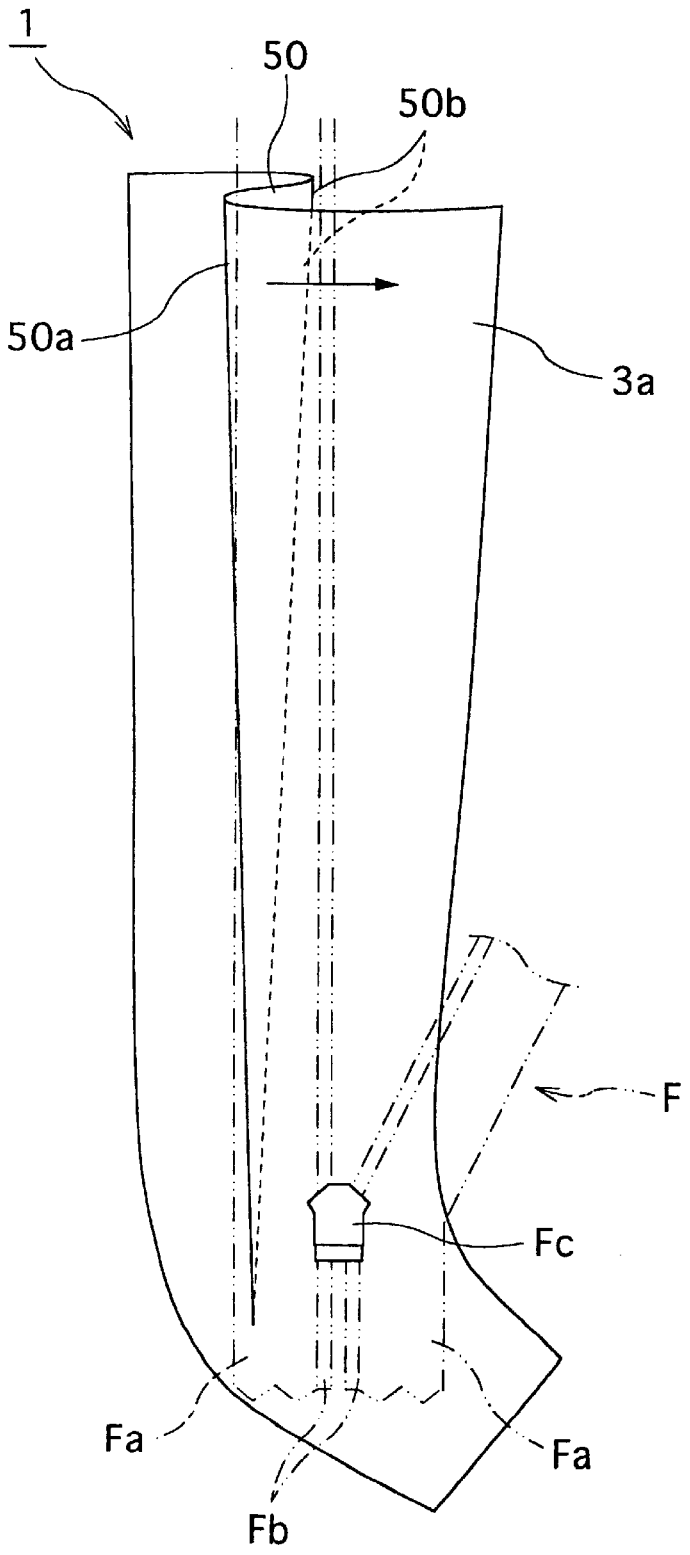
FIG. 68 is a perspective view showing a structure of a tuck of the garment having the waist-adjusting mechanism according to the twenty-second embodiment of the invention.

A twenty-second embodiment is described hereafter. FIG. 67 is an explanatory drawing showing a structure of a garment having a waist-adjusting mechanism according to a twenty-second embodiment of the invention. FIG. 68 is a perspective view showing a structure of a tuck of the garment having the waist-adjusting mechanism according to the twenty-second embodiment of the invention. FIG. 67 is depicted while eliminating the hook element 100A fitted on the belt lining 2*a*.

As shown in FIG. 67, the twenty-second embodiment of waist adjustable garment modifies the seventh embodiment of the pants 1 such that the outer cloth 3*a* has a tuck 50 vertically provided in place of the adjusting cloth 21 stitched thereto. The fastener Fa is stitched to the tuck 50.

As shown in FIG. 68, the tuck 50 is made by folding a portion of the outer cloth 3*a* into an outer folded part 50*a* and an inner folded part 50*b*. Then, an overlap is produced from the folded part 50*a* to the folded part 50*b*. The overlap is extended so as to allow the tuck to change its shape in such a range as the hook assembly adjusts the waist size of the pants 1. The overlap has the largest width at the upper end of the tuck 50 and lessens the width and disappears at the lower end.

As shown in FIG. 68, one of the fastener tape Fa is stitched to the outer cloth 3*a* at the upper side of the overlap of the tuck 50. The other fastener tape Fa, which has worms geared with worms Fb lined along the one fastener tape Fa, is stitched to an inner cloth 3*b* not shown. The front center opening of the pants 1 is openable by moving up and down a slider Fc that joins those two fastener tapes Fa by meshing the worms Fb of the fastener tapes Fa, respectively.

As shown in FIG. 67, the upper end of the one fastener tape Fa is stitched to the upper end of the outer cloth 3*a* via a sliding tape 60 inside the belt lining 2*a*. The sliding tape 60 is held and stitched inside the belt lining 2*a* at an inclination outwardly toward the edge of the outer cloth 3*a*.

Thus, the portion of the fastener tape Fa sewed on the tuck 50 can be pulled and moved outwardly of the edge of the outer cloth 3*a* as shown by an arrow in FIG. 68, within a range of the extra length by the overlap. Therefore, if the tuck 50 is pulled outwardly of the edge of the outer cloth 3*a* via the fastener tape Fa, the overlap of the tuck 50 is stretched. Then, the fastener tape Fa can be moved outwardly of the edge of the outer cloth 3*a*. Moreover, the sliding tape 60 is held and sewed inside the belt lining 2*a* while slanted outwardly of the edge of the outer cloth 3*a*. Thus, when the portion of the fastener tape Fa stitched to the tuck 50 moves outwardly from the edge of the outer cloth 3*a*, the fastener tape Fa moves in such a direction as to make a room. Consequently, it is never hindered from moving.

If an external force is applied in such a direction as to widen the waist belt of the pants 1 while the front center opening is closed by moving up the slide Fc of the zip fastener F, the tuck 50 permits the waist size of the pants 1 to become longer within such a length as to stretch the overlap of the tuck 50 at an area where the tuck 50 is formed under the fastener tape Fa. Then, the lower portion of the waist belt becomes longer, too.

The twenty-second embodiment of the pants 1 are provided with the buttonhole piece 31 having the buttonhole 3lax as shown in FIG. 27, too.

As described above, the twenty-second embodiment has generally the same function and effects as the seventh embodiment.

Specifically, if an external force is applied in such a direction as to enlarge the size of the waist belt 2 of the pants 1, the size of the waist belt 2 can be prolonged at the joined portion by the hook assembly 100 located at the upper ends of the front center opening. Moreover, at the area from the upper part to a predetermined part downward of the front center opening (area where the tuck 50 is provided under the fastener tape Fa), the waist size of the pants 1 can be prolonged within an extendible length of the overlap of the tuck 50.

The upper end of the fastener tape Fa is held and sewed inside the belt lining 2*a* while slanted outwardly of the edge of the outer cloth 3*a* via the sliding tape 60. Therefore, the upper end of the fastener tape Fa and the portion of the fastener tape Fa stitched to the tuck 50 can move outwardly from the edge of the outer cloth 3*a*. Thus, a section where the waist size of the pants 1 is adjustable is completely continuous from the upper end of the pants 1 downward to the portion of the tuck 50. Therefore, it is possible to lessen more a tight feeling of the user when he or she puts on the pants 1 and decrease an influence on the appearance by a periphery of the front center opening being pulled or wrinkled.

Specifically, if the size of the waist belt 2 of the user becomes large, the size of the portion around the waist becomes large accordingly. Consequently, it is impossible to get rid of the tight feeling if a room is provided only on the waist belt. With the pants 1 of the twenty-second embodiment, the waist belt 2 of each part of the pants 1 becomes large according not only to a change of the waist size of the user but also to a change of a size of a portion around the waist. Thus, the user has no tight feeling. Moreover, it also prevents the peripheral part of the front center opening from being pulled or wrinkled due to shortage of the waist size of the pants, thereby improving the appearance thereof.

In addition, the twenty-second embodiment of the pants 1 does not need any fitting work of the adjusting cloth 21 as in the seventh to the twenty-first embodiments. The same advantageous effects are obtained only by folding the outer cloth of the garment in the vertical direction so as to fabricate the tuck. Consequently, the structure becomes simple and manufacturing steps are reduced. As a result, it is possible to produce the waist adjustable garment in shorter time of delivery and at lower costs.

The hook assembly 100 according to each of the first to sixth embodiments can be used as the joint tool of the twenty-second embodiment for joining the garment in a separable manner and adjust the waist size in a fixed range. Alternatively, a variety of waist adjustable joint tools can be used such as the hook assembly 11 of the thirteenth embodiment or the hook assembly 41 of the fourteenth embodiment.

A material of the sliding tape 60 may be made of a cotton tape, a satin tape, an elastic material such as rubber, spandex, stretch tape (rubber contained cloth tape) and other materials.

In the twenty-second embodiment, the upper end of the fastener tape Fa is held and sewed inside the belt lining 2*a* via the sliding tape 60 at an inclination toward the outside of the edge of the outer cloth 3*a*. Alternatively, the upper end of the fastener tape Fa may be held and sewed inside the belt lining 2*a* at an inclination toward the outside of the edge of the outer cloth 3*a* as shown in FIG. 66 and so on.

Thereby, the same effects are obtained without the sliding tape 60 that the upper end of the fastener tape Fa does not hinder the stitched portion of the fastener tape Fa to the tuck 50 from moving toward the outside beyond the edge of the outer cloth 3*a*.

In the twenty-second embodiment, the fastener tape Fa is sewed only on an outermost cloth of the portion of the outer cloth 3*a* that defines the tuck 50. The outer folded part 50*a* is not stitched along its crease. Alternatively, the fastener tape Fa may be sewed on the outer cloth 3*a* such that the outer folded part 50*a* is stitched along the crease by the left stitch in FIG. 67. Thus, the crease of the outer folded part 50*a* is strongly retained. Consequently, even if the fastener tape Fa is pulled in the direction toward the edge of the outer cloth 3*a* and the overlap of the tuck 50 is extended, the crease of the outer folded part 50*a* is not loosened but kept in a good appearance. Then, when the pulling force on the fastener tape Fa is released, the tuck 50 immediately returns to its original shape.

TWENTY-THIRD EMBODIMENT

Figure 69:
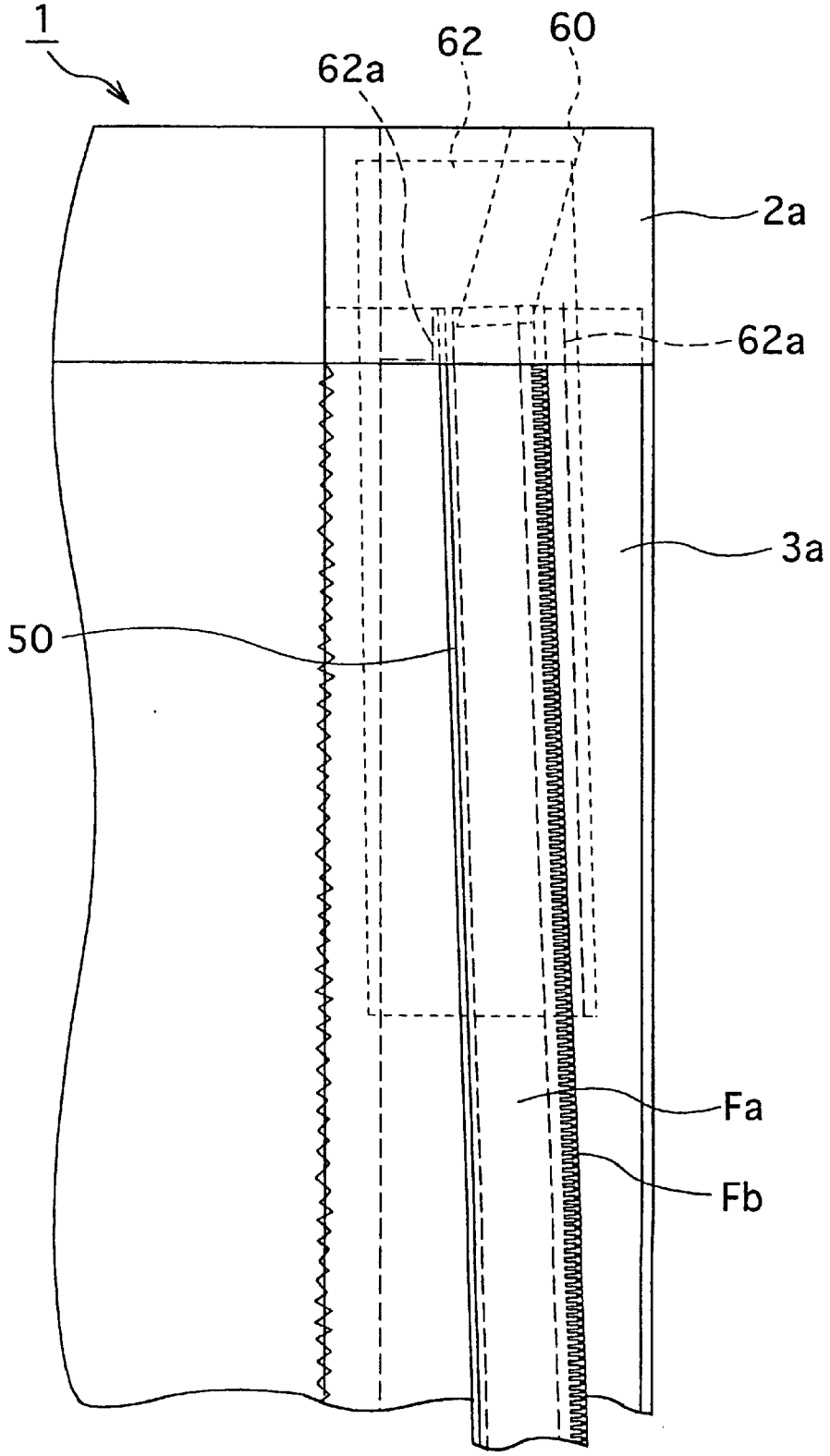
FIG. 69 is an explanatory drawing showing a structure of a garment having a waist-adjusting mechanism according to a twenty-third embodiment of the invention.

A twenty-third embodiment is described hereafter. FIG. 69 is an explanatory drawing showing a structure of a garment having a waist-adjusting mechanism according to a twenty-third embodiment of the invention. FIG. 69 is depicted while eliminating the hook element 100A fitted on the belt lining 2*a*.

As shown in FIG. 69, the twenty-third embodiment of waist adjustable garment modifies the twenty-second embodiment of the pants 1 such that a lining 62 is sewed by stitches 62*a* at the right and the left of the tuck 50 on the rear side of the outer cloth 3*a* so as to be provided on an area wider than the tuck 50.

If the fastener tape Fa is pulled toward the edge of the outer cloth 3*a* in adjusting the waist size so as to extend the overlap of the tuck 50, a tensile (pulling) force is applied to the lining 62 sewed at the right and the left of the tuck 50 by the stitched 62*a*. Then, the lining 62 generates an urging force to return the tuck 50 to its original state. Thus, the tuck 50 changes its shape while receiving a fixed urging force all the time. Therefore, there is generated no "blowoff" that the inner folded part 50*b* of the tuck 50 gets out to the side of the fastener. Moreover, the front side (a surface opposite to a surface on which the fastener tape Fa is sewed) is prevented from wrinkles due to the blowoff, thereby keeping the appearance good. Furthermore, there is generated an urging force to get the tuck return to the original state, so that the overlap of the tuck 50 is prevented from being left open unintentionally. consequently, there is no such situation that the size of the portion under and around the waist belt of the pants 1 becomes too long and loose thereby to produce wrinkles thereat.

In the twenty-third embodiment, the fastener tape Fa is sewed only on an outermost cloth of the portion of the outer cloth 3*a* that defines the tuck 50. The outer folded part 50*a* is not stitched along its crease. Alternatively, the fastener tape Fa may be sewed on the outer cloth 3*a* such that the outer folded part 50*a* is stitched along the crease by the left stitch in FIG. 69. Thus, the crease of the outer folded part 50*a* is strongly retained. Consequently, even if the fastener tape Fa is pulled in the direction toward the edge of the outer cloth 3*a* and the overlap of the tuck 50 is extended, the crease of the outer folded part 50*a* is not loosened but kept in a good appearance. Then, when the pulling force on the fastener tape Fa is released, the tuck 50 immediately returns to its original shape.

TWENTY-FOURTH EMBODIMENT

A twenty-fourth embodiment is described hereafter.

In the twenty-fourth embodiment of waist adjustable garment modifies the twenty-second embodiment of the pants I such that the folded part of the outer cloth 3*a* is stuck by an adhesive double coated tape to the rear side of the outer cloth 3*a* near the tuck 50. Specifically, if the waist adjustable range of the hook assembly is 3 cm, the folded part of the outer cloth 3*a* is stuck by the adhesive double coated tape to the rear side of the outer cloth 3*a* in a vertical direction at a portion which is about 1.5 cm distant from the edge of the outer cloth 3*a*.

If the fastener tape Fa is pulled toward the edge of the outer cloth 3*a* in adjusting the waist size so as to extend the overlap of the tuck 50, a tensile force is applied to the stuck portion. Then, an urging force is produced to return the tuck 50 to its original state. Thus, the tuck 50 changes its-shape while receiving a fixed urging force all the time. Therefore, there is generated no "blowoff" that the inner folded part 50*b* of the tuck 50 gets out to the side of the fastener. Moreover, the front surface is prevented from wrinkles due to the blowoff, thereby keeping the appearance good. Furthermore, there is generated an urging force to get the tuck return to the original state, so that the overlap of the tuck 50 is prevented from being left open unintentionally. Consequently, there is no such situation that the size of the portion under and around the waist belt of the pants 1 becomes too long and loose thereby to produce wrinkles thereat.

TWENTY-FIFTH EMBODIMENT

A twenty-fifth embodiment is described hereafter.

In the twenty-fifth embodiment of waist adjustable garment modifies the twenty-second embodiment of the pants 1 such that the outer cloth 3*a* is sewed in a vertical direction on a portion between the edge of the outer cloth 3*a* and the tuck 50. Specifically, a stitch is formed vertically at a portion which is about 1.5 cm distant from the edge of the outer cloth 3*a* so as to go through it from the front side of the outer cloth 3*a* to the rear side or a surface on which the fastener tape Fa is sewed.

If the fastener tape Fa is pulled toward the edge of the outer cloth 3*a* in adjusting the waist size so as to extend the overlap of the tuck 50, a tensile force is applied to the stitched portion. Then, an urging force is produced to return the tuck 50 to its original state. Thus, the tuck 50 changes its shape while receiving a fixed urging force all the time. Therefore, there is generated no "blowoff" that the inner folded part 50*b* of the tuck 50 gets out to the side of the fastener. Moreover, the front surface is prevented from wrinkles due to the blowoff, thereby keeping the appearance good. Furthermore, there is generated an urging force to get the tuck return to the original state, so that the overlap of the tuck 50 is prevented from being left open unintentionally. Consequently, there is no such situation that the size of the portion under and around the waist belt of the pants 1 becomes too long and loose thereby to produce wrinkles thereat.

Each of the twenty-third to the twenty fifth embodiments has generally the same structure in the other elements as that of the seventh embodiment of the pants 1 and exhibits generally the same function and effects as the seventh embodiment of the pants 1.

TWENTY-SIXTH EMBODIMENT

Figure 70:
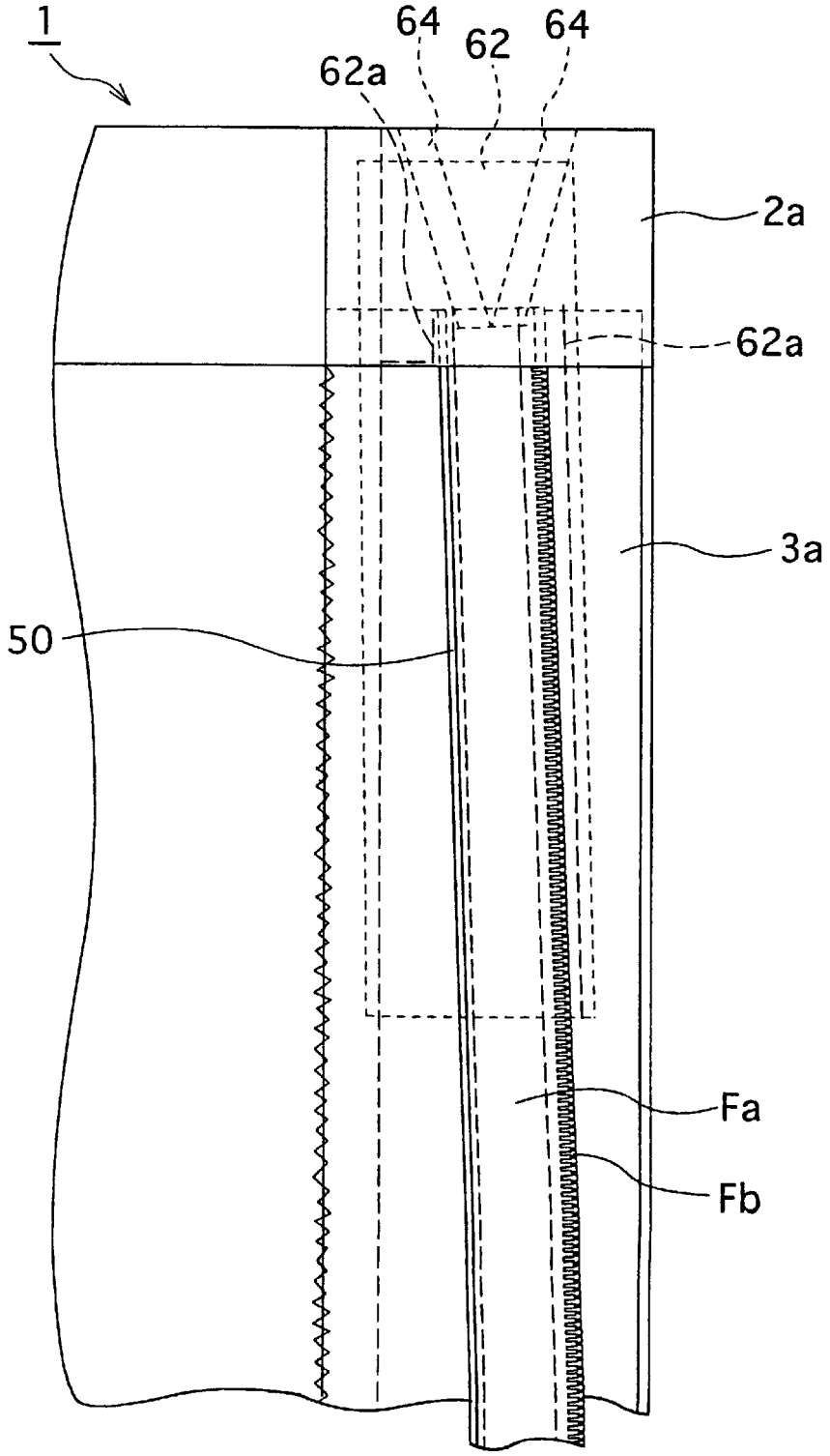
FIG. 70 is an explanatory drawing showing a structure of a garment having a waist-adjusting mechanism according to a twenty-sixth embodiment of the invention.

A twenty-sixth embodiment is described hereafter. FIG. 70 is an explanatory drawing showing a structure of a garment having a waist-adjusting mechanism according to a twenty-sixth embodiment of the invention. FIG. 70 is depicted while eliminating the hook element 100A fitted on the belt lining 2*a*.

As shown in FIG. 70, the twenty-sixth embodiment of waist adjustable garment modifies the twenty-third embodiment of the pants 1 with the lining 62 such that the upper end of the fastener tape Fa is sewed on the upper end of the outer cloth 3*a* via two stretch tapes 64 (rubber contained cloth tape) in place of the sliding tape 60. Those two stretch tapes 64 are stitched such that they form generally a V-shape with their upper ends distant.

If the fastener tape Fa is pulled either direction toward the right or left, either of those two stretch tapes 64 is expanded. Then, an urging force is produced to return the tuck 50 to its original state due to elastic force of the stretch tape 64. Thus, if the tensile force to the fastener tape Fa disappears, the fastener tape Fa quickly returns to the original position. Particularly, the fastener tape Fa does not move or slide smoothly if the cloth of the pants 1 has long pile or is thick, for example. According to the twenty-sixth embodiment, the fastener tape Fa can surely return to the original position even in such case.

While the twenty-sixth embodiment uses the stretch tapes 64 as two elastic tapes stitched substantially in a V-shape, the elastic tape may be made of another material such as rubber, spandex, etc.

The twenty-sixth embodiment has generally the same structure in the other elements as that of the twenty-third embodiment of the pants 1 and exhibits generally the same function and effects as the twenty-third embodiment of the pants 1.

Two elastic tapes of V-shape may be incorporated in the pants according to each of the twenty-second, the twenty-fourth and the twenty-fifth embodiments.

TWENTY-SEVENTH EMBODIMENT

Figure 71:
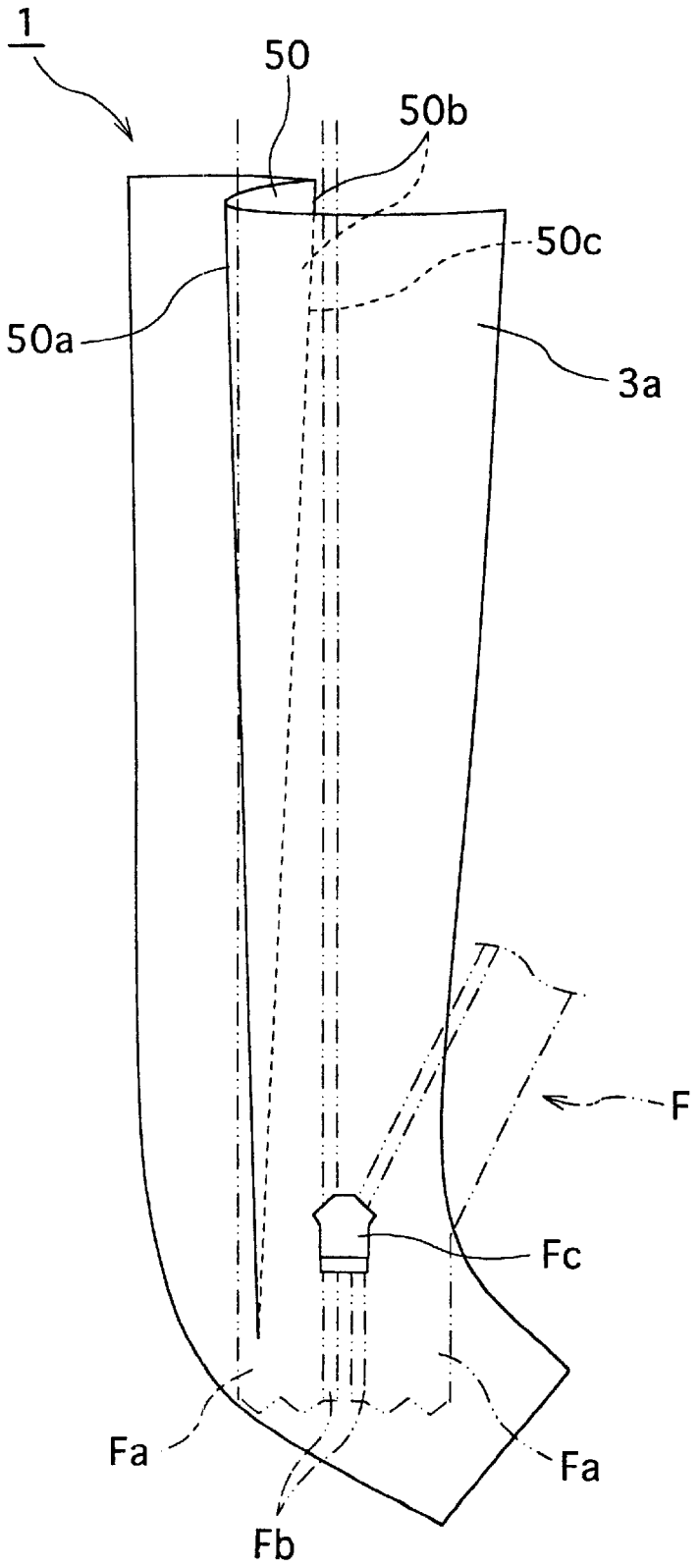
FIG. 71 is a perspective view showing a structure of a portion around a tuck of a garment having a waist-adjusting mechanism according to a twenty-seventh embodiment of the invention.

A twenty-seventh embodiment is described hereafter. FIG. 71 is a perspective view showing a structure of a portion around a tuck of a garment having a waist-adjusting mechanism according to a twenty-seventh embodiment of the invention.

As shown in FIG. 71, the twenty-seventh embodiment of waist adjustable garment modifies the twenty-second embodiment of the pants 1 such that the inner folded part 50*b* of the tuck 50 is pressed by an iron. Therefore, if the fastener tape Fa is pulled toward the edge of the outer cloth 3*a* so as to extend the overlap of the tuck 50, the crease 50*c* of the inner folded part 50*b* of the tuck 50 can be kept as it is without any slack. Thus, it is possible to prevent a disadvantage that the inner folded part 50*b* of the tuck 50 becomes slack and gets out.

The inner folded part 50*b* of the tuck 50 may be provided with pleating. The pleating makes firmer and stronger the crease 50*c* of the inner folded part 50*b* of the tuck 50. Consequently, if the fastener tape Fa is pulled toward the edge of the outer cloth 3*a* so as to extend the overlap of the tuck 50, the crease 50*c* of the inner folded part 50*b* of the tuck 50 can be kept as it is without any slack. Thus, it is possible to prevent a disadvantage that the inner folded part 50*b* of the tuck 50 becomes slack and gets out. Moreover, the pleating prevents the crease 50*c* from slacking after the pants 1 is washed or laundered, thereby maintaining its function and effects almost permanently.

TWENTY-EIGHTH EMBODIMENT

Figure 72:
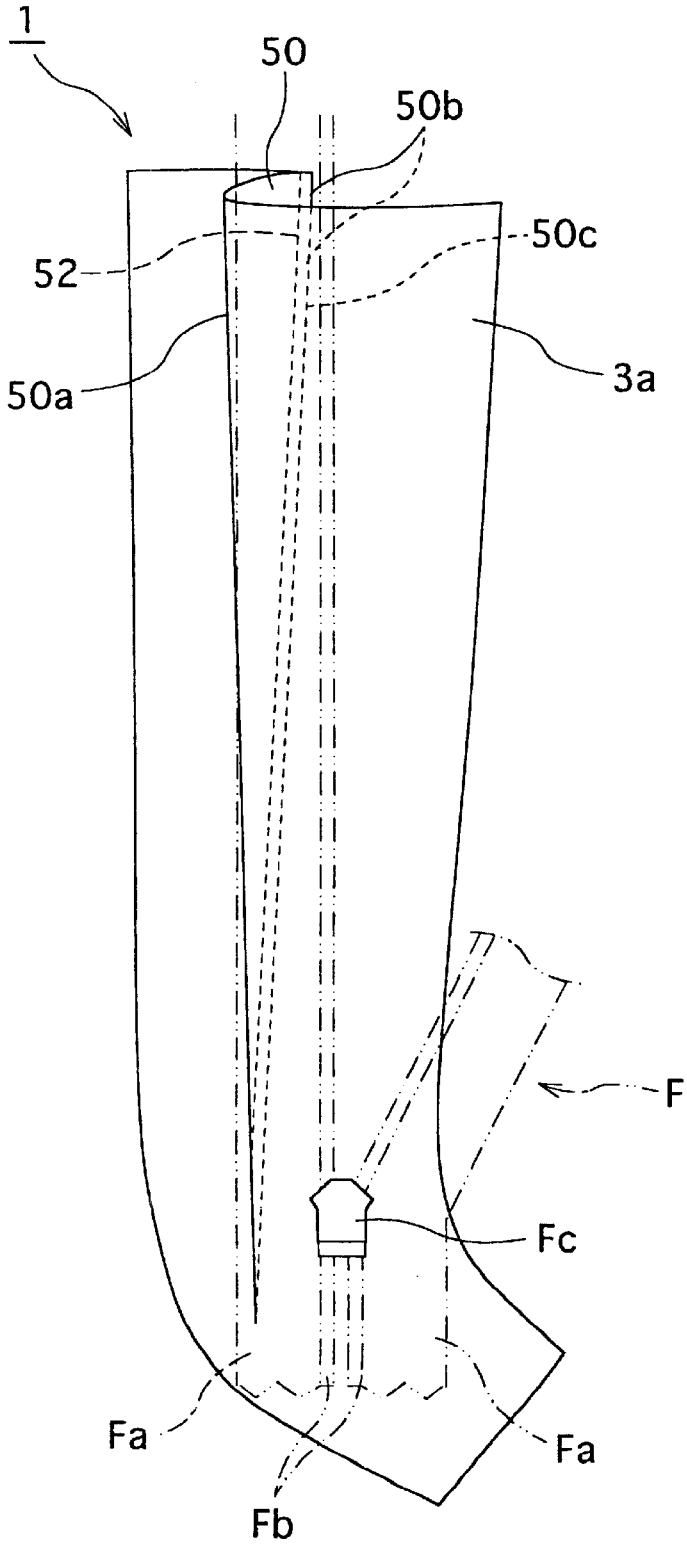
FIG. 72 is a perspective view showing a structure of a portion around a tuck of a garment having a waist-adjusting mechanism according to a twenty-eighth embodiment of the invention.

A twenty-eighth embodiment is described hereafter. FIG. 72 is a perspective view showing a structure of a portion around a tuck of a garment having a waist-adjusting mechanism according to a twenty-eighth embodiment of the invention.

As shown in FIG. 72, the twenty-eighth embodiment of waist adjustable garment modifies the twenty-second embodiment of the pants 1 such that the inner folded part 50*b* of the tuck 50 is sewed by a stitch 52 along the crease 50*c* near the crease 50*c*. Therefore, if the fastener tape Fa is pulled toward the edge of the outer cloth 3*a* so as to extend the overlap of the tuck 50, the crease 50*c* of the inner folded part 50*b* of the tuck 50 can be kept as it is without any slack. Thus, it is possible to prevent a disadvantage that the inner folded part 50*b* of the tuck 50 becomes slack and gets out.

It is preferable to locate the stitch 52 at a position 1 to 2 mm distant from the crease 50*c*. If the stitch 52 is provided too far from the crease, the area in which the shape is changeable due to the tuck 50 becomes small and not desirable in practical use.

While the stitch 52 is provided up to the lower end of the tuck 50 in the twenty-eighth embodiment, the stitch 52 may be formed on an area located from the upper end of the tuck 50 downward to a lower end by ¾ to ⅔ of the height of the tuck 50. Then, the stitch 52 is eliminated at the lower side. In this case, it is supposed that the same function and effects are obtained, too.

Each of the twenty-seventh and the twenty-eighth embodiments has generally the same structure in the other elements as that of the twenty-second embodiment of the pants 1 and exhibits generally the same function and effects as the twenty-second embodiment of the pants 1.

The pressing by the iron or the pleating in the twenty-seventh embodiment or the stitch 52 along the crease 50*c* may be applied to the pants 1 according to each of the twenty-third to the twenty-sixth embodiments.

TWENTY-NINTH EMBODIMENT

Figure 73:
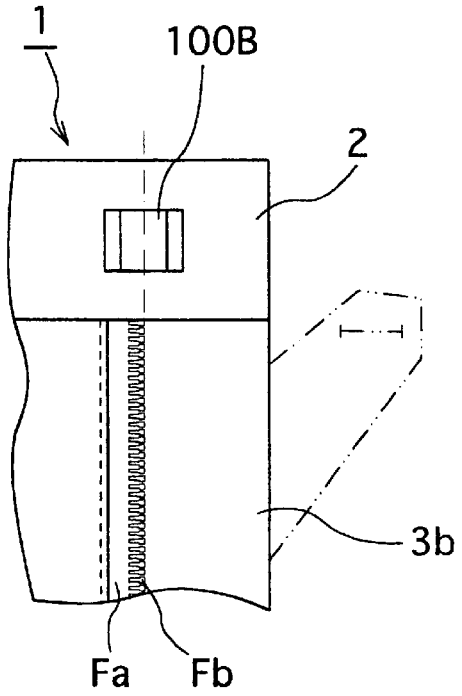
FIG. 73 is a front elevation showing a structure of a portion around an inner cloth of a garment having a waist-adjusting mechanism according to a twenty-ninth embodiment of the invention.

A twenty-ninth embodiment is described hereafter. FIG. 73 is a front elevation showing a structure of a portion around an inner cloth of a garment having a waist-adjusting mechanism according to a twenty-ninth embodiment of the invention.

As shown in FIG. 73, the twenty-ninth embodiment of waist adjustable garment modifies the seventh embodiment of the pants 1 such that the socket element 100B of the hook assembly 100 that is fitted on the waist belt 2 of the inner cloth 3*b* is located at a specific position. That is, the socket element 100B has its horizontal center located on an imaginary line along an edge of the worms Fb of the fastener tape Fa.

Consequently, if the hook element (not shown) on the outer cloth is caught on the socket element 100B such that the waist size becomes the largest, the socket element 100B is hidden by the waist belt of the outer cloth and never seen from the outside. Moreover, if the hook element on the outer cloth is caught on the socket element 100B such that the waist size becomes the smallest, there is no distortion generated around the waist belt 2. Thus, it is possible to prevent such a disadvantage as wrinkles.

In the twenty-ninth embodiment, the fitting position of the socket element 100*b* is optimized so that the socket element 100B is hidden from the outside when catching the hook element. Similar effects are obtainable by changing a dimension of the socket element 100B. For example, it is possible to make smaller the width of the socket element 100B so that the socket element 100B is hidden from the outside when catching the hook element.

THIRTIETH EMBODIMENT

Figure 74:
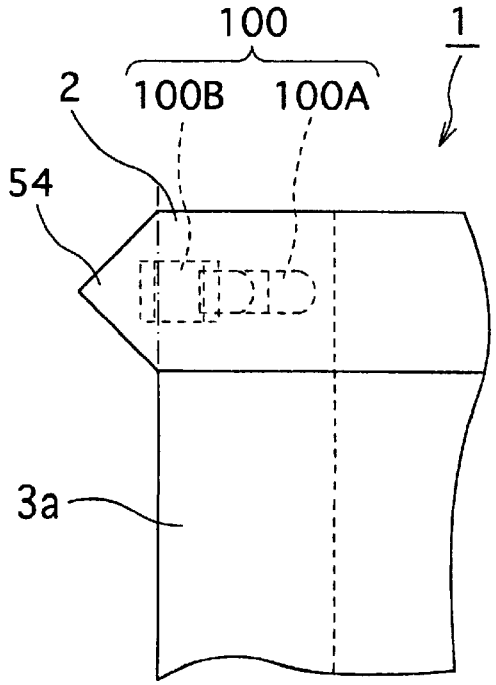
FIG. 74 is a front elevation showing a structure of a portion around an outer cloth of a garment having a waist-adjusting mechanism according to a thirtieth embodiment of the invention.

A thirtieth embodiment is described hereafter. FIG. 74 is a front elevation showing a structure of a portion around an outer cloth of a garment having a waist-adjusting mechanism according to a thirtieth embodiment of the invention.

As shown in FIG. 74, the twenty-ninth embodiment of waist adjustable garment modifies the seventh embodiment of the pants 1 such that a pointed portion 54 of generally an isosceles triangle shape is provided on the edge portion of the waist belt 2 of the outer cloth 3*a* so as to protrude outwardly from the edge of the outer cloth 3*a*.

If the hook element 100A fitted on the rear side of the waist belt 2 of the outer cloth 3*a* is caught on the socket element 100B such that the waist size becomes the largest, part of the socket assembly 10DB may come out of the edge of the waist belt in the aforementioned embodiments. However, according to the present embodiment, such part of the socket element 100B is hidden by the pointed portion 54, and never seen from the outside. Thus, the waist adjustable garment has a good appearance.

The shape of the pointed portion 54 is not limited to the triangle. It may be rectangular, trapezoidal, pentagonal, hexagonal or other polygonal shape or semi-circular shape.

The twenty-ninth embodiment has generally the same structure in the other elements as that of the seventh embodiment of the pants 1 and exhibits generally the same function and effects as the seventh embodiment of the pants 1.

The positioning of the socket element 100B in the twenty-ninth embodiment or the pointed portion 54 in the thirtieth embodiment may be applied to the pants 1 according to each of the eighth to the twelfth embodiments and the nineteenth to the twenty-eighth embodiments.

The preferred embodiments described herein are illustrative and not restrictive, the scope of the invention being indicated in the appended claims and all variations which come within the meaning of the claims are intended to be embraced therein.

What is claimed is:

1. A waist adjustable garment comprising:

a joint tool joining one and another parts of the garment in a separable way and adjusting a waist size of the garment within a predetermined range;

a tuck provided on the one art of the garment so as to extend substantially in a vertical direction, the tuck being capable of changing its shape within such a range as the joint tool adjusts the waist size of the garment; and a zip fastener having one and another fastener tapes, the one fastener tape to be a seam allowance being stitched to the tuck, the other fastener tape to be a seam allowance being stitched to the other part of the garment.

2. A waist adjustable garment according to claim 1, further comprising a lining provided on a rear side of the one part of the garment over an area that is wider than a width of the tuck, the lining being stitched thereto at positions beyond lateral ends of the tuck.

3. A waist adjustable garment according to claim 1, in which a folded part of the one part of the garment is adhered by an adhesive double coated tape to a rear side of the one part of the garment near the tuck.

4. A waist adjustable garment according to claim 1, in which the one part of the garment is sewed in a vertical direction between a lateral end of the one part of the garment and the tuck.

5. A waist adjustable garment according to claim 1, in which an inner folded part of the tuck is pressed by an iron.

6. A waist adjustable garment according to claim 1, in which an inner folded part of the tuck is pleated.

7. A waist adjustable garment according to claim 1, in which an inner folded part of the tuck is stitched along a crease of the inner folded part of the tuck.

8. A waist adjustable garment according to claim 1, in which an upper end portion of the one fastener tape is stitched to the garment while inclined in an outside direction toward a front center opening of the garment.

9. A waist adjustable garment according to claim 1, further comprising a sliding tape, an upper end of the one fastener tape being stitched to an upper end of the one part of the garment via the sliding tape, the sliding tape being stitched at an inclination in an outside direction toward a front center opening of the garment.

10. A waist adjustable garment according to claim 1, further comprising two elastic tapes, an upper end of the one fastener tape being stitched to an upper end of the one part of the garment via the elastic tapes, the elastic tapes being stitched to the garment so as to define substantially a V-shape in combination.

* * * * *